US011986741B1

(12) United States Patent
Young

(10) Patent No.: US 11,986,741 B1
(45) Date of Patent: May 21, 2024

(54) APPARATUS AND METHOD FOR A BOARD GAME

(71) Applicant: Jason Bryan Young, Hillsborough,, NJ (US)

(72) Inventor: Jason Bryan Young, Hillsborough,, NJ (US)

( * ) Notice: Subject to any disclaimer, the term of this patent is extended or adjusted under 35 U.S.C. 154(b) by 0 days.

(21) Appl. No.: 18/513,102

(22) Filed: Nov. 17, 2023

Related U.S. Application Data

(60) Provisional application No. 63/484,880, filed on Feb. 14, 2023, provisional application No. 63/386,479, filed on Dec. 7, 2022.

(51) Int. Cl.
*A63F 3/02* (2006.01)
*A63F 3/00* (2006.01)

(52) U.S. Cl.
CPC ..... *A63F 3/02* (2013.01); *A63F 3/00895* (2013.01); *A63F 2003/00927* (2013.01)

(58) Field of Classification Search
CPC ..... A63F 3/02; A63F 3/00895; A63F 2003/00927
See application file for complete search history.

(56) References Cited

U.S. PATENT DOCUMENTS 4,232,864 A * 11/1980 Yaworsky ..... A63F 3/00214 273/287
5,087,052 A * 2/1992 Simon ..... A63F 3/00 273/272
2012/0098196 A1* 4/2012 Roberts ..... A63F 3/00533 273/287
2014/0084539 A1* 3/2014 Dolk ..... A63F 3/02 273/260

OTHER PUBLICATIONS

Anarchy Chess, publishes by TroyBenites 3 years ago from Jan. 27, 2024 at https://www.reddit.com/r/chessvariants/comments/kvsa4z/anarchy_chess_no_king/#:~:text=Like%20regular%20chess%2C%20but%20there,no%20moves%20in%20it's%20turn (Year: 2021).*
Anarchy Chess (Year: 2021).*

* cited by examiner

*Primary Examiner* — Michael D Dennis
(74) *Attorney, Agent, or Firm* — Walter J. Tencza, Jr.

(57) ABSTRACT

A game apparatus including a plurality of first and second player game pieces, each having a first portion that is a chess piece, such that the plurality of first and second player game pieces include all the pieces for a first and second player, respectively for a game of chess. Each of the plurality of first and second player game pieces has a second portion fixed to a corresponding first portion. Each second portion has a recess so that a cube can be inserted into the recess so the cube cannot be seen from a front of the second portion. The game apparatus may further include a base; a grid; and a first and/or second plurality of insert pieces. The grid and the base form a chessboard pattern of a plurality of grid spaces. Each of the insert pieces fits within a space of the plurality of grid spaces.

25 Claims, 57 Drawing Sheets

APPARATUS AND METHOD FOR A BOARD GAME

CROSS REFERENCE TO RELATED APPLICATION(S)

The present application claims the priority of U.S. provisional patent application Ser. No. 63/386,479, titled "MULTI-DIMENSIONAL CHESS GAME", filed on Dec. 7, 2022, inventor Jason Bryan Young; and the present application claims the priority of U.S. provisional patent application Ser. No. 63/484,880, titled "MULTI-DIMENSIONAL CHESS GAME (CHANCE CHESS)" filed on Feb. 14, 2023, inventor Jason Bryan Young.

FIELD OF THE INVENTION

This invention relates to devices concerning board games.

BACKGROUND OF THE INVENTION

There are various known board games.

Playing a board game in accordance with a set of rules generally involves some combination of luck, variability, and/or skill. Some games utilize all three of these characteristics. Others are purely luck-based, skill-based, or either luck or skill based with some degree of variability. Luck in a board game refers to the occurrence or nonoccurrence of an unpredictable event, feature, or other attribute of the game through chance. Instructing players to roll a pair of dice, flip a coin, and/or spin a spinner are all examples of ways in which games incorporate luck through player participation without giving the players control over specific results. Such player rolls, flips, or spins may determine how pieces are to be moved, where they ultimately land, and/or whether or not one or more new rules, parameters, or other factors impact the game.

Variability with respect to a board game refers to the game's flexibility and/or the number of variations or modifications the game allows in its initial setup and arrangement. In a variable game, the players may agree on one of a plurality of potential board setups, arrangements, and/or rules consistent with the overarching rules of the game. In the game of poker, for example, variability or flexibility is a factor at the start of each round, where every hand has the possibility of different chip stacks, different players, and different dealer button positions indicating turn order. As another example, in the game 'Settlers of Catan,' players set up a board made up of hexagonal tiles by placing the tiles in any order, and assign a number to each tile associated with a dice roll. This type of variability allows for a new board every game with complete visibility (i.e., provides all initial information) to both players. While each roll of the dice involves luck, the initial board setup is variable and controlled by the players. Individual player setups may be strategically based, but may also turn out to be lucky depending on subsequent dice rolls.

Stratego (trademarked) is another example of a variable game, but one which has only partial visibility to the players. Each player can control his or her initial setup of forty individual pieces while keeping the type of each piece secret from an opponent. Since each piece is identically shaped and only marked on one side, the opposing player cannot see which types of pieces his or her opponent has at particular squares unless the opposing player attacks the pieces at those squares, has his pieces attacked by the opponent's pieces, or deduces/infers piece identities through watching their movements or lack thereof. Stratego's high variability with incomplete visibility to the players allows players to strategize their initial setups (e.g., such as surrounding a flag with bombs which can only be survived by an '8' piece or a '3' piece, depending on the particular version of the game). Players can try attacking certain pieces, and may have success through luck and/or intelligent guesses based on observations and memories of where other pieces lie. Players can also employ tactics at which they may be skillful, such as concealing body language, bluffing, reading an opponent's body language, or inferring information from an opponent's moves. Games with high variability thus avoid or minimize repetition and unfair pattern recognition by a player, and continually give rise to new scenarios or obstacles for players to navigate.

Skill with respect to a board game refers to a player's expertise and ability to play the game well, both generally and in specific circumstances (i.e., in particular board positions). A player's skills may include, for example, knowledge of probabilities (e.g., of particular hands in a game of poker), hand-eye coordination, thinking ability, spatial reasoning, reading a player's emotions or non-verbal communication, planning ability, bluffing, predicting an opponent's subsequent moves and counter-attacks, and reasoning through or envisioning potential scenarios or permutations arising from the game's current position.

Chess is a game that is solely skill based, and does not incorporate luck or variability in either its initial setup or its governing rules during play. At the beginning of and throughout a chess game, all information about the game itself is known and visible to both players at all times. All chess games are set up identically, and played in accordance with identical or virtually identical rules. The chess board, the pieces used on the board, and the rules governing play are all rigid and immutable from start to finish. The only characteristic of chess that varies is which player plays the white pieces and moves first, and which player plays the black pieces and moves second. Players who play each other more than once typically alternate between playing with the white and black pieces, and thereby take turns going first with each new game. Each chess player controls sixteen white or black chess pieces (i.e., one king, one queen, two rooks, two bishops, two knights, and eight pawns) on a chessboard having sixty-four squares arranged in an eight-by-eight grid. The object of the game is to checkmate an opponent's king. Checkmate is reached when the king is attacked (placed in "check") and has no way out of it (i.e., a player cannot kill the piece attacking the king, block the piece that has a line of sight on attacking the king, or move the king to any other square to avoid the attack because all other squares within the king's reach are either inhabited by the player's own pieces or protected (i.e., within range of one or more opponent pieces). The rules of traditional chess have been known since the fifteenth century, and are published by FIDE (Fédération Internationale des Échecs), chess's international governing body, in its Handbook: "Fide Laws of Chess taking effect from 1 Jan. 2018", which is hereby incorporated by reference herein in its entirety, and available at https://handbook.fide.com/chapter/E012018.

When two chess players play in person, they move the individual chess pieces on a two-dimensional board to one of sixty-four potential locations on an eight-by-eight grid in accordance with the rules. Chess pieces are self-standing, and slide freely along and extend generally perpendicular to the chess board. As a result, if the chess board is jostled by either player or a third party, or inadvertently struck by an object, then the chess pieces tend to fly off of the board, even if magnetized and temporarily held to the board via magnetic attraction. If a chess game needs to be stopped and continued at another time or date, then preserving the positional relationship of the pieces on the board can be tricky because chess game packaging and assemblies generally require that the chess pieces be stored in one or more separate compartments, bags, or other areas where they are lumped together.

While some chess games include a cover that may be placed over the game with the pieces magnetically mounted to the board, such covers either take up a lot of space or are part of a miniature chess set that has very small pieces. Moreover, even if the chess game is covered with the pieces standing and magnetically attracted to the board, if the packaged or covered chess game assembly is jostled (which is highly likely when the game is moved/transported), then the positional relationship of the pieces on the board are easily disturbed or lost completely. Thus, without the time consuming and generally laborious process of writing down individual piece locations/positions, a chess game can be easily disrupted and/or irretrievably lost when stopped or moved, or during play in an active area such as a park.

Since chess is a skill-only game, and does not allow for variability or luck during either the initial set-up or during play, it can be discouraging to beginners, novices, or relative newcomers. For example, chess does not give beginners or players with low skill levels any reasonable chance of competing with players at much higher skill levels. Additionally, much of modern chess play is about theory, pattern recognition, and rote memorization. Even advanced players can get overwhelmed, lose the desire to play, and burn out. Moreover, the increased computing power of computers has allowed for the development of improved models, simulations, and game theory through brute force, which has taken a lot of the fun and creativity out of the game.

For highly advanced players, chess has largely been reduced to attempts at incremental improvements to known openings and positions, avoiding mistakes, and/or players trying to improve their ratings through intense study. Even beginners who have a lot of potential to become skilled at the game cannot compete with experienced players because they do not know the positional patterns, particularly during fast moving timed chess games such as "blitz" or "rapid." The energy and time a beginner needs to analyze a particular chess position are generally far greater than the time and energy an experienced player needs because the experienced player has already encountered and/or studied many positional patterns which arise during the game. While such knowledge does relate to the experienced player's skill, and might be viewed as a reward for an experienced player's commitment to the game, it also confers a huge (and perhaps unfair) advantage, regardless of a novice opponent's reasoning ability, creativity, and/or other skills.

SUMMARY OF THE INVENTION

One or more embodiments of the present invention address many of the issues associated with the traditional game of chess by adding elements of variability and luck, by allowing for player customization, and by modifying the chess board in a way that maintains the look and feel of the classic board, yet also incorporates new rules and features through one or more customizable rule-based layers which the players secretly preset in association with locations on the chess board, and/or in association and movable with one or more chess pieces. The modified chess board of one or more embodiments of the present invention also maintains the positional integrity of the pieces and the customized pre-set rule-based layers within individual compartments of the board during live and temporarily suspended games. The invention also facilitates changes to the game, such as bluffing, which allow it to be played on different levels.

The exponentially increased flexibility/variability of the invention will allow beginners to compete with more experienced players, but will also allow more experienced participants to, using both their knowledge of the classical rules of chess, previously encountered patterns or setups, and the new rules, think creatively, anticipate events, and plan board setups to influence the outcome of the game in a way that may not be noticeable or as readily obvious to a novice. It is anticipated that the present invention will also change the manner in which computerized models, including even artificial intelligence (AI) analyses of the game, are conducted due to the virtually limitless possibilities and permutations of alternate style chess games which may be played in accordance with the invention.

One or more embodiments of the present invention will also help humans to better compete against computers in the game of chess by leveling the playing field through introducing various elements of chance and variability. Computers have been better at chess than humans for over two decades. Deep Blue, created by IBM (trademarked), was a chess playing system that defeated the world chess champion, Garry Kasparov, in 1997. Today, chess playing systems such as Stockfish have evolved to higher levels than, and play better than, Deep Blue. Computers cannot reliably anticipate the added levels of flexibility/variability and chance incorporated by the present invention. Additionally, such variability and chance allow for the development of new pattern recognition, strategies, and game theories that computers are unaware of because they do not yet exist. One or more embodiments of the present invention thus enable humans to once again compete with computers in the game of chess.

Chess is a two player game where each player takes turns moving. One or more embodiments of the present invention allow for a player to achieve an "extra turn" by activating a hidden trap removing pieces. In this instance, it can be argued that going first no longer nets an advantage as a bomb allows for a free turn upon the activation of a trap.

Certain embodiments of the invention are disclosed in the form of a physical chess board assembly configured for in-person play. Other embodiments of the invention utilize a computer-generated game that can be played by participants online or with any computing device (e.g., a remote mobile computing device) which runs a stored or accessible program or a downloadable app. The invention thus presents a new multi-dimensional version of chess by adding to but maintaining the traditional rules of chess, the traditional sixteen chess pieces used by each player, and the traditional sixty-four square, two-dimensional space through which the chess pieces move. The incorporation of one or more preset customizable rule-based layers associated with the pieces and/or the squares of the chess board, as well as other elements of luck and variability discussed herein, allows people of varying skill levels to compete with or without handicaps, constantly presents new scenarios to analyze, provides a high level of variability to the game, and reduces barriers for those who wish to enjoy the game, but are overwhelmed by its long history and/or intimidated by higher skilled and experienced players. The invention incorporates the characteristics of luck and variability into the skill-based classical game of chess in a way that can be applied to a wide variety of other board games that are missing one or more of these three major game characteristics. For example, the one or more preset customizable rule-based layers described herein (i.e., stacked layered squares of a board, each of which has one or more rules associated with a particular location on the board or a piece movable on the board) could also be applied to other board games such as monopoly. The preset rules may be integrated with a board during play, or stored in separate compartments such as a chest with drawers, a box, a markup sheet, and the like, with one or more written rules corresponding to each square of the board.

The invention provides non-traditional methodologies that facilitate competitive challenges between participants at all skill levels. Other objects, features, and characteristics of the invention, as well as the methods of operation and functions of the related structural elements and the combination of parts and method steps, will become apparent upon consideration of the description herein with reference to the figures and illustrations included herein, all of which form a part of this specification. The figures and illustrations included herein are not intended to limit the scope of the invention, but merely to clarify and exemplify it.

The present disclosure is not intended to be limited to the specific terminology selected, and it will be understood that each specific element of systems disclosed herein and schematically depicted include all technical equivalents which operate in a similar manner. Techniques, methods, systems, and operating structures in accordance with the invention may be embodied in a wide variety of forms and modes, some of which may be quite different from those in the disclosed embodiments. Consequently, the specific structural, functional, and step-by-step details disclosed herein are merely representative. The embodiments herein are described in sufficient detail to enable those skilled in the art to practice the embodiments, and it is to be understood that logical, mechanical, and other changes may be made without departing from the scope of the embodiments, and that the description herein is not to be taken in a limiting sense.

In at least one embodiment of the present application a game apparatus is provided comprising: a plurality of first player game pieces, each of which has a first portion that is a chess piece, such that the plurality of first player game pieces include all the pieces for a first player for a game of chess; a plurality of second player game pieces, each of which has a portion that is a chess piece, such that the plurality of second player game pieces include all the pieces for a second player for a game of chess; and wherein each of the plurality of first player game pieces has a second portion fixed to a corresponding bottom of a corresponding first portion of each the plurality of first player game pieces; wherein each of the plurality of second player game pieces has a second portion fixed to a corresponding bottom of a corresponding first portion of each the plurality of first player game pieces; wherein each second portion of each of the plurality of first player game pieces has a recess at a rear of the second portion so that a cube is configured to be inserted into the recess in a manner so the cube cannot be seen from a front of the second portion; and wherein each second portion of each of the plurality of second player game pieces has a recess at a rear of the second portion so that a cube is configured to be inserted into the recess in a manner so the cube cannot be seen from a front of the second portion.

The game apparatus may further include a base; a grid; and a first plurality of insert pieces; wherein the grid and the base form a chessboard pattern of a plurality of grid spaces; and wherein each of the first plurality of insert pieces fits within a space of the plurality of grid spaces.

The game apparatus may further include a second plurality of insert pieces; and wherein each of the second plurality of insert pieces fits within a space of the plurality of grid spaces.

In at least one embodiment of the present application, each of the first plurality of insert pieces is configured to sit on top of one of the second plurality of insert pieces within a space of the plurality of grid spaces. Each of the first plurality of insert pieces and/or each of the second plurality of insert pieces may have a device which is subject to magnetic attraction.

In at least one embodiment of the present invention, each of the first and/or second plurality of insert pieces may have a device which toggles from an expansion state to a contraction state when pressed.

In at least one embodiment, the grid and the base form a chessboard pattern of a plurality of grid spaces, such that each of the plurality of grid spaces is surrounded by four walls at right angles to each other; and wherein each of the first plurality of insert pieces fits within a space of the plurality of grid spaces, such that each of the first plurality of insert pieces is surrounded by four walls at right angles to each other. Each of the second plurality of insert pieces may be configured to fit within a space of the plurality of grid spaces, such that each of the second plurality of insert pieces is surrounded by four walls at right angles to each other.

In at least one embodiment of the present invention, each of the first plurality of insert pieces is configured to sit on top of one of the second plurality of insert pieces within a space of the plurality of grid spaces, such that each of the first plurality of insert pieces and each of the second plurality insert pieces is surrounded by four wall at right angles to each other.

In at least one embodiment of the present invention, the base has a plurality of openings aligning with the plurality of grid spaces, such that the first plurality of insert pieces is configured to cover the plurality of openings, but not fall through the plurality of openings; and wherein the base has four corners, and there is a leg at each of the four corners lifting up a bottom of the base so that one can reach under the bottom of the base and push out through each of the plurality of openings each corresponding pieces of the first plurality of insert pieces.

In at least one embodiment, there is a drawer located underneath the bottom of the base, wherein the drawer is configured to be pulled out from under the base.

A method is also provided which includes playing a game with a plurality of first player game pieces and a plurality of second player game pieces, wherein the game is played on a chess board pattern; wherein each of the plurality of first player game pieces has a first portion that is a chess piece, such that the plurality of first player game pieces include all the pieces for a first player for a game of chess; wherein each of the plurality of second player game pieces, has a first portion that is a chess piece, such that the plurality of second player game pieces include all the pieces for a second player for a game of chess; and wherein each of the plurality of first player game pieces has a second portion fixed to a corresponding bottom of a corresponding first portion of each the plurality of first player game pieces; wherein each of the plurality of second player game pieces has a second portion fixed to a corresponding bottom of a corresponding first portion of each the plurality of first player game pieces; wherein each second portion of each of the plurality of first player game pieces has a recess at a rear of the second portion so that a cube is configured to be inserted into the recess in a manner so the cube cannot be seen from a front of the second portion; and wherein each second portion of each of the plurality of second player game pieces has a recess at a rear of the second portion so that a cube is configured to be inserted into the recess in a manner so the cube cannot be seen from a front of the second portion.

The chessboard pattern may be formed by a grid and a base; wherein each of a first and/or second plurality of insert pieces fits within a space of the plurality of grid spaces.

The method may include playing the game with structure previously specified.

DETAILED DESCRIPTION OF THE DRAWINGS

Figure 1:
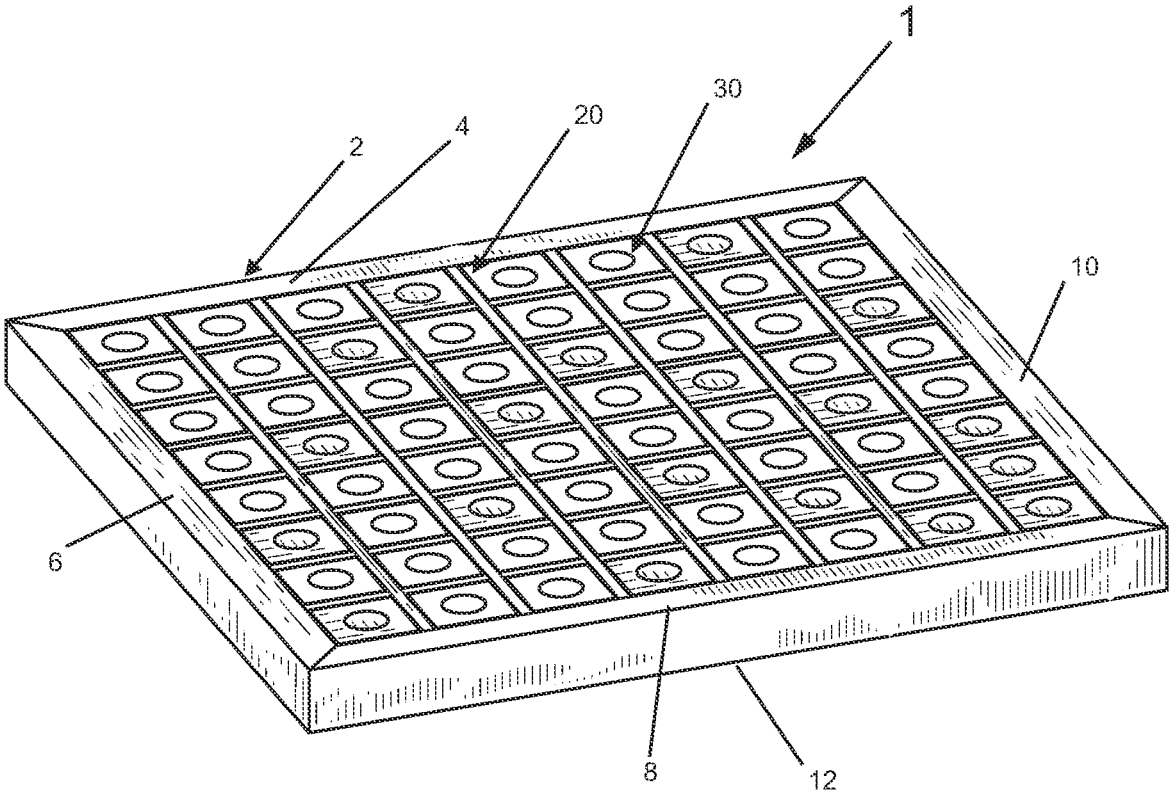
FIG. 1 is a left side, top, and front perspective view of the game board apparatus, in accordance with the present invention, wherein the game board apparatus is shown in a fully assembled state.
Figure 8:
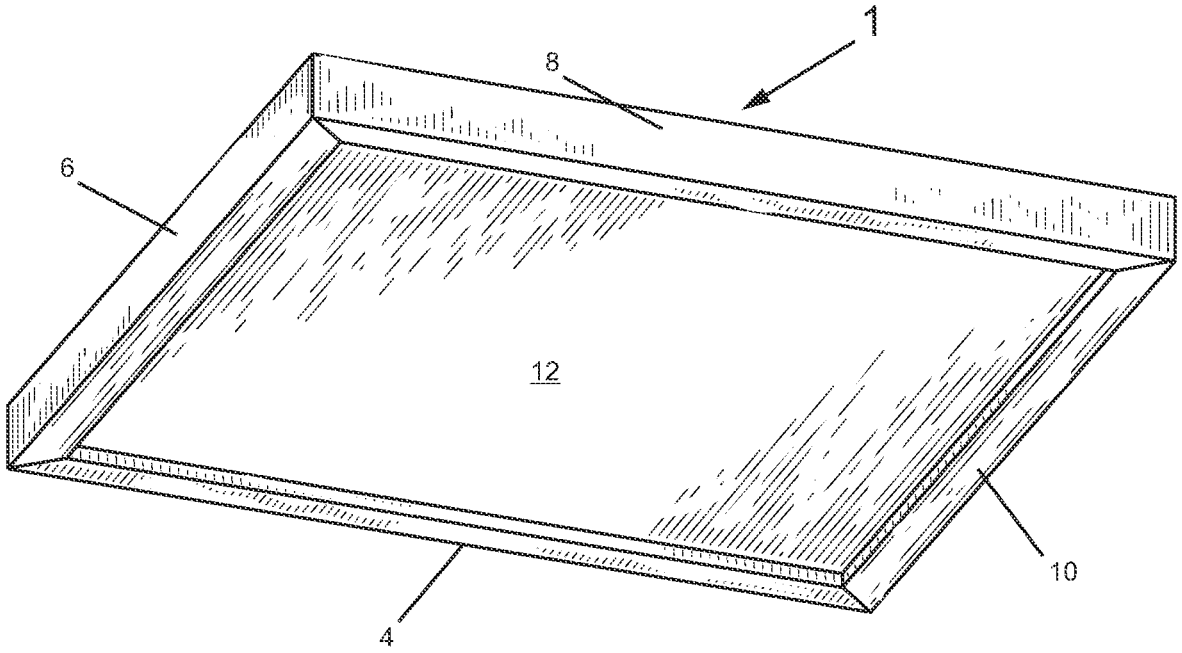
FIG. 8 is a left side, bottom, and rear perspective view of the game board apparatus in the fully assembled state.

FIG. 1 is a left side, top, and front perspective view of the game board apparatus 1, in accordance with the present invention, wherein the game board apparatus 1 is shown in a fully assembled state. FIGS. 2-7 are front elevational, rear elevational, left side elevational, right side elevational, top plan, and bottom plan views, respectively, of the game board apparatus 1 in the fully assembled state. FIG. 8 is a left side, bottom, and rear perspective view of the game board Apparatus 1 in the fully assembled state.

Referring to FIGS. 1-8, the game board apparatus 1 includes a base 2, a grid 20, and a plurality a first type of game pieces 30, which make up a first layer.

Figure 9:
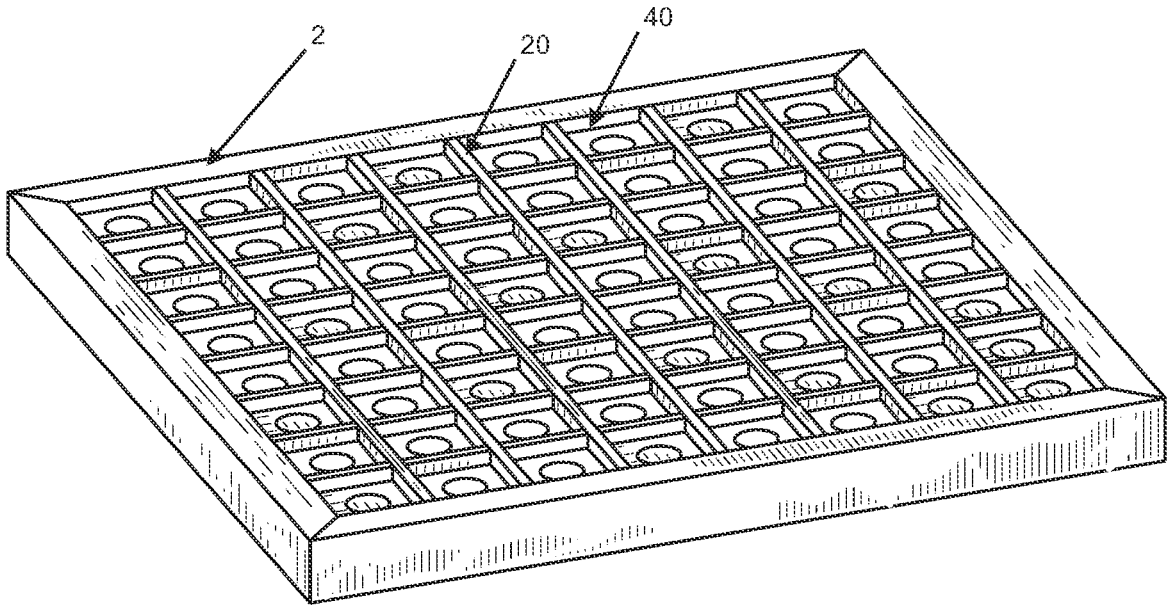
FIG. 9 is a left side, top, and front perspective view of a first part of the game board apparatus in a first partial state, in accordance with the present invention, wherein a first layer of pieces have been removed from the fully assembled game board apparatus.
Figure 10:
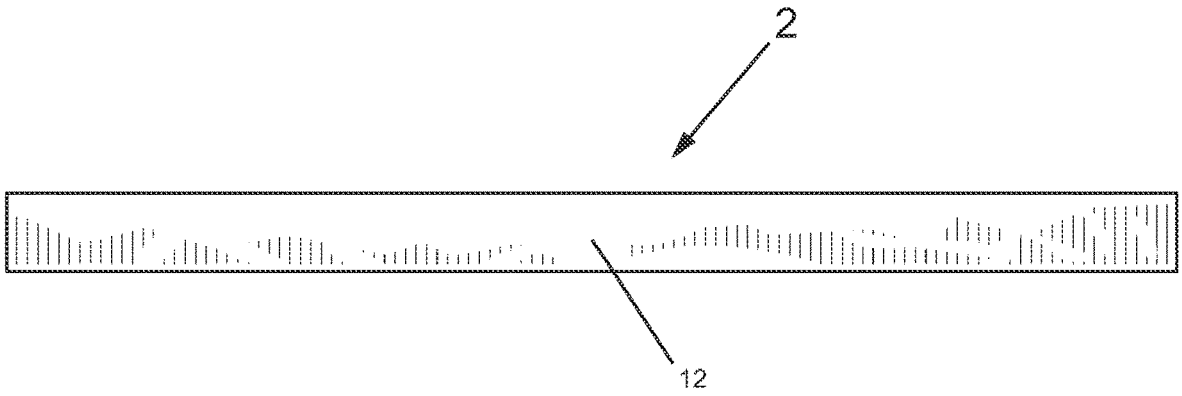
FIG. 10 is a front elevational view of the first part of the game board apparatus in the first partial state.
Figure 11:
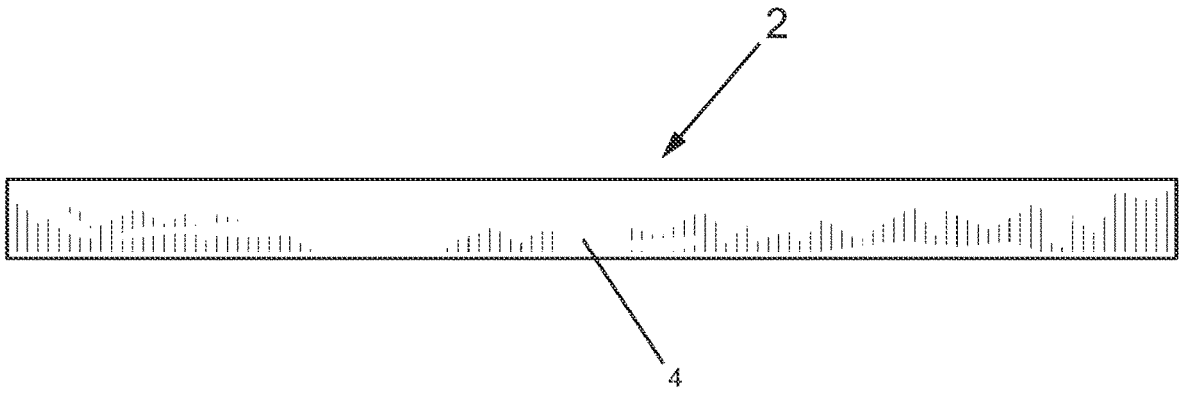
FIG. 11 is a rear elevational view of the first part of the game board apparatus in the first partial state.
Figure 12:
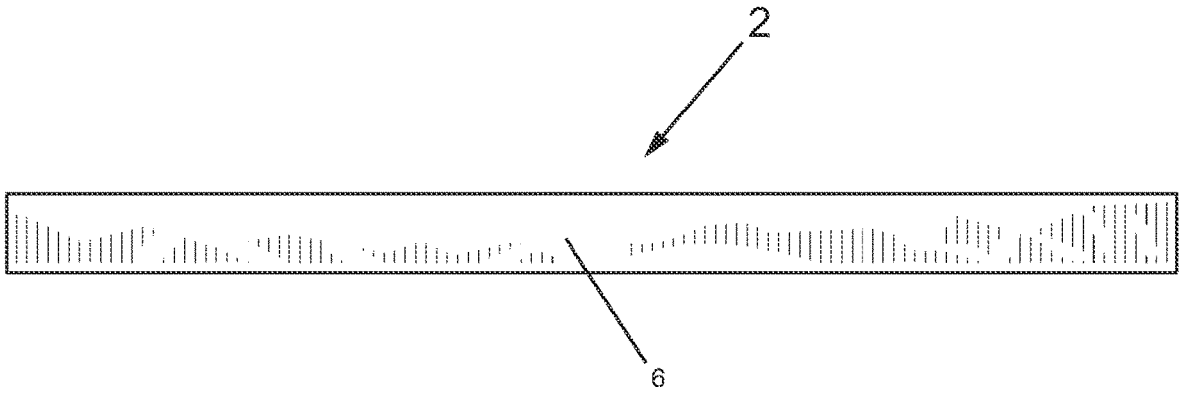
FIG. 12 is a left side elevational view of the first part of the game board apparatus in the first partial state.
Figure 13:
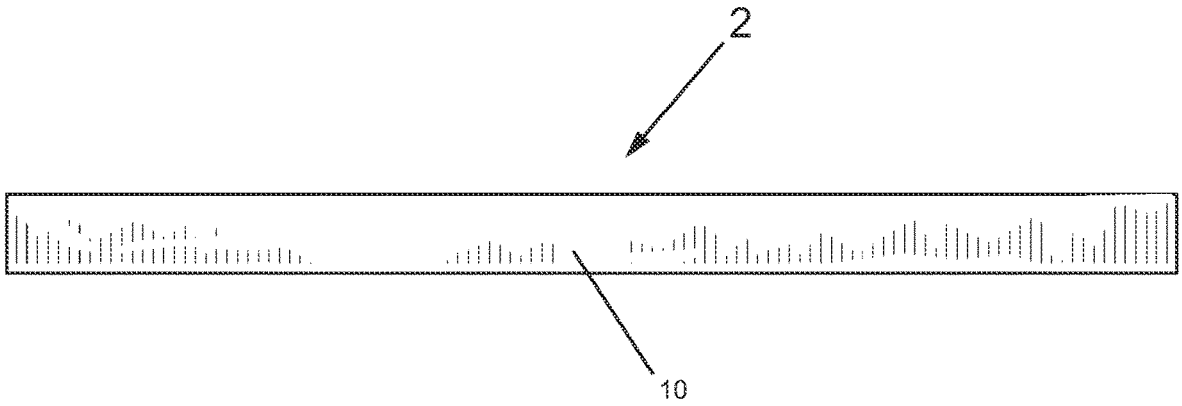
FIG. 13 is a right side elevational view of the first part of the game board apparatus in the first partial state.
Figure 14:
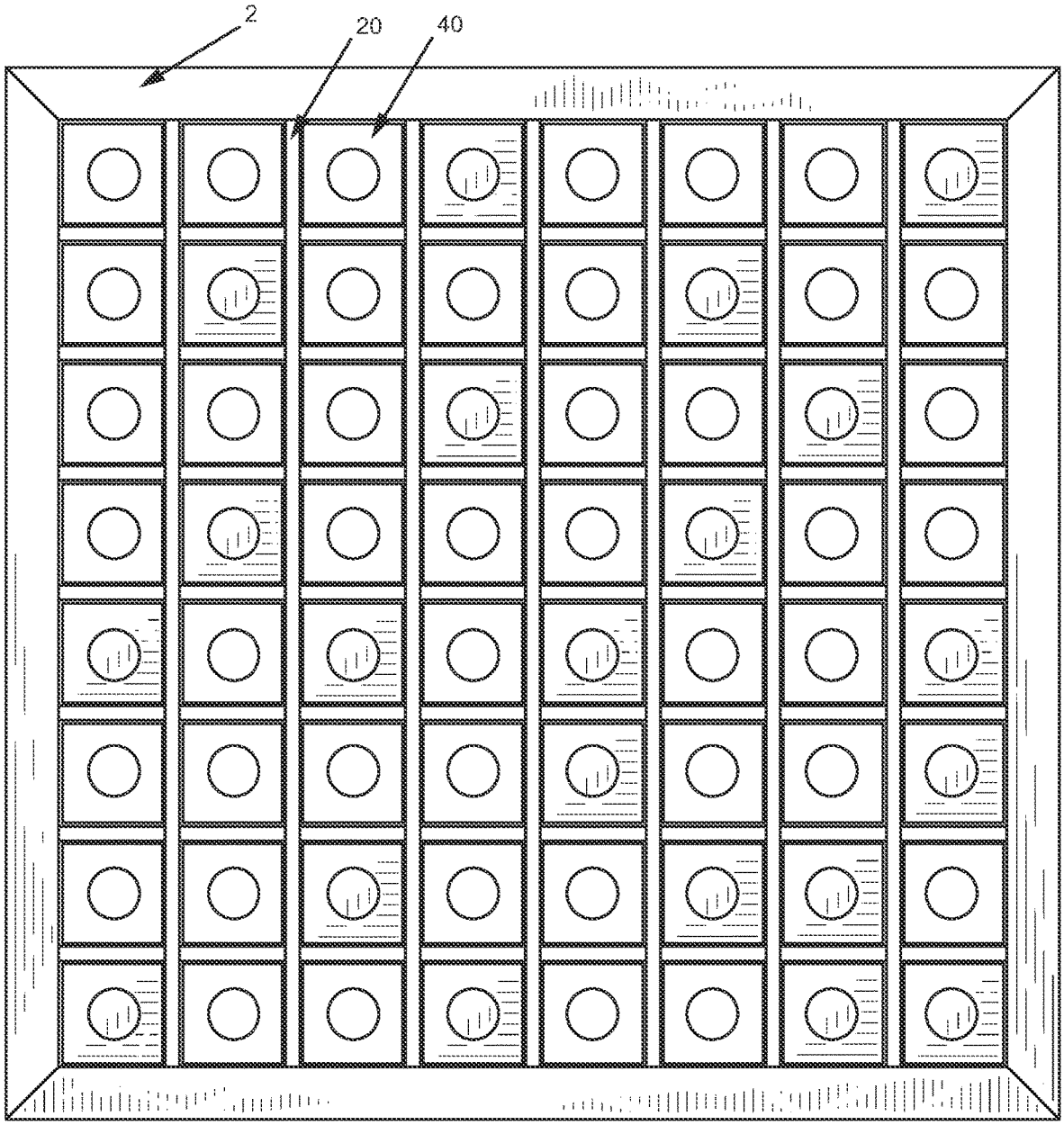
FIG. 14 is a top plan view of the first part of the game board apparatus in the first partial state.
Figure 15:
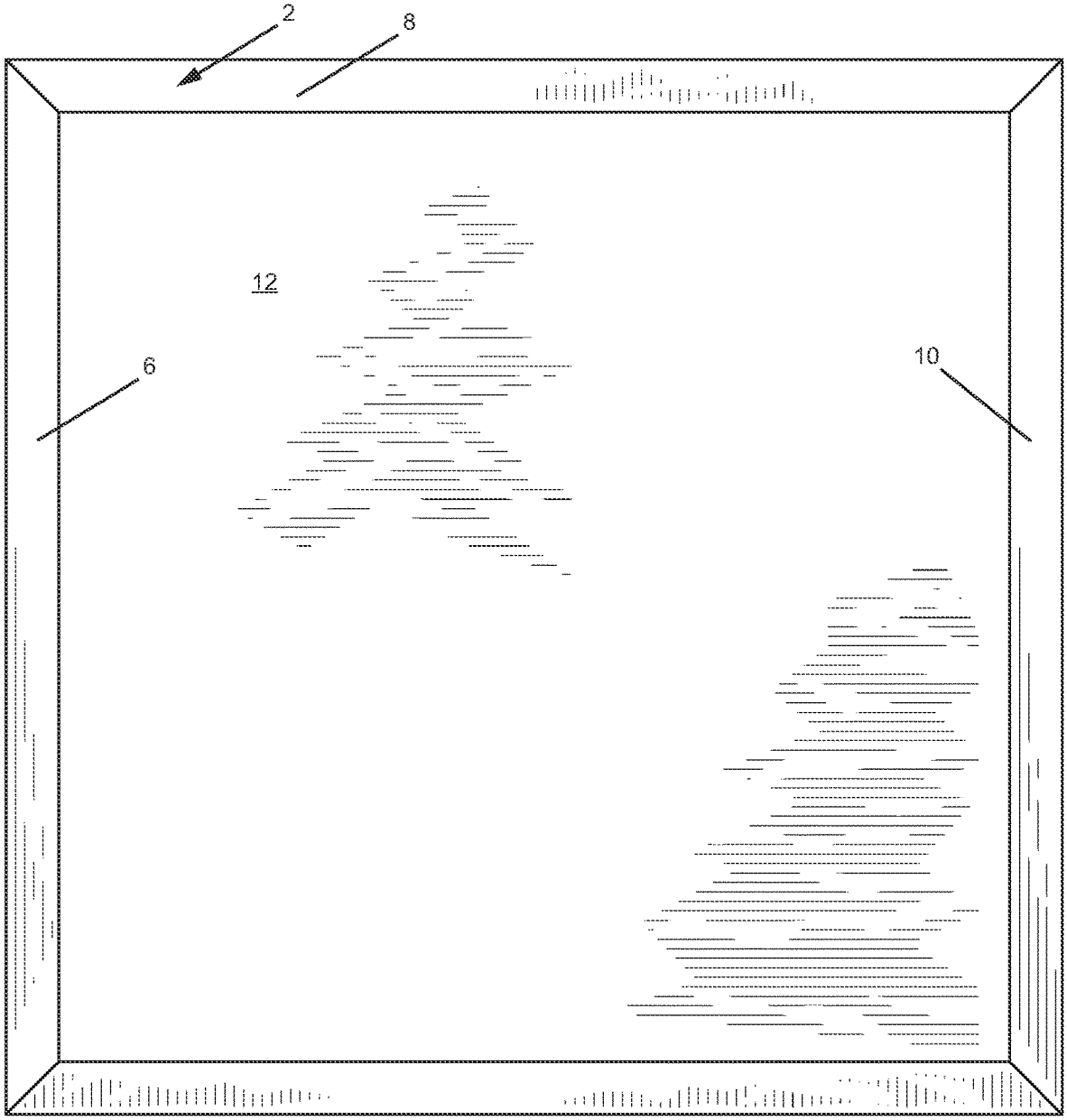
FIG. 15 is a bottom plan view of the first part of the game board apparatus in the first partial state.
Figure 16:
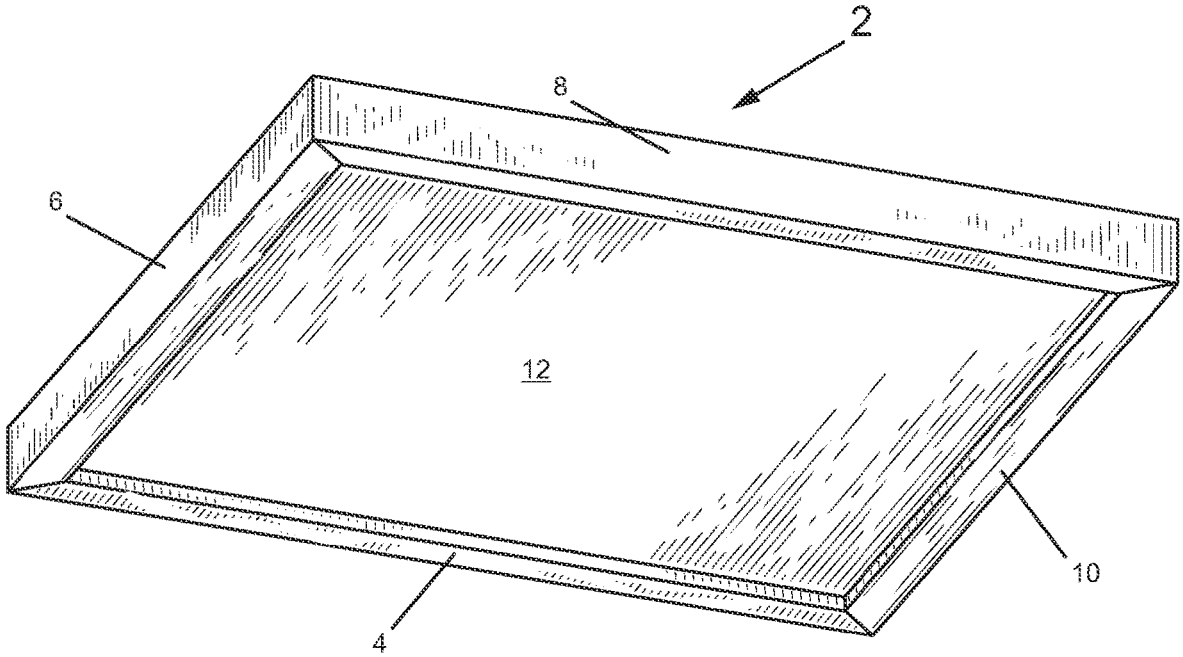
FIG. 16 is a left side, bottom, and rear perspective view of the first part of the game board apparatus in the first partial state.

FIG. 9 is a left side, top, and front perspective view of a first part of the Game Board Apparatus 1 in a first partial state, in accordance with the present invention, wherein the first layer of the first type of game pieces 30 have been removed from the fully assembled Game Board Apparatus 1. FIGS. 10-15 are front elevational, rear elevational, left side elevational, right side elevational, top plan, and bottom plan views, respectively, of the first part of the game board apparatus 1 in the first partial state. FIG. 16 is a left side, bottom, and rear perspective view of the first part of the game board apparatus 1 in the first partial state.

Referring to FIGS. 9-16, the game board apparatus 1 further includes a plurality of a second type of game pieces 40, which make up a second layer. The second layer of game pieces 40 lies underneath the first layer of game pieces 30, and between the bottom 12 of the base 2 and the first layer of game pieces 30, when the game board apparatus 1 is fully assembled as in FIGS. 1-8, but the second layer of game pieces 40 is obscured and cannot be seen or at least cannot be seen clearly in FIGS. 1-8.

Figure 17:
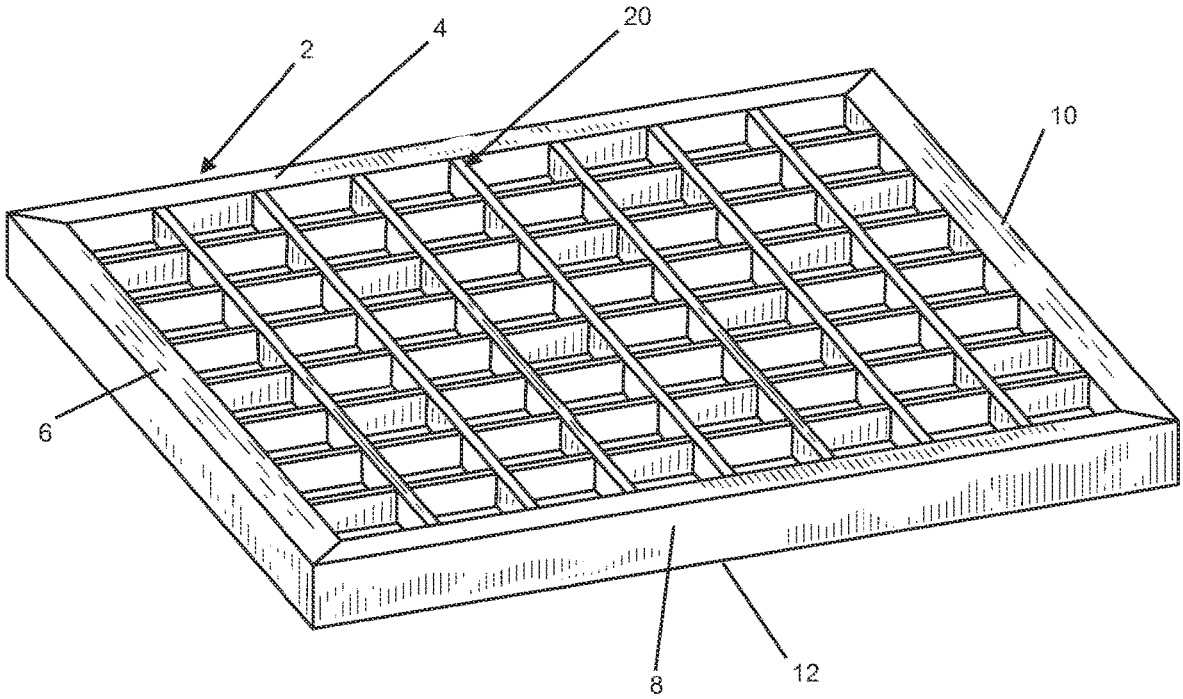
FIG. 17 is a left side, top, and front perspective view of a second part of the game board apparatus in a second partial state, in accordance with the present invention, wherein the first layer of pieces, and a second layer of pieces have been removed from the fully assembled game board apparatus.
Figure 18:
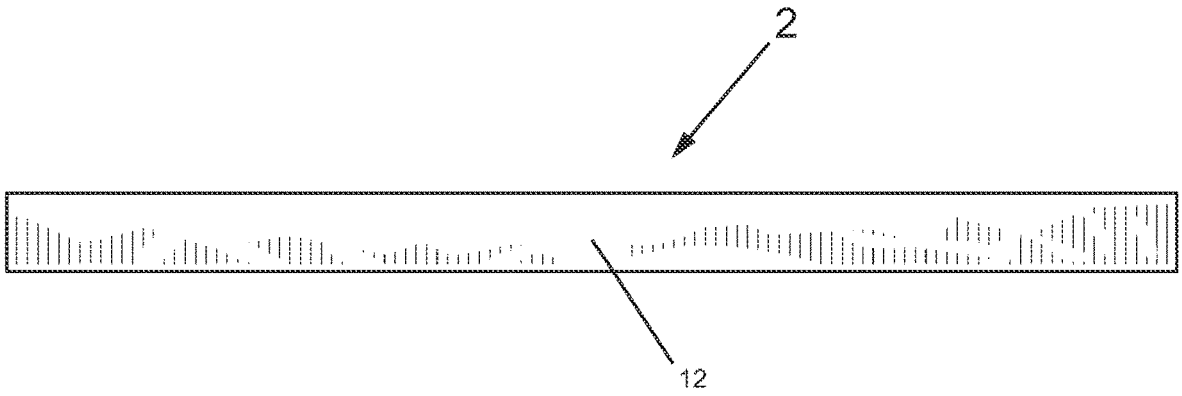
FIG. 18 is a front elevational view of the second part of the game board apparatus in the second partial state.
Figure 19:
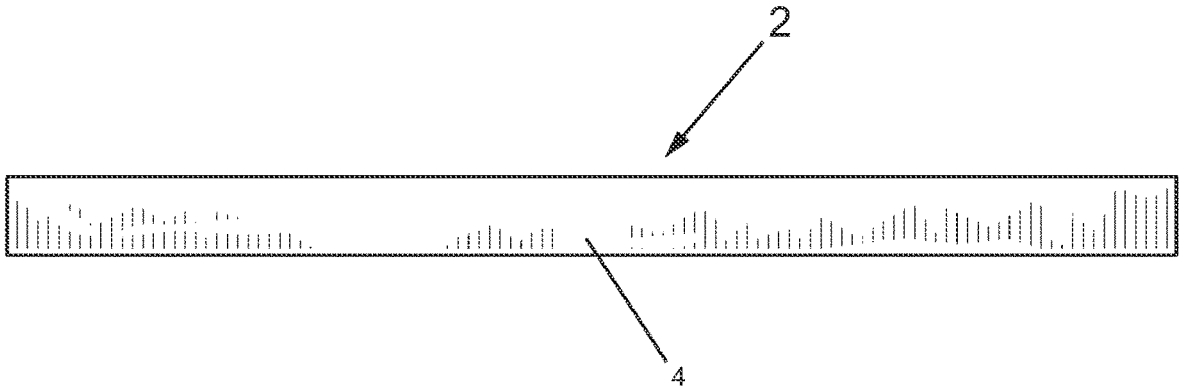
FIG. 19 is a rear elevational view of the second part of the game board apparatus in the first partial state.
Figure 20:
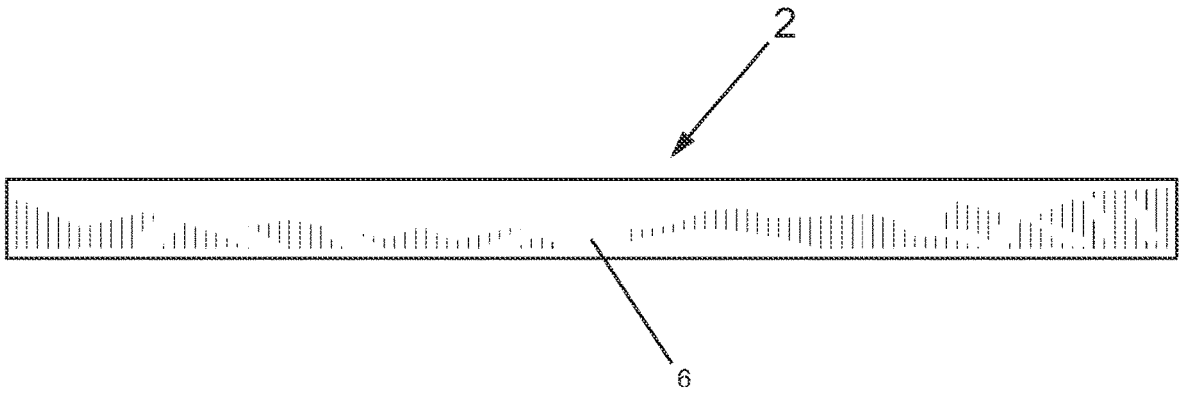
FIG. 20 is a left side elevational view of the second part of the game board apparatus in the second partial state.
Figure 21:
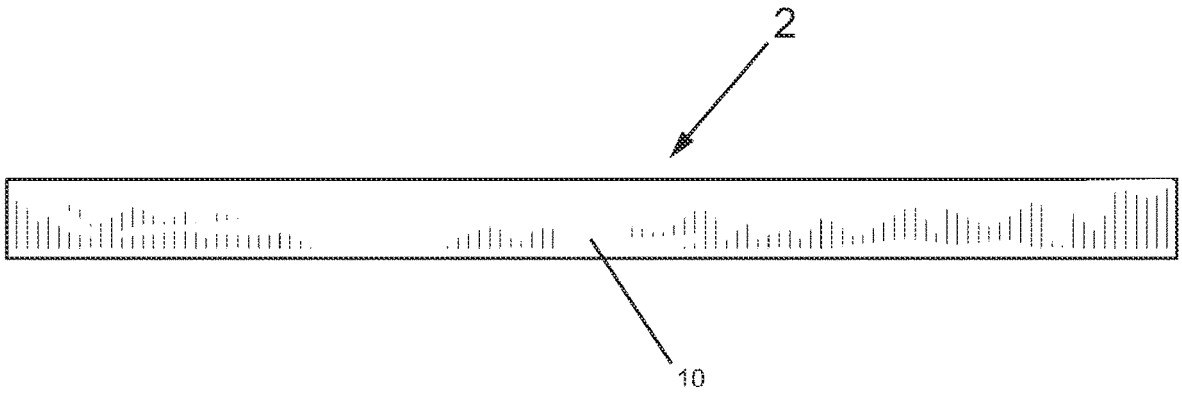
FIG. 21 is a right side elevational view of the second part of the game board apparatus in the second partial state.
Figure 24:
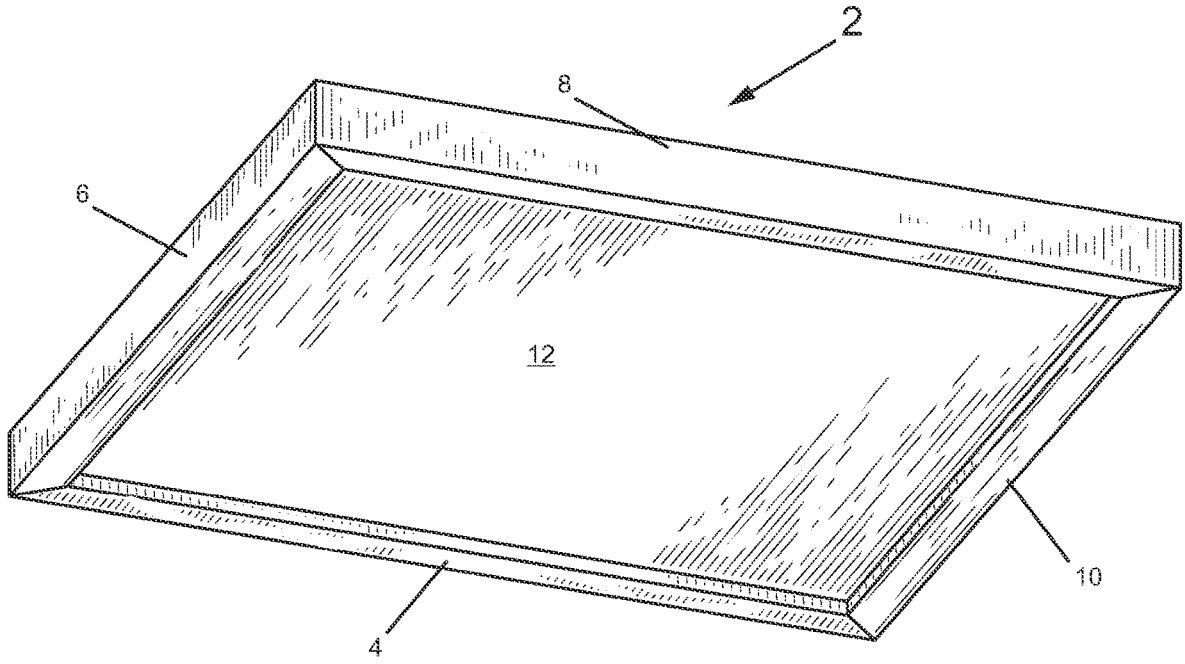
FIG. 24 is a left side, bottom, and rear perspective view of the second part of the game board apparatus in the second partial state.

FIG. 17 is a left side, top, and front perspective view of a second part of the game board apparatus in a second partial state, in accordance with the present invention, wherein the first layer of pieces 30, and the second layer of pieces 40 have been removed from the fully assembled game board apparatus 1. FIGS. 18-23 are front elevational, rear elevational, left side elevational, right side elevational, top plan, and bottom plan views, respectively, of the second part of the game board apparatus 1 in the second partial state. FIG. 24 is a left side, bottom, and rear perspective view of the second part of the game board apparatus 1 in the second partial state.

Figure 22:
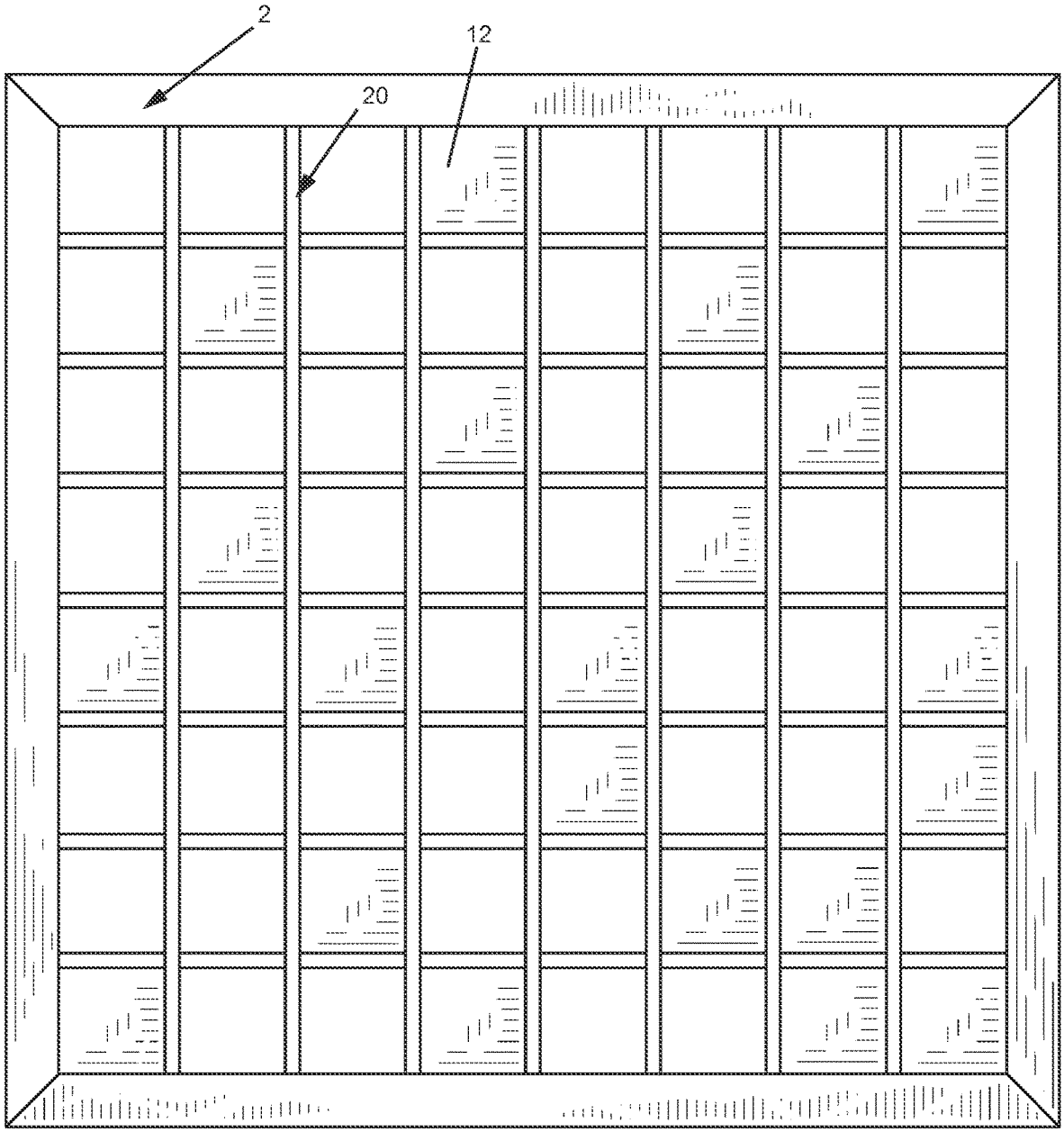
FIG. 22 is a top plan view of the second part of the game board apparatus in the second partial state.
Figure 23:
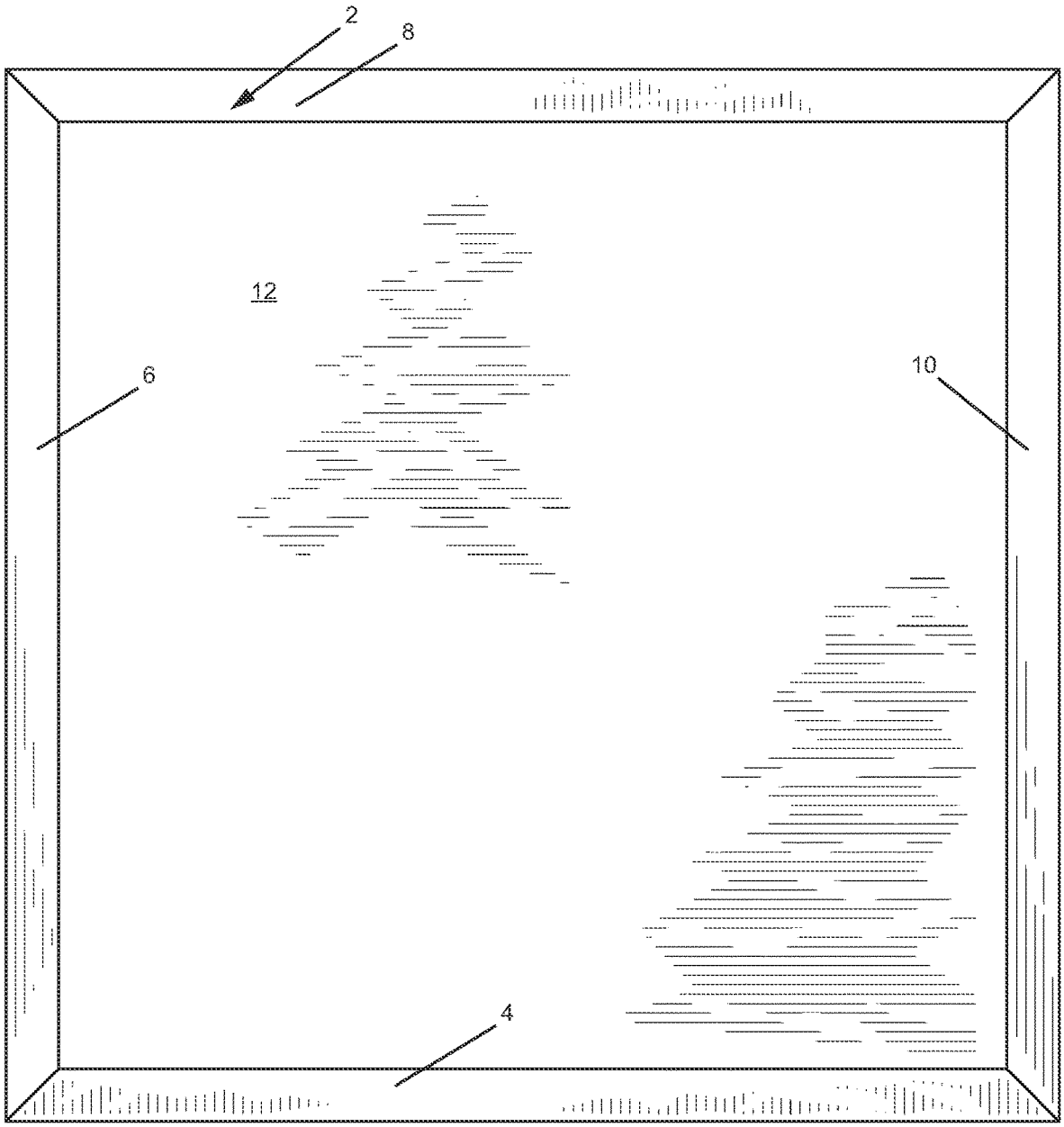
FIG. 23 is a bottom plan view of the second part of the game board apparatus in the second partial state.

Referring to FIG. 22, at least a portion of a top surface of the bottom 12 can be seen through spaces in the grid 20, with the pieces 30 and the pieces 40 removed in the second partial state.

Figure 25:
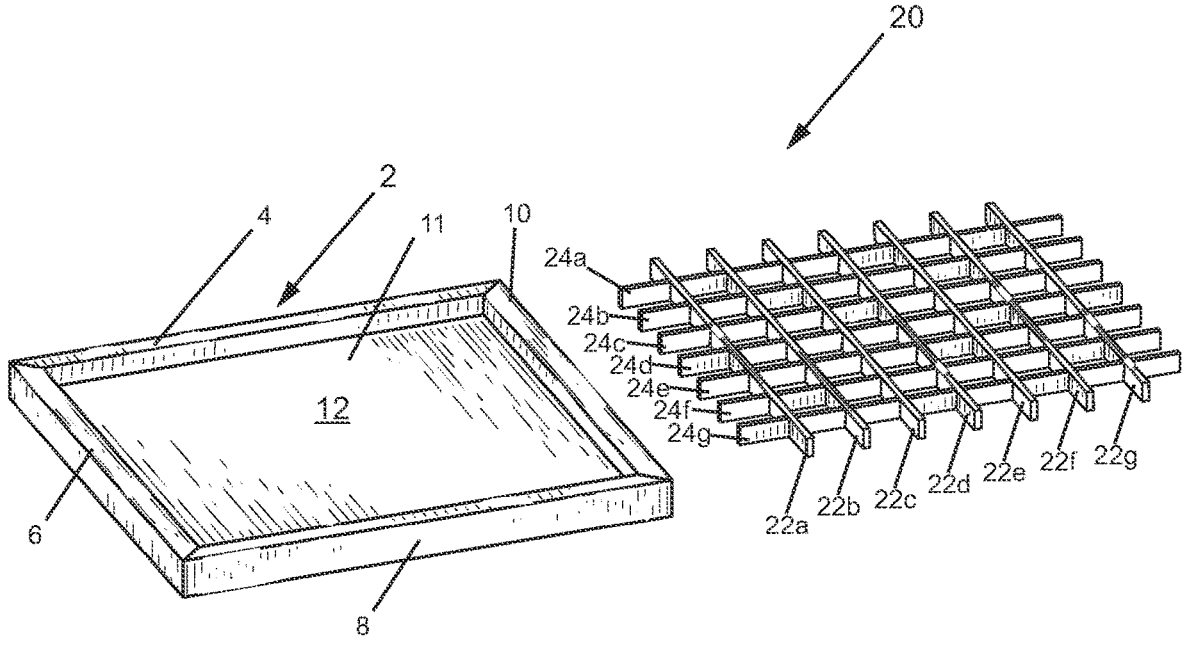
FIG. 25 is a left side, top, and front perspective view of a third part of the game board apparatus in a third partial state, in accordance with the present invention, wherein the first layer of pieces, the second layer of pieces have been removed from the fully assembled game board apparatus, and a grid has been separated from a base.
Figure 26:
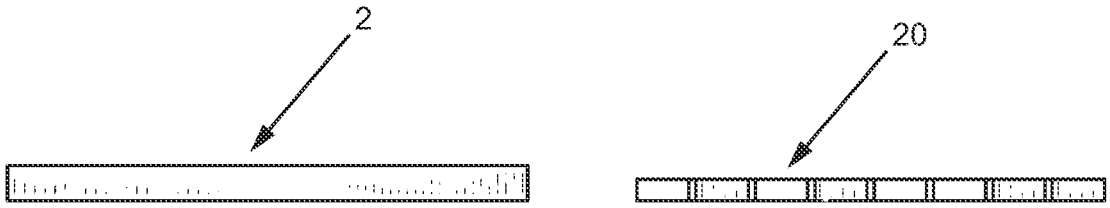
FIG. 26 is a front elevational view of the third part of the game board apparatus in the third partial state.
Figure 27:
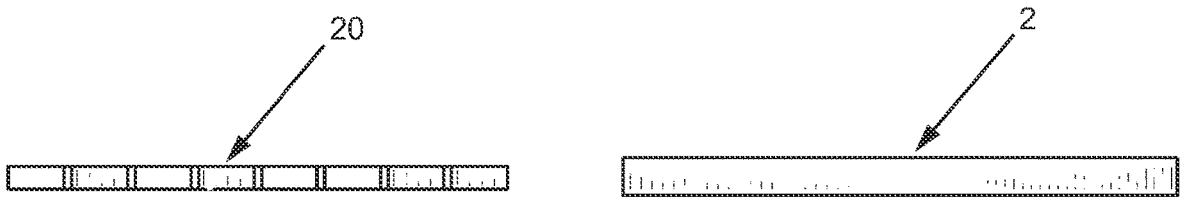
FIG. 27 is a rear elevational view of the third part of the game board apparatus in the third partial state.
Figure 28:
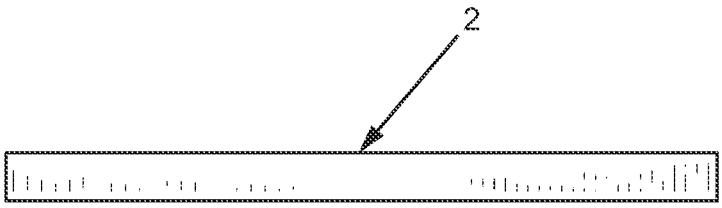
FIG. 28 is a left side elevational view of the third part of the game board apparatus in the third partial state.
Figure 29:
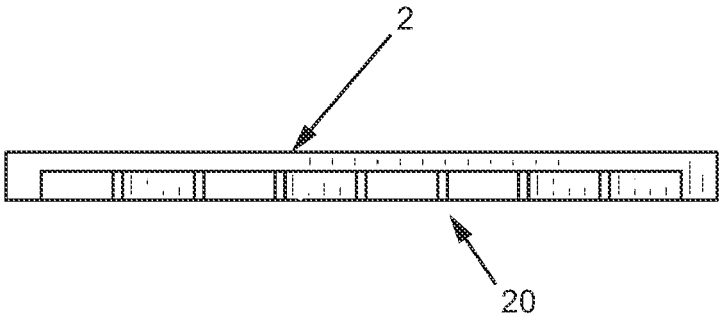
FIG. 29 is a right side elevational view of the third part of the game board apparatus in the third partial state.
Figure 30:
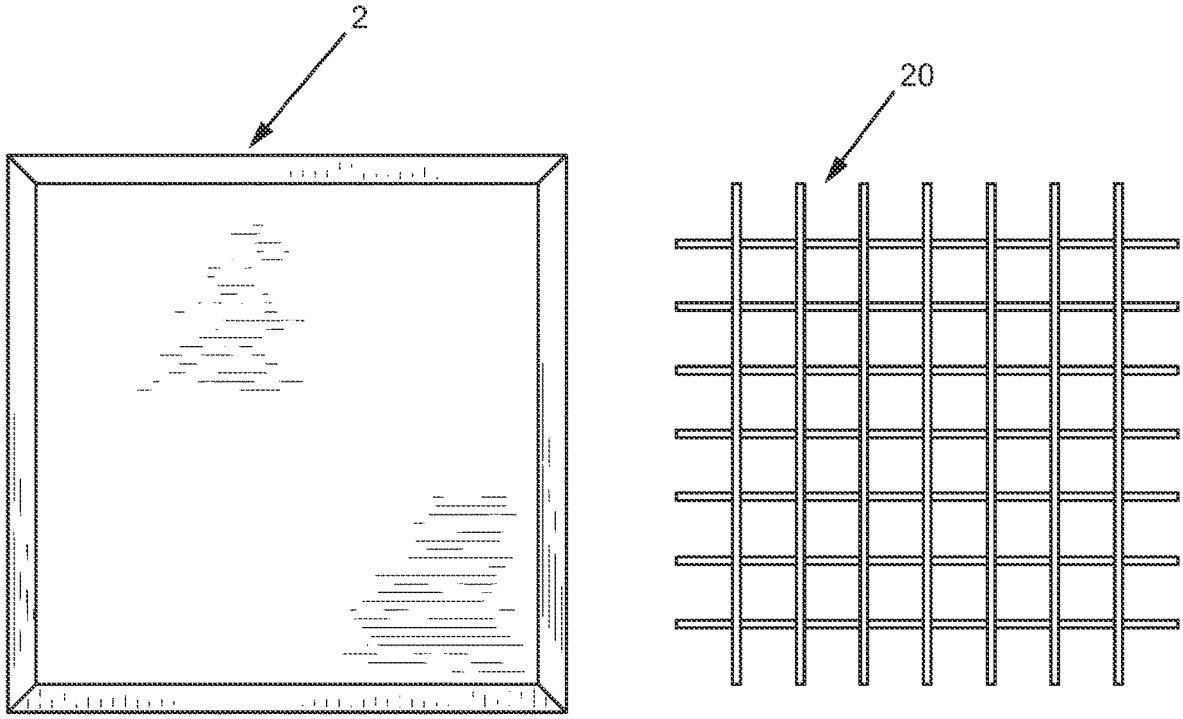
FIG. 30 is a top plan view of the third part of the game board apparatus in the third partial state.
Figure 31:
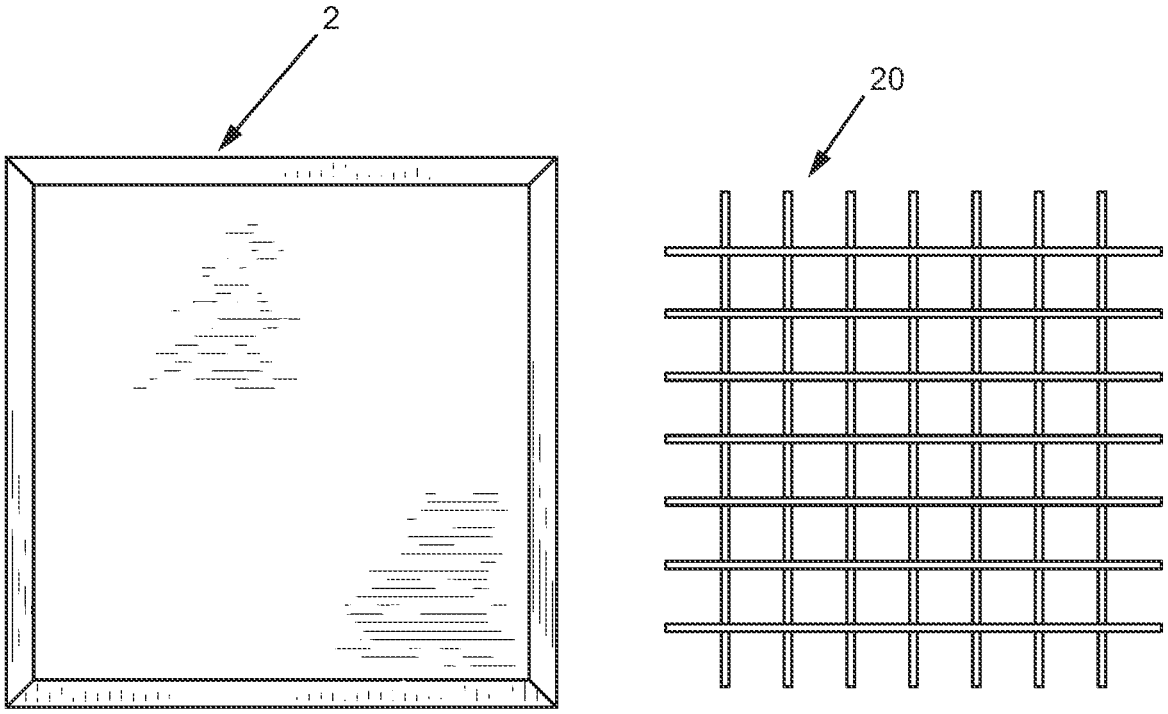
FIG. 31 is a bottom plan view of the third part of the game board apparatus in the third partial state.

FIG. 25 is a left side, top, and front perspective view of a third part of the game board apparatus 1 in a third partial state, in accordance with the present invention, wherein the first layer of pieces 30, the second layer of pieces 40 have been removed from the fully assembled game board apparatus 1, and the grid 20 has been separated from the base 2.

Figure 32:
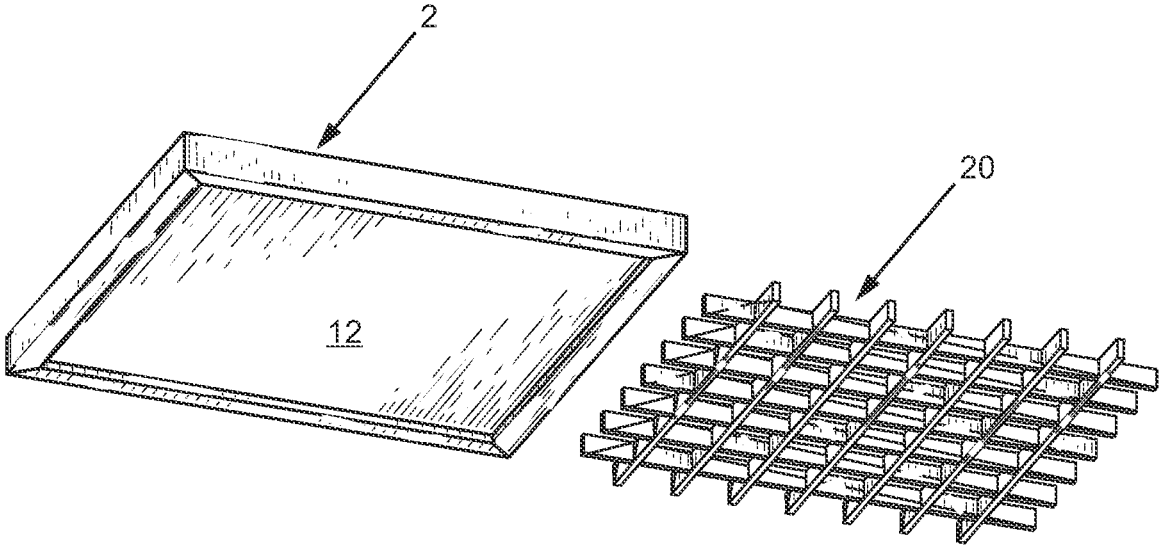
FIG. 32 is a left side, bottom, and rear perspective view of the third part of the game board apparatus in the third partial state.

FIGS. 26-31 are front elevational, rear elevational, left side elevational, right side elevational, top plan, and bottom plan views, respectively, of the third part of the game board apparatus 1 in the third partial state. FIG. 32 is a left side, bottom, and rear perspective view of the third part of the game board apparatus 1 in the third partial state.

Figure 33:
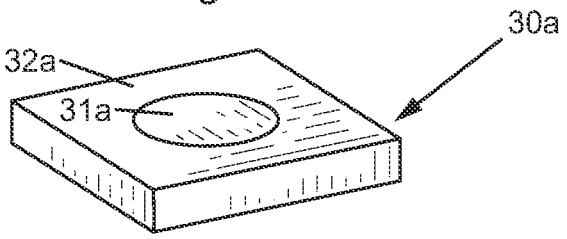
FIG. 33 is a left side, top, and front perspective view of a first piece, which may be any of the pieces of the first layer or the second layer of pieces of the game board apparatus.
Figure 34:
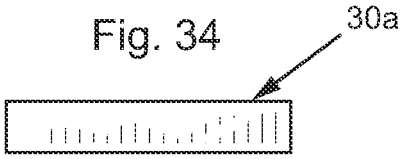
FIG. 34 is a front elevational view of the first piece.
Figure 35:
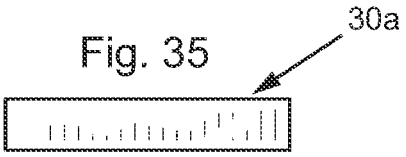
FIG. 35 is a rear elevational view of the first piece.
Figure 36:
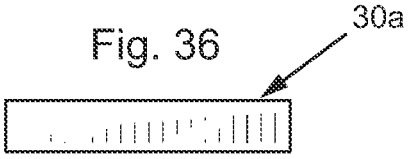
FIG. 36 is a left side elevational view of the first piece.
Figure 37:
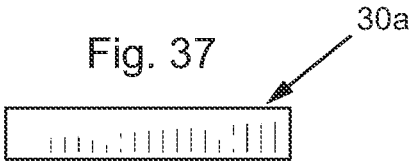
FIG. 37 is a right side elevational view of the first piece.

FIG. 33 is a left side, top, and front perspective view of a first piece 30*a*, which may be any of the pieces 30 of the first layer or any of the pieces 40 of the second layer of pieces of the game board apparatus 1. FIGS. 34-39 are front elevational, rear elevational, left side elevational, right side elevational, top plan, and bottom plan views, respectively, of the piece 30*a*. The piece 30*a* has an embedded centrally located circular magnet 31*a*, inside of a housing, member or body 32*a*.

Figure 40:
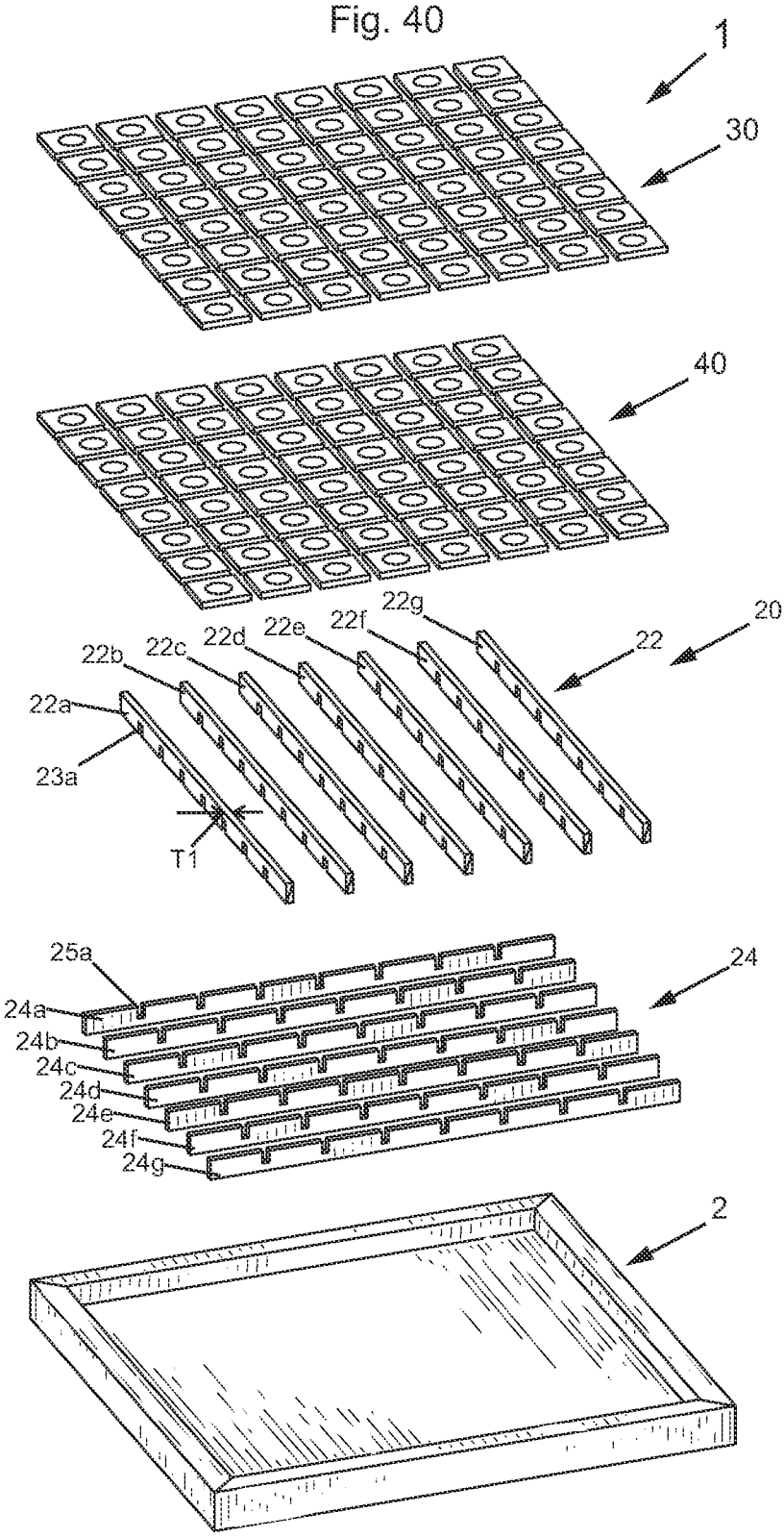
FIG. 40 is a left side, top, and front perspective view of the game board apparatus, wherein the game board apparatus is shown taken apart, with the first layer of pieces, the second layer of pieces, row members of a grid, column members of a grid, and a base separated from each other.

FIG. 40 is a left side, top, and front perspective view of the game board apparatus 1, wherein the game board apparatus 1 is shown taken apart, with the first layer of pieces 30, the second layer of pieces 40, a plurality 24 of row members, including row members 24*a*, 24*b*, 24*c*, 24*d*, 24*e*, 24*f*, and 24*g* of the grid 20, and a plurality 22 of column members, including column members 22*a*, 22*b*, 22*c*, 22*d*, 22*e*, 22*f*, and 22*g* of the grid 20, and the base 2 separated from each other. Each of the column members 22*a-g* has a plurality of notches, each notch similar or identical to notch 23*a* of column member 22*a*, for interlocking and/or meshing with a notch of a row member of row members 24*a-g*, such as notch 25*a* of row member 24*a*, to form the grid 20. In other embodiments, the grid 20 may be formed as one integrated unit so that row members 24*a-g* and column members 22*a-g* cannot be taken apart without breaking one or more of these members.

Figure 41:
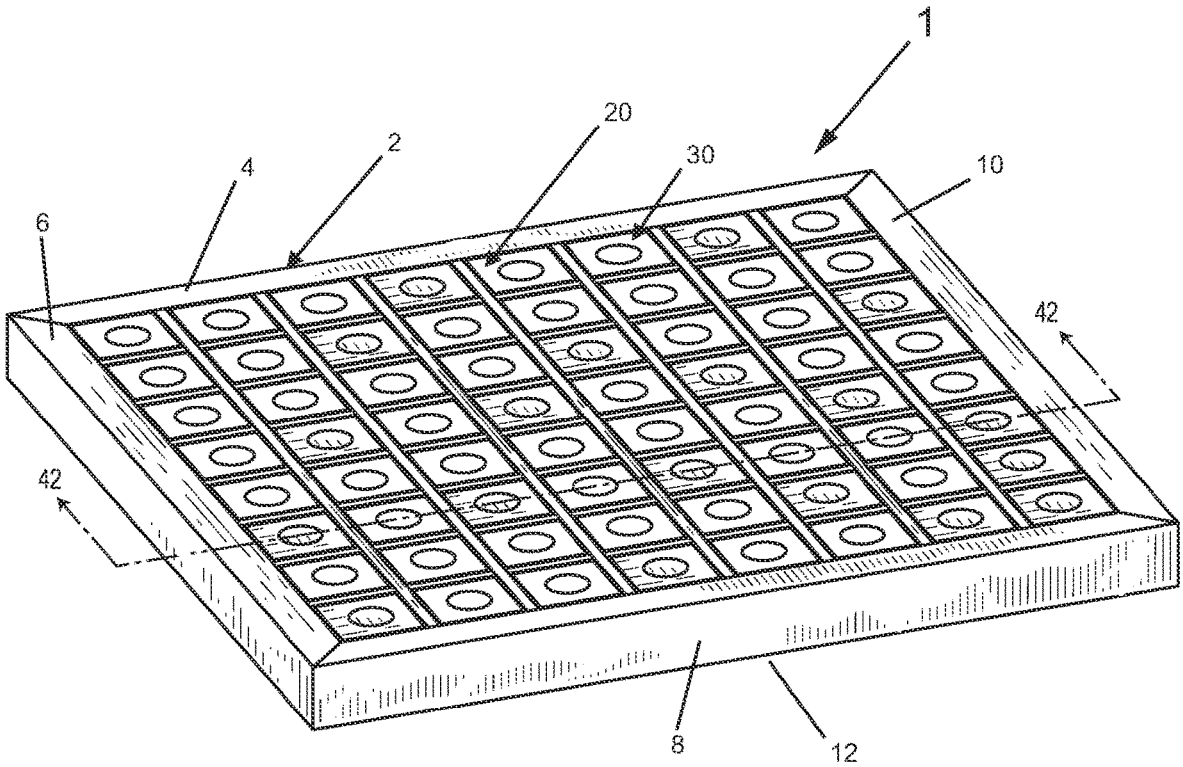
FIG. 41 is a left side, top, and front perspective view of the game board apparatus, in accordance with the present invention, wherein the game board apparatus is shown in a fully assembled state, and wherein a line 42-42 is shown for taking a cross section of the fully assembled game board apparatus.

FIG. 41 is a left side, top, and front perspective view of the game board apparatus 1, in accordance with the present invention, wherein the game board apparatus 1 is shown in a fully assembled state, and wherein a line 42-42 is shown for taking a cross section of the fully assembled game board Apparatus 1.

Figure 42:
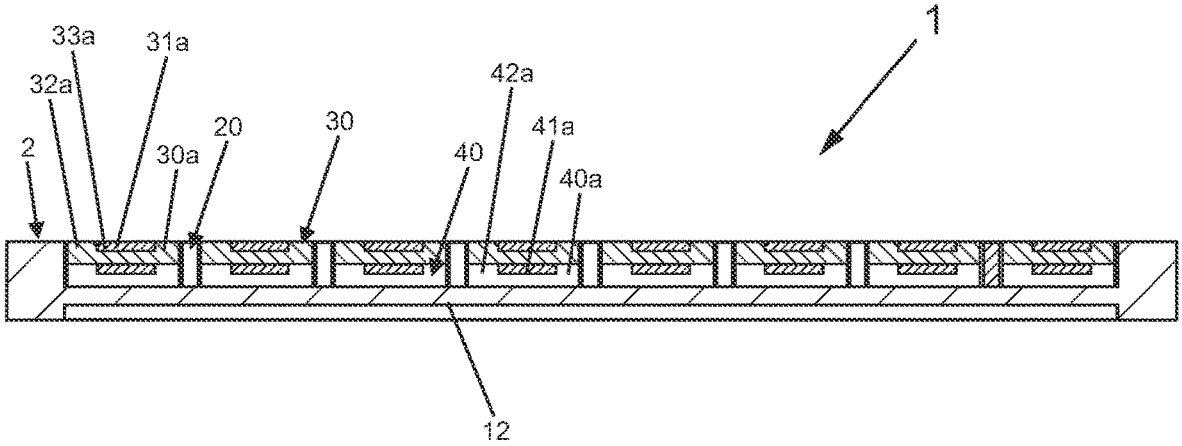
FIG. 42 is a cross section of the fully assembled game board apparatus taken along the line 42-42 shown in FIG. 41.

FIG. 42 is a cross section of the fully assembled game board apparatus taken 1 along the line 42-42 shown in FIG. 41. FIG. 42 shows the depth of magnetic piece 31*a* of piece 30*a*. The other pieces of pieces 30 and 40 may be identical to piece 30*a*. In at least one embodiment, the magnetic 31*a* exerts a magnetic force on something placed on top of piece 30*a*. However, there is a buffer of housing or member 32*a* between magnetic piece 31*a* for piece 30*a*, and the magnetic piece of the game piece of pieces 40 on which the piece 30*a* sits.

Figure 43:
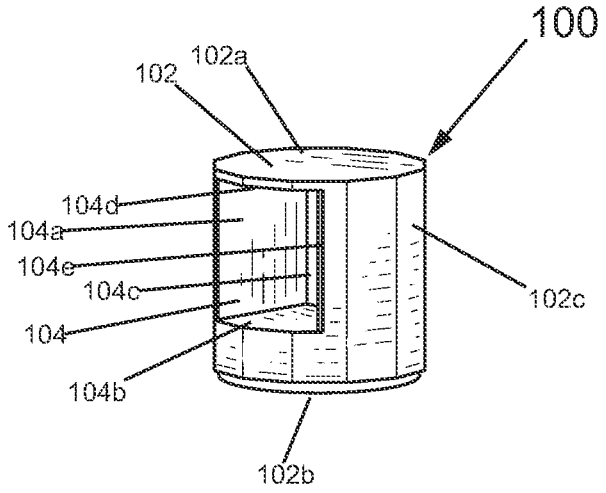
FIG. 43 is a left side, top, and rear perspective view of the game piece base, in accordance with the present invention.
Figure 44:
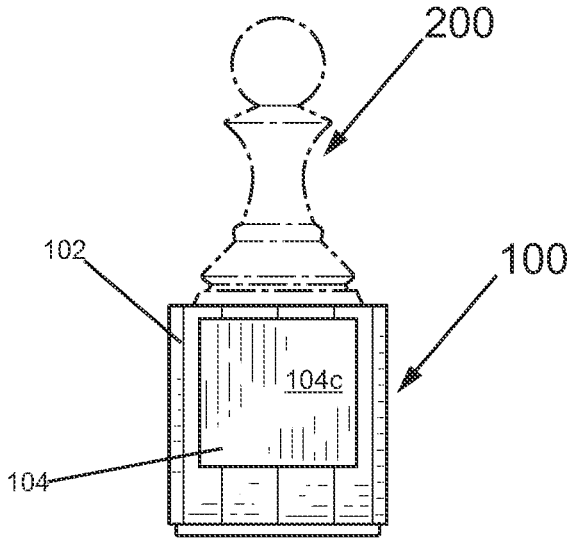
FIG. 44 is a rear elevational view of the game piece base attached to a bottom of a first known chess piece.
Figure 45:
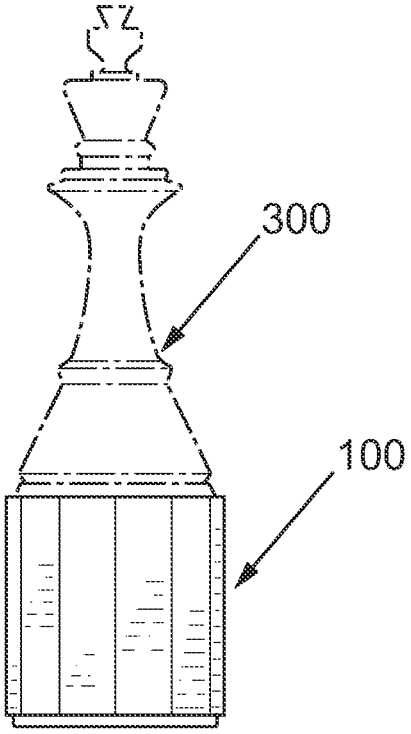
FIG. 45 is a front elevational view of the game piece base attached to a bottom of a second known chess piece.
Figure 46:
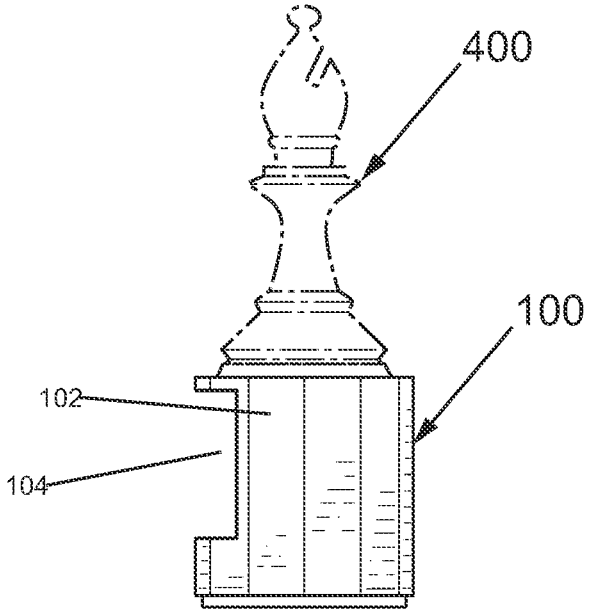
FIG. 46 is a left side elevational view of the game piece base attached to a bottom of a third known chess piece.
Figure 47:
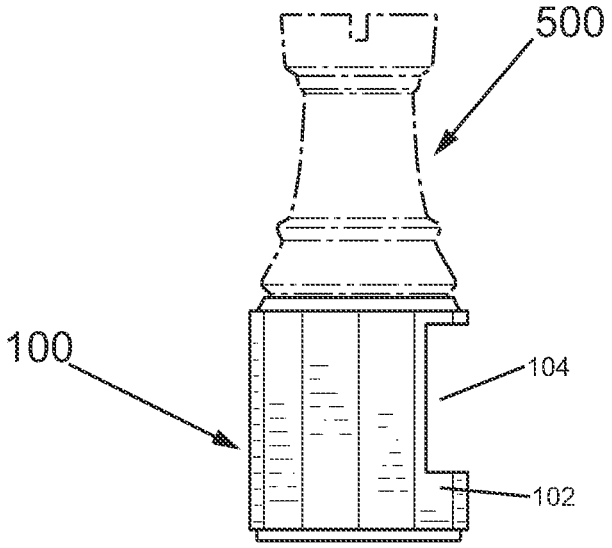
FIG. 47 is a right side elevational view of the game piece base attached to a bottom of fourth known chess piece.
Figure 48:
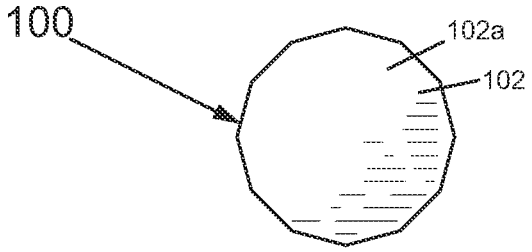
FIG. 48 is a top plan view of the game piece base.
Figure 49:
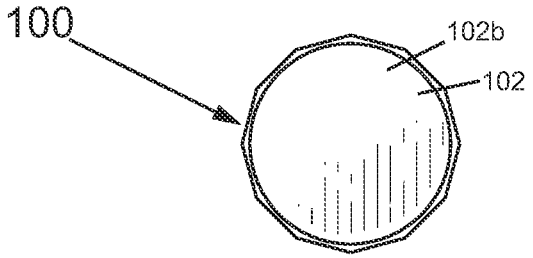
FIG. 49 is a bottom plan view of the game piece base.

FIG. 43 is a left side, top, and rear perspective view of a game piece base 100, in accordance with the present invention. FIG. 44 is a rear elevational view of the game piece base 100 attached to a bottom of a first known chess piece 200 (which is a pawn) shown in dashed lines. FIG. 45 is a front elevational view of the game piece base 100 attached to a bottom of a second known chess piece 300 (which is a king). FIG. 46 is a left side elevational view of the game piece base 100 attached to a bottom of a third known chess piece 400 (which is a bishop). FIG. 47 is a right side elevational view of the game piece base 100 attached to a bottom of fourth known chess piece 500 (which is a rook). FIG. 48 is a top plan view of the game piece base 100. FIG. 49 is a bottom plan view of the game piece base 100.

Referring to FIGS. 43-49, the game piece base 100 includes a recess 104, which has an inner surface 104*a* and a parallel inner surface 104*e*. The recess 104 also includes a top of ceiling surface 104*d* and a parallel bottom surface 104*b*. The recess 104 also includes a rear surface 104*c*. The recess or indentation 104 is configured to receive the cube 600 shown in FIG. 50. The game piece base 100 includes a housing or body portion 102 having a top surface 102*a* a peripheral surface 102*c* and a bottom surface 102*b*. The housing or body portion 102 is preferably opaque, i.e. not able to be seen through, so that the cube 600 when placed in the recess 104 as shown in FIG. 50, cannot be seen from the front view of FIG. 45.

Figure 50:
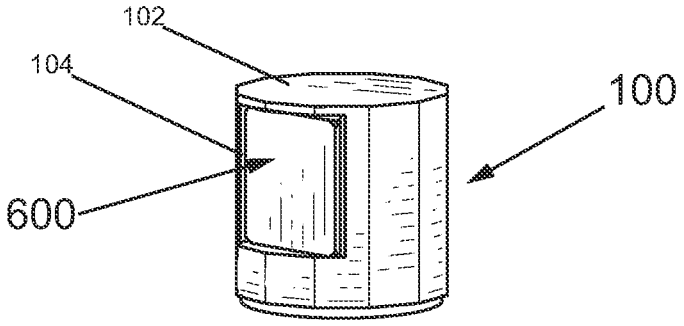
FIG. 50 is left side, top, and rear perspective view of the game Piece Base, in accordance with the present invention, with a cube inserted into the game piece base.
Figure 51:
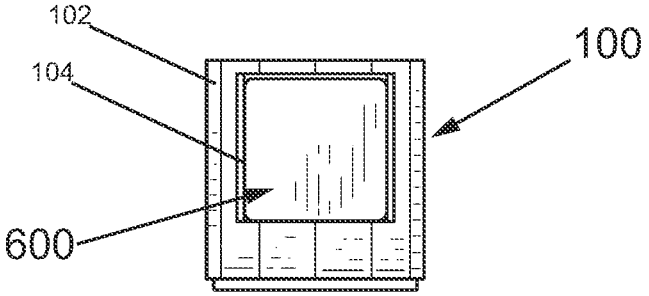
FIG. 51 is a rear elevational view of the game piece base, with the cube inserted into the game piece base.
Figure 52:
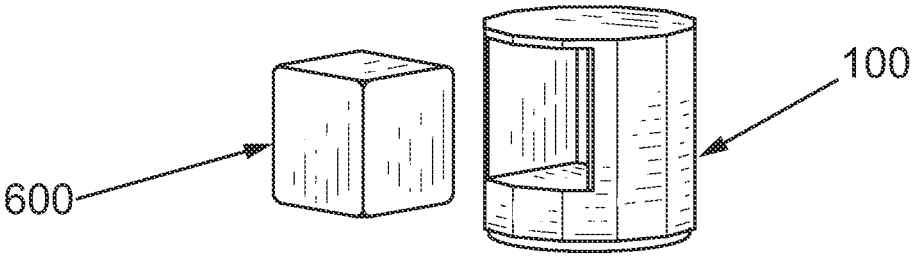
FIG. 52 is left side, top, and rear perspective view of the game piece base and the cube, in accordance with the present invention, with the cube shown separate from the game piece base.
Figure 53:
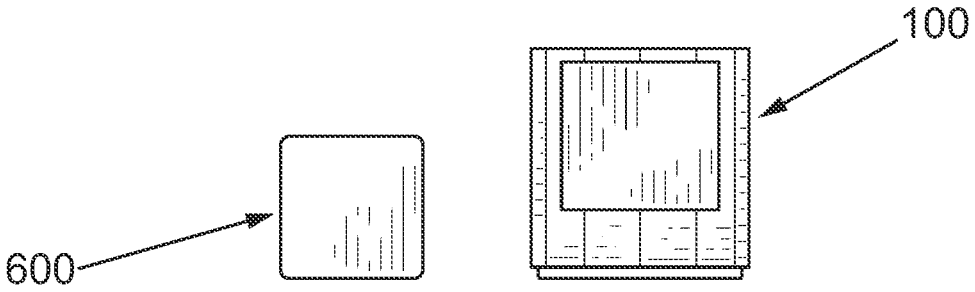
FIG. 53 is a rear elevational view of the game piece base and the cube, with the cube shown separate from the game piece base.

FIG. 50 is left side, top, and rear perspective view of the game piece base 100, in accordance with the present invention, with a cube 600 inserted into the game piece base 100. FIG. 51 is a rear elevational view of the game piece base 100, with the cube 600 inserted into the game piece base 100. FIG. 52 is left side, top, and rear perspective view of the game piece base 100 and the cube 600, in accordance with the present invention, with the cube 600 shown separate from the game piece base 100. FIG. 53 is a rear elevational view of the game piece base 100 and the cube 600, with the cube 600 shown separate from the game piece base 100.

Figure 54:
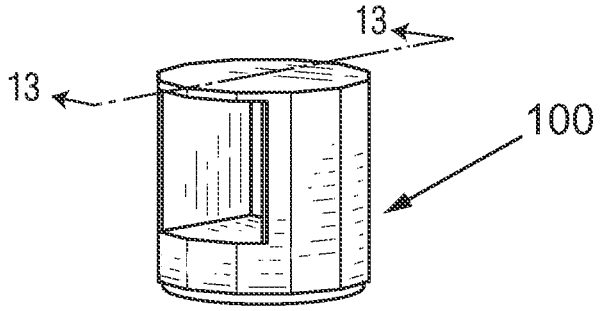
FIG. 54 is a left side, top, and rear perspective view of the game piece base, with a line 13-13 shown.
Figure 55:
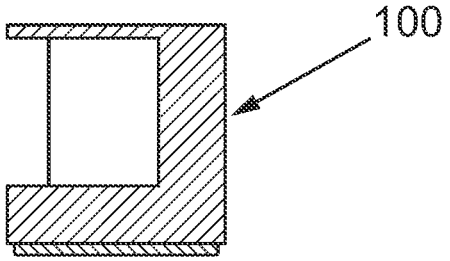
FIG. 55 is a cross sectional view of the game piece base along the line 13-13 shown in FIG. 54.

FIG. 54 is a left side, top, and rear perspective view of the game piece base 100, with a line 13-13 shown. FIG. 55 is a cross sectional view of the game piece base 100 along the line 13-13 shown in FIG. 54.

One or more embodiments of the present invention provide a multi-dimensional chess board.

Figure 56:
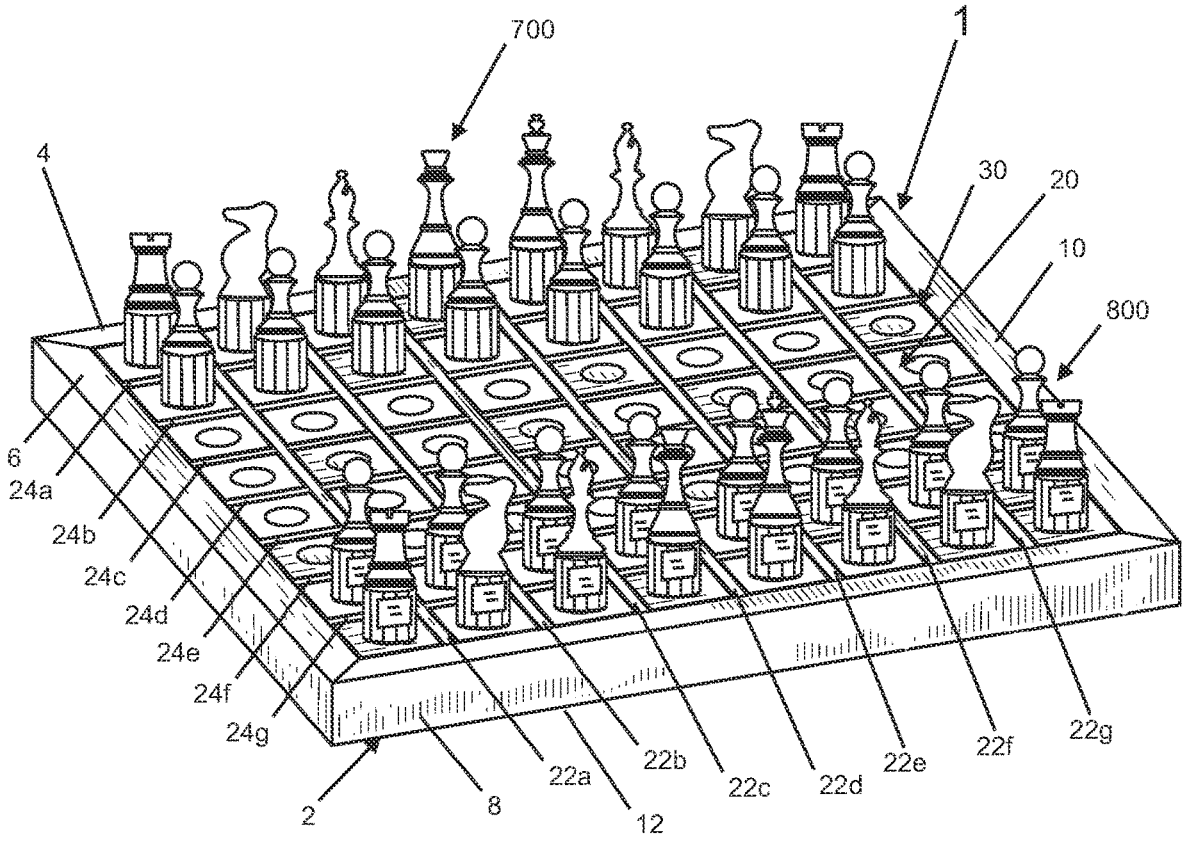
FIG. 56 is a left side, top, and front perspective view of the game board apparatus, in accordance with the present invention, wherein the game board apparatus is shown in a fully assembled state, and with chess pieces for two players shown on the game board apparatus.

FIG. 56 is a left side, top, and front perspective view of the game board apparatus 1, in accordance with the present invention, wherein the game board apparatus is shown 1 in a fully assembled state, and with a set of first player modified chess pieces 700 and a set of second player modified chess pieces 800 shown on the game board apparatus 1.

The first player modified chess pieces 700 include eight modified pawns, two modified rooks, two modified knights, two modified bishops, one modified queen, and one modified king. Each of the first player modified chess pieces 700 has a game piece base 100 as its base and provided fixed to and underneath a conventional known chess piece. For example, the modified king of the modified chess pieces 700 has a game piece base 100 underneath and fixed to the bottom of a conventional known king chess piece.

Similarly, or identically, the second player modified chess pieces 800 include eight modified pawns, two modified rooks, two modified knights, two modified bishops, one modified queen, and one modified king. Each of the second player modified chess pieces 800 has a game piece base 100 as its base and provided fixed to and underneath a conventional known chess piece. For example, the modified king of the modified chess pieces 800 has a game piece base 100 underneath and fixed to the bottom of a conventional known king chess piece.

In FIG. 56, the first player modified chess pieces 700 and the second player modified chess player 800 are arranged on the game board apparatus 1, so that each of the pieces 700 and 800 sits on only one game piece of the pieces 30, within a single grid space of the grid 20, without overlapping any of the row members 24*a-g* or the column members 22*a-g*, within a delineated square of the grid 20, i.e. between two adjacent row members of 24*a-g* (or members 4 and 8), and between two adjacent column members of 22*a-g* (or members 6 and 10) of the grid 20. In at least one embodiment, each game piece base 100 has a magnetically attracted device typically impregnated and/or located within the housing 102 towards the bottom 102*b* shown in FIG. 43, wherein the magnetically attracted device within game piece base 100 is magnetically attracted to magnetic piece 31*a* of piece 30*a*, and similar or identical magnetic pieces of all the other pieces of pieces 30 and 40. For example, the modified king of the first player modified chess pieces 700 is shown in FIG. 56 so that the bottom 102*b* (with a magnetically attracted device) of the modified king overlaps and is attracted and held by a magnetic piece, similar or identical to piece 31*a* of each of the pieces 30 underneath the bottom 102*b* of the game piece base 100 of the modified king, and within a square defined by the member 4, the row member 24*a*, and column members 22*d* and 22*e*. In at least one embodiment, the area of the magnetically attracted device of the game piece 100 is the same as the area of the piece 31*a*, and these areas overlap each other when, for example, the king modified piece of pieces 700 is situated as in FIG. 56.

The first player pieces 700 and the second player pieces 800 are configured, so that each of the pieces 700 and 800 can be placed as in FIG. 56, within one grid space, and where none of the pieces 700 or the pieces 800 overlap the members 4, 6, 8, 10, row members 24*a-g*, or column members 22*a-g*.

While floor or bottom 12, shown for example in FIGS. 25 and 32, is shown as a single solid sheet, such as a sheet of wood or rigid plastic, it can alternatively comprise any other support structure extending across the bottom of a peripheral border including members 4, 6, 8, and 10 as shown in FIG. 25. The members 4, 6, 8, and 10 and the bottom 12 form an enclosed area or rectangular recess 11, which is configured to allow insertion of the grid 20, and the pieces 30 and 40 to assemble fully as in FIG. 1, such that pieces 30 and grid 20 do not project above the members 4, 6, 8, and 10 but rather at their top surfaces are level with top surfaces of members 4, 6, 8, and 10. The support structure of floor or bottom 12 may be, for example, a plurality of strips defining gaps, or grid spaces, there between. The row members 24*a-g* extend from wall or member 4 to wall or member 8, with spaces in between, and the column members 22*a-g*, extend from wall or member 6 to wall or member 10, with spaces in between, as shown in FIG. 56.

The peripheral border defined by walls or members 4, 6, 8, and 10 may be configured either as a single piece or as multiple detachable pieces. For example, sidewalls or members 4, 6, 8, and 10 may be detachable from one another via screws, fasteners, or other suitable means, or integrally formed with one another.

Removable grid 20 may be an integrated single unit or may be comprised of the plurality of vertically extending strips or column members 22*a-g* extending from peripheral wall 6 to peripheral wall 10, as well as a plurality of horizontally extending strips or row members 24*a-g* extending from peripheral wall 4 to peripheral wall 8, as shown in FIG. 56.

As further shown in FIG. 56, vertically extending strips or column members 22*a-g* define columns A-H (i.e. eight columns into which any one of pieces 700 or 800 can be placed) and horizontally extending strips or row members 24*a-g* define rank positions ("1"-"8"). In this manner, peripheral border (comprised of members 4, 6, 8, and 10) and removable grid 20 together define the eight by eight, sixty-four, square grid of a traditional chess board, but also provide depth, shown for example by FIGS. 25 and 42 to base 2, and to game board apparatus 1 in a direction perpendicular to floor or bottom 12.

In particular, game board apparatus 1 defines sixty-four cubic or colloidal spaces at the square regions of the chessboard defined by removable grid 20 along columns A-H and rows "1"-"8", as shown, for example by FIGS. 1 and 56.

Figure 2:
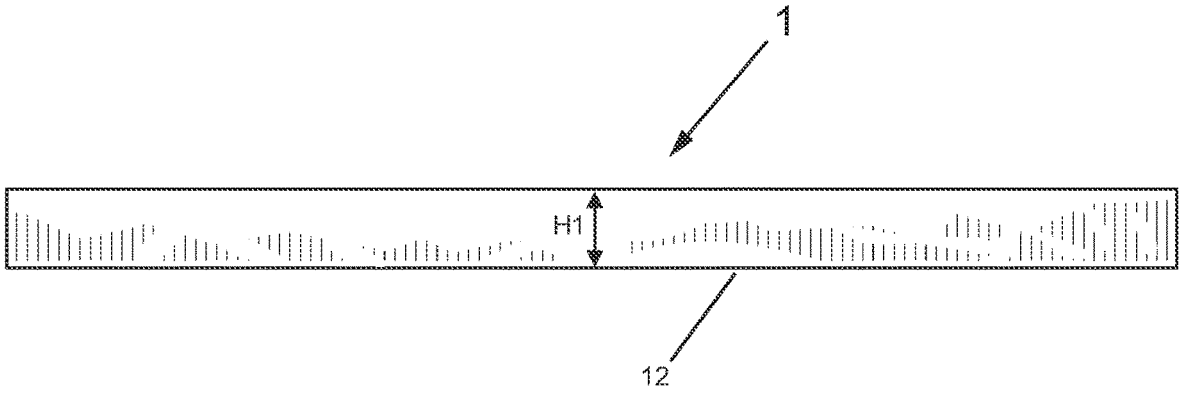
FIG. 2 is a front elevational view of the game board apparatus in the fully assembled state.
Figure 3:
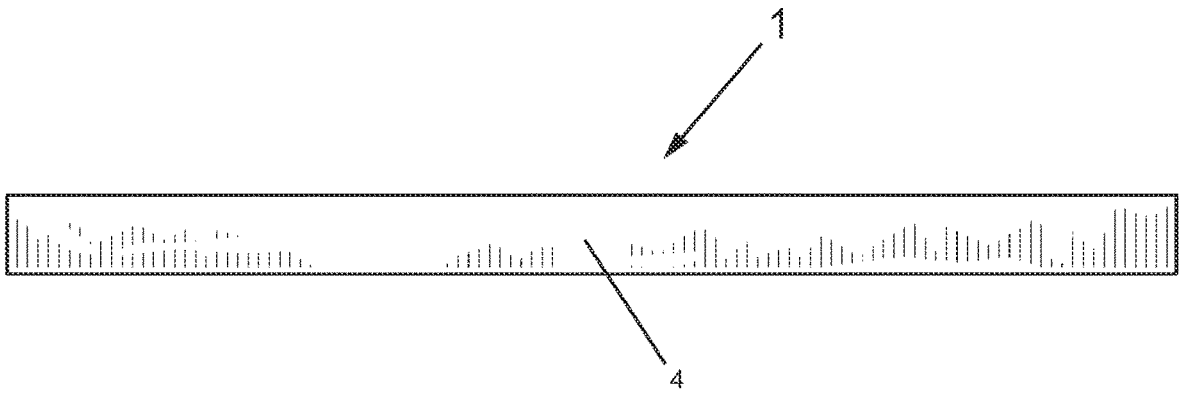
FIG. 3 is a rear elevational view of the game board apparatus in the fully assembled state.
Figure 4:
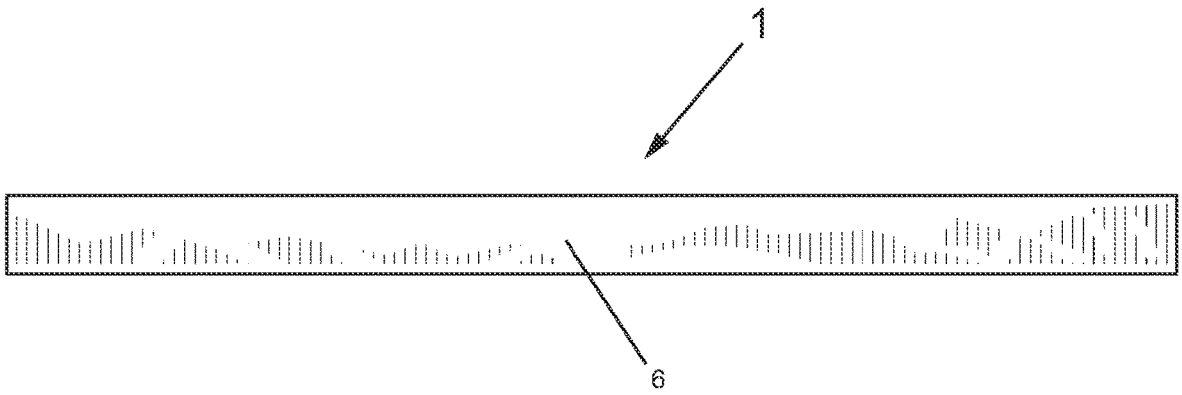
FIG. 4 is a left side elevational view of the game board apparatus in the fully assembled state.
Figure 5:
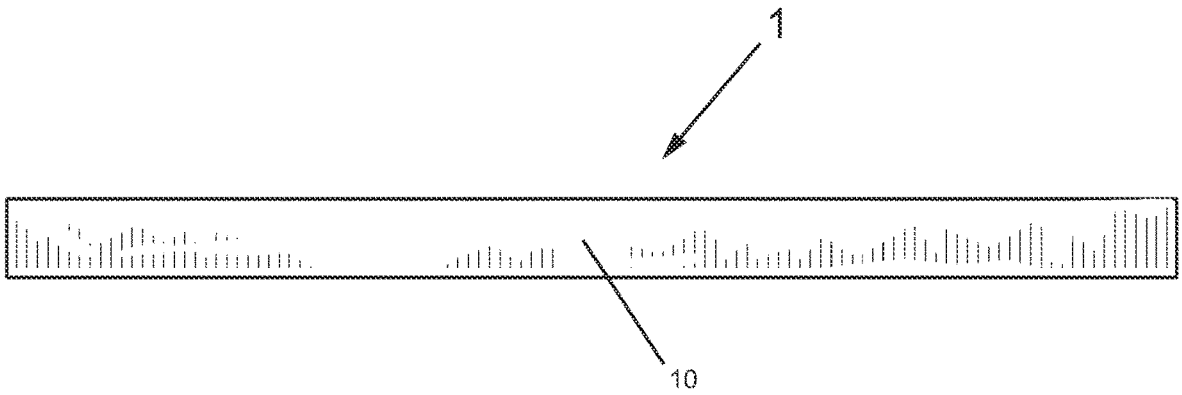
FIG. 5 is a right side elevational view of the game board apparatus in the fully assembled state.
Figure 6:
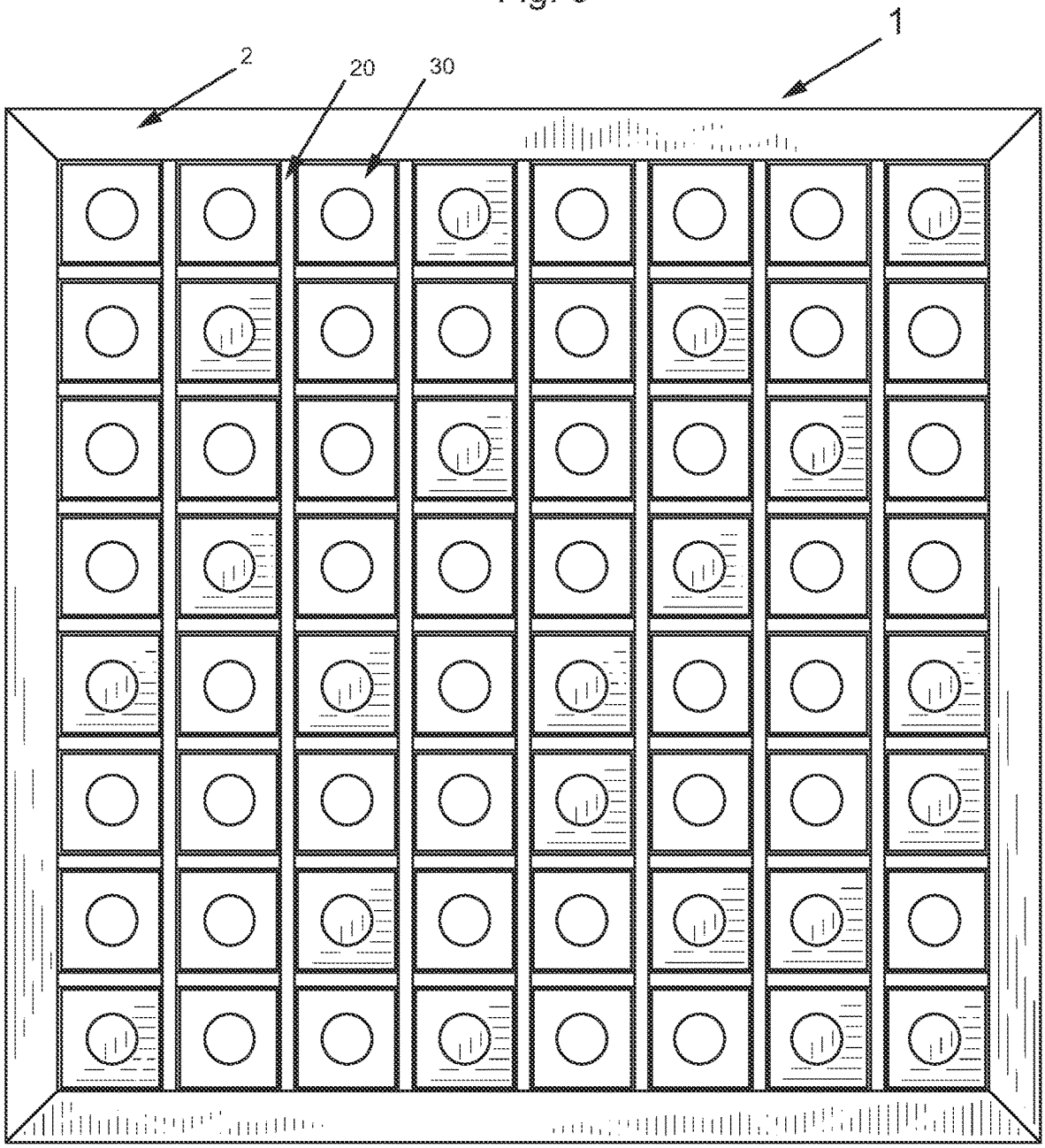
FIG. 6 is a top plan view of the game board apparatus in the fully assembled state.
Figure 7:
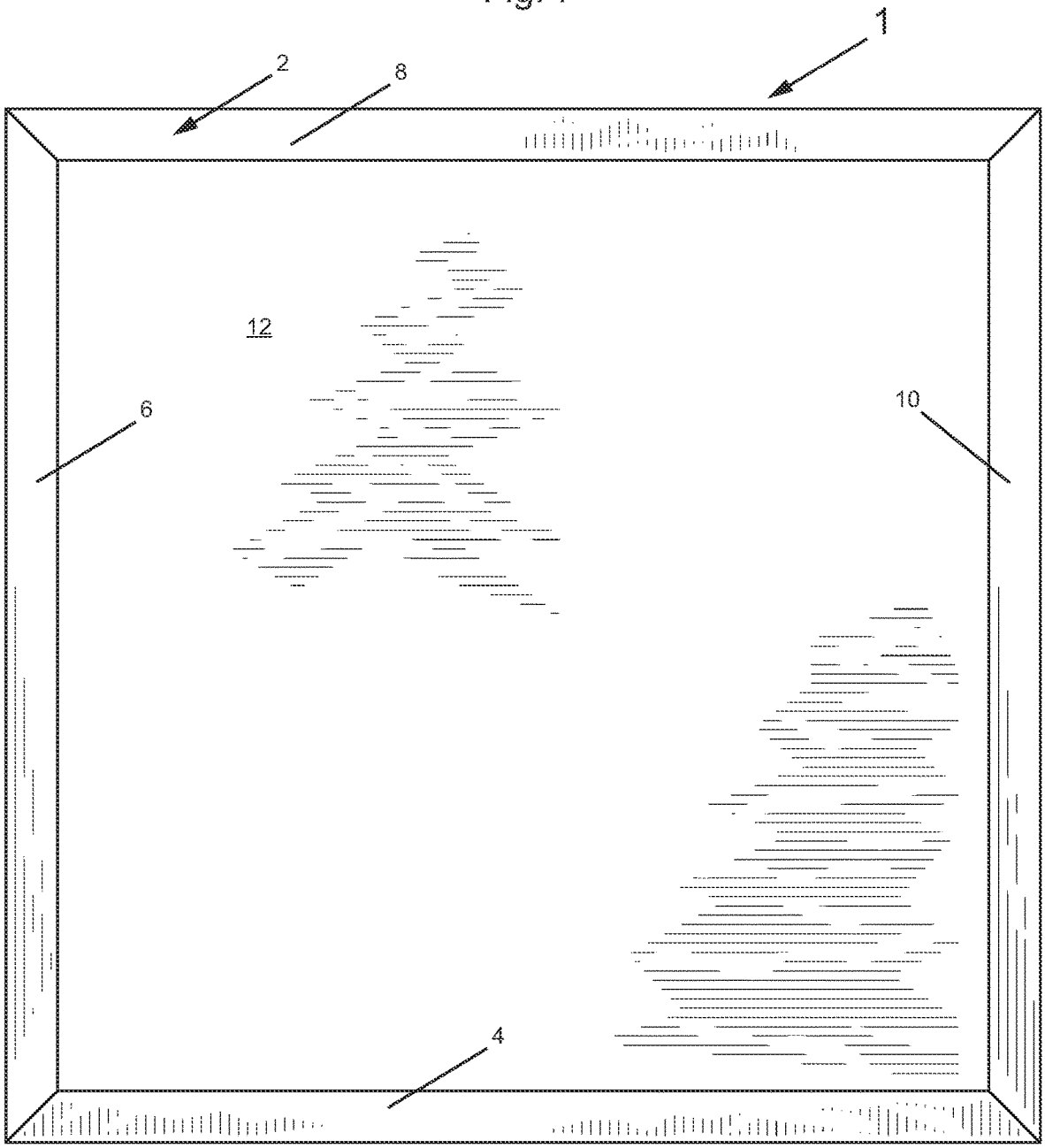
FIG. 7 is a bottom plan view of the game board apparatus in the fully assembled state.

In at least one embodiment, the base 2 has a height H1, shown in FIG. 2, which is at least two and a half inches high. Each of the vertically and horizontally extending strips 22*a-g* and 24*a-g*, respectively, of removable grid 20 have a thickness T1, which, in at least one embodiment, is approximately a quarter inch thick, as shown in FIG. 40. The removable grid 20, along with the periphery of members 4, 6, 8, and 10 defines sixty-four cubic or cuboidal spaces above floor or bottom 12, and sixty-four squares whose top surfaces are either along floor 12 or atop the top insert or piece of the one or more inserts or pieces 30 or 40 inserted into each cubic or cuboidal space at each of the sixty-four square regions defined by removable grid 20 along with members 4, 6, 8, and 10.

In at least one embodiment, each cubic or cuboidal space has at least two and a half inches of depth/height between floor 12 and the top of grid 20 (without pieces 30 and 40), and is configured to receive at least three inserts stacked on top of one another atop floor 12, i.e. another set of pieces, similar to either pieces 30 or 40, may be stacked on top of pieces 30 in other embodiments.

Other shapes, sizes, and depths of the board components may be utilized, but grid 20, along with members 4, 6, 8, and 10, preferably defines an eight-by-eight matrix (i.e., eight rows and eight columns) like a traditional, classic chess board. Adjacent inserts or pieces 30 which form the top layer of a chess board of apparatus 1 may be painted black and white, and arranged to alternate in color to further give the look and feel of a classic chess board. In other embodiments, chess board of apparatus 1 may be provided without colored top layer inserts or pieces 30, and interior portions or the top of grid 20 may be painted white and black to demarcate particular adjacent squares of chess board of apparatus 1. In other embodiments, sections or a section of sidewall such as a sidewall of sidewalls 4, 6, 8, and 10 may be painted to differentiate particular adjacent squares of chess board of apparatus 1.

As shown in FIG. 40, for example, horizontally extending strips or row members 24*a-g* are provided with notches, similar or identical to notch 25*a*, along the length thereof. Notches, similar or identical to notch 25*a*, are configured to receive vertically extending strips or column members 22*a-g* to form the configuration of removable grid 20. Vertically extending strips or column members 22*a-g* are also provided with notches, similar or identical to notch 23*a* and configured to receive horizontally extending strips or row members 24*a-g*. Notch 23*a* receives notch 25*a*. In certain embodiments, notch 23*a* and similar or identical notches of column members 22*a-g*, and notch 25*a* and similar or identical notches of row members 24*a-g* may be configured to mate with one another so that strips or column members 22*a-g* and row members 24*a-g* attach to one another in a press or mating fit to form grid 20.

Strips 22*a-g* and 24*a-g* are thus detachably coupled to one another by slot, interference fit, or other suitable attachment means, and enable grid 20 to be removed as a single piece as shown in FIG. 25, despite its components being detachable from one another. In other embodiments, removable grid 20 may be constructed as a single integrated piece. In yet other embodiments, removable grid 20 may be formed as a plurality of uniform modular and identically sized pieces that all mechanically couple to one another.

In at least one embodiment, each of inserts or pieces 30 and 40 is constructed as a modular, square-shaped plate which is insertable into one of the cubic or cuboid spaces defined by removable grid 20 above floor 12. As shown, for example, by the combination of FIGS. 1, 9, and 17, each of inserts or pieces 30 and 40 is also sized to fit into one of the cubic/cuboidal spaces defined by removable grid 20, and removable therefrom. Each of inserts or pieces 30 and 40 may be sized to allow a finger or other device to wedge between removable grid 20 and any of inserts or pieces 30 and 40, to remove any one (or more) of inserts 30 or 40, or sized to enter the cubic/cuboidal spaces in more of a snug fit, and each of inserts 30 and 40 may be equipped with a magnetic piece or magnet, similar or identical to magnetic piece 31*a* of insert or piece 30*a* shown in FIG. 33 to facilitate each insert's removal.

In certain embodiments, each of inserts or pieces 30 and 40, such as insert or piece 30*a* shown in FIG. 33, are configured with a magnet or metal piece 31*a* nested within a concavity 33*a* shown in FIG. 42 defined by or surrounded by body portion 32*a* of the piece 30*a*, and wherein the body portion 32*a* is painted black or white on the side which receives the magnet or metal piece, to form a chessboard or checkerboard pattern.

In at least one embodiment, a concavity 33*a*, shown in FIG. 42, is formed in insert 30*a* with an approximately three quarters of an inch diameter circular hole drilled centrally partially through insert 30*a* on the top of the insert 30*a*. The bottom of each insert 30 or 40, similar or identical to insert 30*a*, opposite the top of insert 30*a* (i.e., the side without the concavity 33*a* and which is not colored white or black), in at least one embodiment, may be "blank" as in FIG. 39, which means the bottom of piece 30*a*, contains no rule, alphanumeric characters, graphics, or the bottom of any one or more of inserts 30 and 40 may include alphanumeric characters, a rule, and/or graphics.

Figure 38:
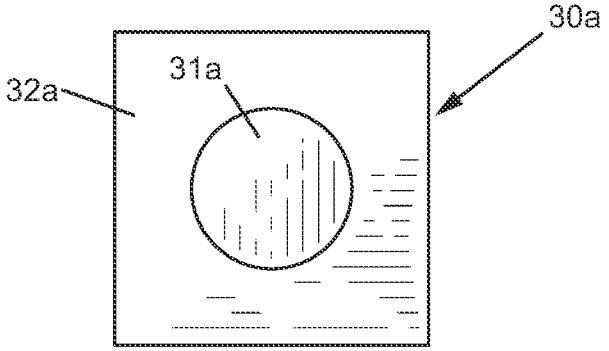
FIG. 38 is a top plan view of the first piece.
Figure 39:
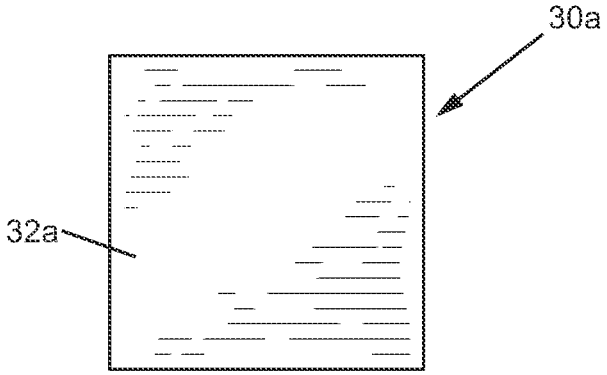
FIG. 39 is a bottom plan view of the first piece.
Figure 57A:
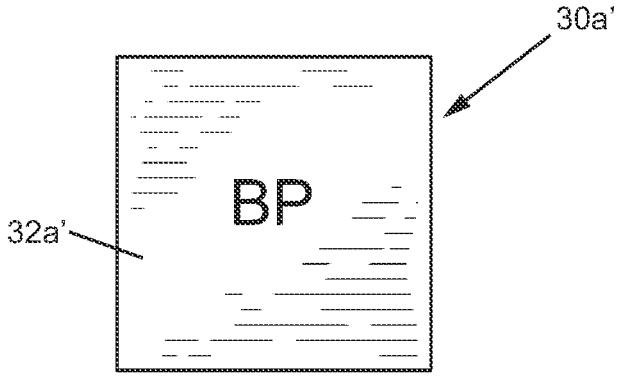
FIG. 57A is a bottom plan view of a first modified first piece.

For example, FIG. 57A is a bottom plan view of a first modified first piece 30*a*', wherein the first modified piece 30*a*' may be identical to piece 30*a* shown in FIGS. 33-39, except that instead of the bottom being without a rule, graphics, or alphanumeric characters on the bottom surface as in FIG. 39, the first modified first piece 30*a*' has the letters "BP" which stand for "Bomb Player" in FIG. 57A, on bottom of body portion 32*a*'.

Figure 57B:
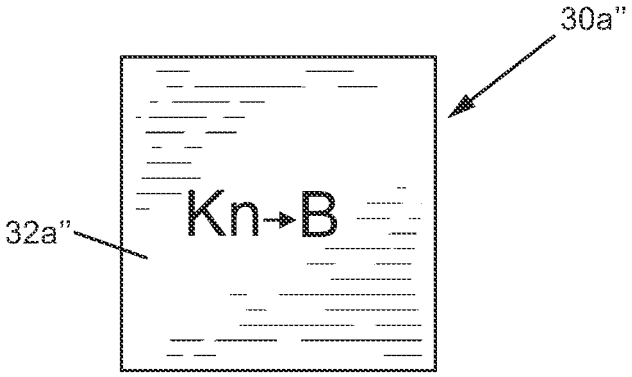
FIG. 57B is a bottom plan view of a second modified first piece.

As another example, FIG. 57B is a bottom plan view of a second modified first piece 30*a*", wherein the first modified piece 30*a*" may be identical to piece 30*a* shown in FIGS. 33-39, except that instead of the bottom being without a rule, graphics, or alphanumeric characters on the bottom surface as in FIG. 39, the second modified first piece 30*a*" has the expression "Kn→B" which is a rule meaning that a knight piece can be exchanged for a bishop piece.

A rule, alphanumeric characters, and/or graphics, such as shown, for example, in FIGS. 57A and 57B may be written on the bottom of any one or more of inserts 30 or 40 with removable or permanent markers, attached with stickers, may be preprinted, and may include various images representative of the rules. Other inserts of inserts 30 and 40 may contain no rules at all, such as shown in FIG. 39. As discussed in more detail below with respect to the game's setup, board of apparatus 1 may be initially set up with "blank" inserts for inserts 30 and 40 which contain no rules/traps. Inserts for any one or more of inserts 30 and/or 40 containing particular types of rules/traps, from outside of the apparatus 1, may then be used to replace inserts that are shown in FIG. 1. I.e. an insert with a rule may be substituted for an insert of 30 and 40 that has no rule or is "blank" on the bottom.

As shown in FIG. 57A, the bottom of first modified insert 30*a*' has a rule and/or an alphanumeric character notation of "BP'". This notation indicates that a bomb (B) is associated with that particular insert 30*a*'. Thus, when that particular insert 30*a*' is placed by a player within one of the cuboidal spaces of board of game board apparatus 1, it will detonate when an opposing player's pawn piece (having base 100) (and only a pawn) is moved to the square associated with the cuboidal space containing this trap of insert 30*a*' (e.g., containing the insert 30*a*' with which the trap is associated). Once the "bomb" detonates and kills the opposing player's pawn piece, the bomb is no longer active, and is removed from the board of apparatus 1 (e.g., insert 30*a*' with which the bomb is associated is removed and optionally replaced with a "blank" insert 30*a* which contains no rule/trap). In other embodiments, the players may agree to a rule stating that bombs stay permanently on the board, with or without additional rules.

As shown in FIG. 57B, the bottom of the second modified insert 30*a*" has a rule and/or alphanumeric character notation of "Kn→B". This notation indicates that if an opposing player's knight (Kn) lands on the space/square with which this insert 30*a*" is associated, the knight piece (with base 100) is "swapped" or converted into a bishop (B). In other embodiments, one or more preset rules or traps associated with each square or piece may continue to apply throughout the game, with repeated activations thereof.

In yet other embodiments, "BP" (Bomb player) and "Kn→B" (Knight for Bishop) "traps" or "rules" may additionally or alternatively be directly associated with individual modified chess pieces of pieces 700 or 800 shown in FIG. 56. Rather than individual locations (A1, A2, A3 . . . ). For example, suppose an insert 30*a*" containing the notation "Kn→B" is attached to and underneath a rook (e.g., via magnetic attraction between metal or magnetic piece 31*a* in insert 30*a*" and magnet at bottom 102*b* of modified rook piece of pieces 700 or 800), and the players are playing a game in which the attached inserts 30 or 40 move with the pieces 700 or 800 on base 2. In that situation, if a modified knight piece, such as of pieces 700 takes the modified rook piece of pieces 800 which has this trap, then the modified rook piece of pieces 800 dies but the modified knight piece of pieces 700 is swapped for a modified bishop piece for first player pieces 700.

The various rules associated with inserts 30 and 40 are preset by each player to his/her side of the board 1 and/or to his/her pieces, such as of first player pieces 700 or second player pieces 800, and are initially unknown (hidden) with respect to each opposing player. By way of example, in certain embodiments, a first player presets rules for inserts 30 and 40 within the four rows in front of the first player (i.e., rows 1-4), and a second player presets rules for inserts 30 and 40 within the four rows in front of the second player (i.e., rows 5-8). Hidden inserts allow the concept of bluffing. In the example shown in FIG. 56, for the first player, who is controlling pieces 700, the first row is between the row member 24*a* and the member 4, the second row is between the members 24*a* and 24*b*, the third row is between the members 24*b* and 24*c*, and the fourth row is between the members 24*c* and 24*d*. For the second player, who is controlling pieces 800, the fifth row is between the row member 24*d* and 24*e*, the sixth row is between the members 24*e* and 24*f*, the seventh row is between the members 24*f* and 24*g*, and the eighth row is between the members 24*g* and the member 8.

Each of inserts 30 and 40 is configured as relatively flat square plates insertable in multiple layers within the same cubic/cuboid region defined by grid 20 (e.g. in at least one embodiment, up to three inserts, i.e. an insert of inserts 30, an insert of inserts 40, and an additional layer of inserts, not shown, wherein each insert of a stack of three (or two or one) may each contain a different rule, and may be stacked on top of one another within a space associated with one square location, such as at 'A1' in FIG. 56). In such stacking embodiments, the rules associated with inserts 30, 40, and an optional third layer of inserts not shown, in a particular square compartment (i.e., at A1) are executed in a top-down manner, whereby the rule associated with the top insert, such as an insert of layer 30 in FIG. 1, (on which a modified chess piece of pieces 700 or 800 stands) is executed first, followed by the rule associated with the next layered insert, i.e. an insert of layer of pieces 40 shown in FIG. 9 (and directly underneath the first layer of inserts 30 as shown in FIG. 42), followed by an insert of the third layer (not shown) (and supported by floor 12 directly underneath the second insert within the same compartment). The preset rules for rows one through four, set by the first player (controls pieces 700), only affect the second player pieces 800. The preset rules for rows five through eight, set by the second player (controls pieces 800), only affect the first player pieces 700. In other embodiments, all preset rules affect all pieces.

In preferred embodiments, each preset rule is executed if and only if it does not violate the traditional rules of chess in terms of creating an illegal move, such as placing one's own king in check, putting a pawn on the first row/rank, etc. It will be appreciated that the top surface of the top insert (which may be one of inserts 30, or when an insert of 30 is removed, may be one of inserts 40, or when there is a third layer, may be one of another layer of inserts) in each square/rectangular compartment functions as a portion of the surface of the chessboard on which modified chess pieces 700 and 800 stand and move. Inserts 30 and 40 may be colored black and white and may thus contain respective rules on the opposite side or bottom thereof, i.e. similar or identical to what is shown for bottom of 30*a*' in FIG. 57A or bottom of 30*a*" in FIG. 57B, hidden from view. Alternatively, top layer inserts of inserts 30 or 40 (depending which is on top) may be provided without any color, and grid 20 may be appropriately colored black and white (alternately) to signify black and white squares on board or game board apparatus 1. In yet other embodiments, inserts 30 and 40 may be colored black and white and may contain no respective rules on the opposite sides thereof, and merely function as removable and replaceable pieces of the playing board upon which pieces 700 and 800 move, with rules associated with other inserts of inserts 30 and 40 beneath the inserts colored black and white.

Figure 58A:
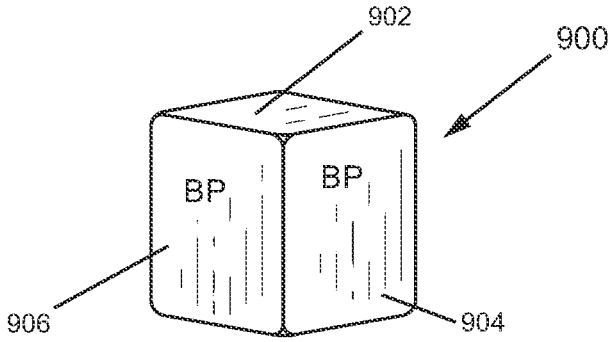
FIG. 58A is a front, top, and right perspective view of a cube for use in accordance with another embodiment of the present invention.
Figure 58B:
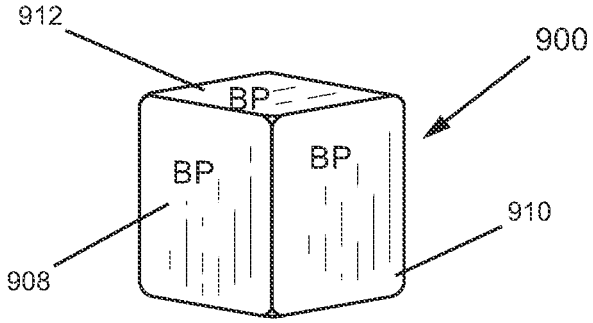
FIG. 58B is a bottom, rear, and left perspective view of the cube of FIG. 58B.

In certain embodiments, removable grid 20 is configured to define cubic regions instead of cuboidal regions by equalizing the height of grid 20 relative to floor 12, the distance between parallel and adjacent vertically extending strips or column members 22*a-g*, and the distance between parallel and adjacent horizontally extending strips or row members 24*a-g*. In such embodiments, inserts 30 and 40 are configured as either flat plates or modular cubes inserted into the cubic compartments/regions. In other words, rather than inserting a layer of inserts 30 stacked on top of another layer of inserts 40, potentially stacked on another layer of inserts not shown, single cubic blocks, such as including a cubic block 900 shown in FIGS. 58A-B, may be inserted into cubic regions, with each cubic block preset with a rule on each side thereof (i.e., on all four sides and the bottom thereof) except for the top side, which may or may not be painted white or black. For example cubic block 900 includes sides 904, 906, 908, and 910, top 902, and bottom 912. The rule "BP" for "Bomb Player" may be shown on sides 904, 906, 908, 910, and bottom 912 and not shown on top 902.

In such embodiments, the preset rules on the four sides (904, 906, 908, and 910) of the insertable cube 900 are temporarily hidden by removable grid 20 until the cube 900 is removed from removable grid 20. The preset rule associated with the bottom 912 of each cube 900 is of course also hidden from view. The preset rules are executed in any previously agreed upon order (e.g., bottom side first, then rotationally starting with a front side).

It will be appreciated that in the embodiments illustrated above, the alternating black and white coloring of the top side of inserts 30 and 40 containing magnets or metal pieces, such as identical or similar to piece 31*a* shown in FIG. 33, gives board of game board 1, the look and feel of a traditional chessboard. Alternatively or additionally, removable grid 20 can be colored white and black within and around each cubic/cuboidal space.

The bottom 102*b* may be or may contain a magnet, magnetic piece, or metal piece which is attracted to a magnet. Each of the first player pieces 700 and the second player pieces 800, which have a base 100, may have the bottom 102*b* with the magnet, magnetic piece, or metal piece which is attracted to a magnet. The magnet or magnetically attracted piece at the bottom 102*b* typically is configured to be magnetically attracted to the piece 31*a* which is typically included in each of the pieces 30 and the pieces 40, and any insert piece of any further layer of pieces. In at least one embodiment, each chess modified piece of 700 and 800 is magnetically attached to and moved with one or more respective stacked inserts 30 and/or 40 to a location where the modified piece of pieces 700 or 800 is moved.

In certain embodiments, inserts 30 and 40 are provided with magnets (instead of metal pieces) which are magnetically attracted to magnets mounted to the bottom 102*b* of each of modified chess pieces 700 and 800. Each modified chess piece of pieces 700 and 800 is removed from an individual insert of inserts 30 and 40 or from two or more magnetically coupled inserts of inserts 30 and 40 (such as one of layer 30 and one of layer 40) by simply inclining the particular modified chess piece of 700 and 800 relative to the particular insert of 30 and 40 while the piece of 700 and 800 is at least partially within one of the cubic or cuboid regions defined by removable grid 20.

If a modified chess piece of pieces 700 or 800 is instead lifted vertically, then one or more inserts of 30 and 40, which are magnetically attached to piece of pieces 700 and 800, are lifted up and out of removable grid 20 as modified chess piece of 700 or 800 is lifted. One or more inserts 30 and 40 may also be individually removed from a location on board of game board apparatus 1 using a modified chess piece of pieces 700 and 800, and moved while magnetically coupled to a modified chess piece of pieces 700 and 800 to a new location on board of game board apparatus 1. Additionally, a stronger magnet (not shown) may be provided separate and apart from game board apparatus 1 for regular use by players during a game to remove one or more particular inserts 30 and 40 from grid 20, or to remove all inserts 30 and 40 at once. This configuration allows inserts 30 and 40 to be snugly fit and maintained in the individual compartments during play or when the game is suspended and moved, yet still easily removable.

Floor 12, peripheral border (members 4, 6, 8, and 10), removable grid 20, and inserts 30 and 40 are preferably made of plastic, wood, metal, cardboard, or any combination thereof. Non-magnetic portions of game board apparatus 1 may be constructed from aluminum, plastic, cardboard, wood, and/or other lightweight materials. It will be appreciated that while lightweight materials are generally preferable for board games, in certain embodiments, if desired, game board apparatus 1 and/or base 2, can be constructed as a fixture, and made from heavier materials. In yet other embodiments, game board apparatus 1 and/or base 2 is configured as a flat surface, and inserts 30 and 40 are stacked on board or base 2 without grid 20. In certain embodiments, peripheral border (members 4, 6, 8, and 10), or a modified version, are equipped with one or more removable drawers, such as will be described with respect to FIGS. 65A-B, which display rules for each square within a particular row or column, or which selectively display removable blank stickers in which players can write preset rules for each square for each new game. For example, in certain embodiments, players could add bomb rules to the game by writing down which pieces of first player pieces 700 or second player pieces 800 or squares of the grid 20 are equipped with a bomb, and then reveal this information when the bomb(s) are triggered in the game. In yet other embodiments, no magnets are provided and pieces 700 and 800 attach to inserts 30 and 40 via another type of fastener such Velcro, clips, or other suitable attachment means.

As further discussed below with respect to several examples and illustrations of game moves played in accordance with the invention, modified chess pieces 700 and 800 can be tilted sideways to lie within their respective spaces atop the top insert of inserts 30 and 40 within removable grid 20. A flat cover, such as including two of the dividers 1100 shown in FIG. 62, or such as including the ceiling or roof 1202 shown in FIG. 63 can be placed over removable grid 20 and flush therewith, thereby trapping/maintaining chess pieces 700 and 800 within respective individual compartments defined by the grid 20, floor 12, and the cover. The ceiling or roof 1202 shown in FIG. 63 can be located at any height, i.e. the legs 1204, 106, 1208, and 1210, may be any desired length or height to set the height of roof 1202 with respect to the surface of members 4, 6, 8, and 10 and/or grid 20. In this manner, an existing game can be easily moved with all physical positions of modified chess pieces 700 and 800 maintained without writing down or memorizing any piece locations, and without having to store modified chess pieces 700 and 800 lumped together in one or two compartments. In certain embodiments, board or base 2 of game board apparatus 1 may be configured to house a single layer of inserts, such as inserts 30, and removable grid 20 may be dimensioned to receive only one layer of inserts 30, whereby board or base 2 is more compact and has less height when covered during a game and transported. It will be appreciated that even if no cover is applied to board or base 2, removable grid 20, which can extend upward above the top insert of inserts 30 and/or 40, itself maintains modified chess pieces 700 and 800 and inserts 30 and 40 in their respective locations if board or base 2 is moved, struck, or otherwise jostled, particularly if modified chess pieces 700 and 800 are placed lying down sideways in their individual spaces. All inserts 30 and 40 and preset rules associated with each location/position are thus easily maintained when the game is suspended or moved, so no disassembly or reassembly is required.

In certain embodiments described herein, it is preferable that during a game, if any conflicts arise between the normal rules of chess and one or more preset rules associated with a square of game board apparatus 1 or a particular modified chess piece of pieces 700 and 800, then the normal rules of chess take priority. For example, if the player controlling the first player pieces 700 were to move a rook to location/square H6 on grid 20, and the move clearly checkmated the opposing player's modified king piece (the player controlling pieces 800) based on the position of the pieces on board of grid 20 at that moment, then the game would be over regardless of any pre-set rules associated with square H6 or any piece on H6 that the rook captures. In other embodiments, rules associated with location/square H6 may be checked/reviewed and implemented, even if the player is checkmated, to see if implementation of the rule(s) would save the player from losing the game.

The term "priority" as used herein refers to the order in which various rules in accordance with at least one embodiment of the present invention are evaluated and executed.

The term "trap" as used herein refers to a preset rule applied to either a particular location of grid 20 within base 2 or of a modified chess piece of pieces 700 and 800.

The term "fizzle" as used herein refers to a preset rule which does not activate because activating it would go against the traditional/standard rules of chess, and thus is removed from the game or ignored.

The term "sight" as used herein refers to player awareness of traps and/or the specific positions of traps on board or grid 20 and base 2.

The following are rules in at least one embodiment for initial setup of game and priority. Various rules such as rules "BP" (Bomb Player), shown at bottom of piece 30*a*' in FIG. 57A and "Kn→B" (Knight for Bishop), shown at the bottom of piece 30*a*" in FIG. 57B, and as applied to the bottom of any number of inserts 30 and 40 are set up for the game board apparatus 1 by the players without each player knowing which rule(s) his or her opponent has applied to his or her squares (i.e., to rows one through four for first player controlling pieces 700 or to rows five through eight, for second player controlling pieces 800). First, the players agree upon which rules they want to incorporate into the game. For simplicity, the players may agree, for example, that the only rules (traps) they are going to incorporate into the traditional game of chess are "bombs" (i.e., "BP" as shown in FIG. 57A), and that the bombs will only be attached to particular squares of the board (A1, B1, C2 . . . etc) via inserts 30 and/or 40, but not to the movable modified chess pieces of pieces 700 or 800 themselves. In other embodiments, inserts 30 and/or 40 with bomb traps may be magnetically attached to the bottom of any one or more of pieces 700 and/or 800 and moved with modified chess pieces 700 and 800 on board formed by grid 20 and base 2, to each new location by swapping out one or more blank inserts of inserts 30 and 40 from board formed by grid 20 and base 2 each time a modified chess piece of pieces 700 or 800 is moved.

Initially, when setting up board formed by grid 20 and base 2, players may place a plurality of the modular inserts 30 and 40 that contain different types of bomb rules on them and a plurality of blank inserts of 30 and 40 (i.e., inserts without any rules/traps attached to or written on the bottom thereof) in a bag. Inserts 30 and 40 may be pre-marked and selected, written on by the players, labelled with stickers with one or more images showing the rules, and/or contain preprinted images on a side thereof corresponding to or showing particular rules.

The players then each blindly draw an agreed upon number of inserts 30 and 40 from the bag. The inserts 30 and 40 drawn from the bag by the players will thus include both inserts with rules/traps thereon (hereafter, 'insert-traps') and, in some versions of play, inserts 30 and 40 which do not have any rules/traps associated therewith (hereafter, 'insert-blanks'). If a player gets lucky, he or she will draw all insert-traps. It will be appreciated that when the player draws the insert-traps from the bag, he or she may cover the inserts 30 and 40 withdrawn so that an opposing player will not see what is drawn. Two draw bags may be utilized, one for white and one for black.

The "BP" (bomb player) is just one example of a rule-based bomb, and instructs "BP". As described above, this notation means that the trap is a bomb (B) that will kill an opposing player's modified pawn piece (P) that lands on the particular square with which the insert-trap is associated during the initial setup. Another example of a rule-based bomb would be the designation "BR" which is a bomb (B) that will kill an opposing player's rook (R) that lands on the square with which the insert-trap is associated.

As each player draws the predetermined number of inserts 30 and 40 from the bag, the other player will not know which types of bombs the other player has drawn, if any, or whether the other player has drawn any insert-blanks. It will be appreciated that placing a relatively large number of insert-blanks and/or insert-traps in the bag will reduce the likelihood of a player being able to deduce what has been drawn by the other player by simply looking at his own drawn inserts 30 and 40 if a single draw bag is utilized. For example, each player could draw from a bag which contains nine bomb insert-traps for pawns, two bomb insert-traps for bishops, two bomb insert-traps for rooks, etc., along with a large number of insert-blanks.

During this initial setup, board defined by grid 20 and base 2 is preferably pre-filled with insert-blanks 30 and 40 as in FIG. 1. After drawing their respective inserts 30 and 40, the players may then substitute one or more of their drawn inserts 30 and 40 for one or more of the insert-blanks 30 and 40 already in the spaces of board defined by grid 20 and base 2. This setup can be done while the other player is away from board (20 and 2) or in his/her presence, in which case the locations of the traps would be known (to the extent that the players watch each other and remember), but the specific types of bombs placed remain unknown until revealed. This setup can also be completed with both players present. A physical partition can be used to block each player's view. If neither player shows the bottom of his or her drawn inserts 30 or 40 to his or her opponent, then a partition may not be needed.

Each player may then swap out his/her drawn inserts 30 and 40 for the insert-blanks 30 and 40 already in board (formed by grid 20 and base 2) on his or her side of the board (i.e., in rows "1"-"4" or rows "5"-"8"). Since only one side of insert-traps 30 and 40 reveal the particular rule/trap, the opposing player cannot see it. Drawing inserts 30 and 40 in this manner thus provides additional elements of chance or randomness to the game as well as variability with limited sight (i.e., each player can strategize based on the traps drawn and decide upon any number of options in terms of how to secretly plant the traps he/she has drawn onto board formed by grid 20 and base 2). While this initial setup example involves only insert-traps which are bomb traps, other types of traps may additionally or alternatively be utilized for the game, such as, for example, insert-traps which are swap traps, such as for example trap shown by FIG. 57B.

Prior to the start of the game, the players may additionally agree on how priority levels are to be analyzed. As noted above, priority levels herein refer to the specific order in which stacked inserts 30 and 40 within each space on board formed by grid 20 and base 2 are analyzed. In one embodiment, a top to bottom approach may be utilized. In other embodiments, a bottom to top approach may be employed. If a particular cuboidal space contains multiple stacked inserts 30 and/or 40, and two or more of such stacked inserts 30 and 40 have respective rules on or associated therewith, then the top insert of 30 and 40 (i.e., the one directly beneath piece of pieces 700 and 800) may get first priority. Each insert of inserts 30 and 40 beneath the first priority insert may be assigned a subsequent priority (i.e., second priority, third priority, etc).

Continuing with the example of a game with only bomb-based rules/traps, a player may decide to place several of his or her bombs, each of which kills a particular type of piece, within one square. If, for example, a player draws a bomb trap which kills pawns and another bomb trap which kills rooks, then the player may stack these two bomb insert-traps 30 and 40 on top of each other within the space at that square so that either a pawn or a rook which lands on the square will be killed. The player may wish to place both bomb traps at, for example, at column D, row "2" or column E row "2", which are the two squares in front of the king of pieces 700 or the queen of pieces 700, during the initial setup. Since players like to control the center of the board, it may be advantageous to place more bombs (which can only kill an opponent" s pieces) within those squares as they are prime real estate on a chess board, located at D4, D5, E4, E5 On the other hand, if the players agree that bombs are removed once detonated, then placing them on prime real estate may prematurely detonate certain pieces in the game. An advanced pawn at the seventh rank, for example, may be more valuable to capture than a pawn at the fifth rank. On the other hand, if a trap does not detonate because doing so would violate the traditional rules of chess, then the trap is said to "fizzle," and is removed for attempting to activate. A trap may also fail to activate, and thus left on the board in some versions of play.

As another example, suppose the players agree to use both bomb traps, such as shown in FIG. 57A and swap traps, such as shown in FIG. 57B, and one player draws from the bag a bomb trap that kills bishops and a swap trap that switches a knight into a bishop. These two rules can be logically combined in different layers within a single space on the grid. If the bomb that kills bishops is the bottom of the top insert of inserts 30 and 40, then any bishop that lands on that square is immediately killed. If the swap rule that switches a knight into a bishop is placed at the second level (i.e., on the insert of inserts 30 and 40 directly underneath the top insert of inserts 30 and 40), then when an opponent's knight lands on that square, the bomb on the top layer will not initially detonate because the opponent's piece is a knight, not a bishop (the bomb only kills bishops). But when the second layer rule is revealed, the knight is swapped for a bishop. The bomb on the top layer, which kills bishops, then detonates and kills the bishop. All rules associated with a particular square/location may be deemed in effect at all times, even when rules at different layers are analyzed and implemented.

In this manner, two stacked insert-traps which are drawn from the bag by the player can be used within the same space to potentially kill two different types of pieces which land on the square associated with the space, even if the player only has a single bomb trap and a single swap trap. It will be appreciated that the invention provides different logical ways in which these rules may be applied and assigned priority. The following is a more detailed explanation of an exemplary execution of priority in accordance with the invention.

The following is a priority Example.

A piece of pieces 700 and 800 is moved to a square to take another piece. In accordance with the normal rules of chess, the captured piece is removed from the square, and the moving piece is placed on the square. The destination square's inserts 30 and 40 are then checked from top to bottom, starting with the top insert of 30 and 40 (Priority 1), and the following logic may be applied:

First Priority: (Top Insert-Trap for Insert of 30 and 40)

a. If the Trap (i.e., rule) on First Priority doesn't activate or is not present, go to Second priority.

b. If the Trap on the First Priority activates and a piece remains on the square, go to Second Priority.

c. If the Trap on the First Priority activates and a piece no longer remains on the square, then the turn is over and the move is complete.

Second Priority: (Middle Insert-Trap of Inserts 30 and 40)

a. If the Trap on the Second Priority doesn't activate or no trap is present, go to the Third Priority.

b. If the Trap on the Second Priority activates and a piece remains on the square, go to First Priority. (In some versions of play, go to Third Priority)

c. If the Trap on the Second Priority activates and a piece no longer remains on the square, the turn is over and the move is complete.

Third Priority. (Bottom Insert-Trap of Inserts 30 and 40)

a. If the Trap on third priority doesn't activate or is not present and third priority is the last (bottom) insert of inserts 30 and 40, the turn is over and the move is complete.

b. If the Trap on third priority activates and a piece remains on the square, go to first priority. (In some versions of play, the move is complete.)

c. If the Trap on third priority activates and a piece no longer remains on the square, the turn is over and the move is complete.

This execution of priority allows for many permutations and variations in the game setup and execution due to the initial drawing and setup by the players as well as the particular modified chess pieces of pieces 700 and 800 which happen to land on the squares during the game, and the manner in which those pieces are affected by the traps. Once an opponent's piece of pieces 700 or 800 is moved to a square with a trap, the opponent becomes aware of the trap, and can strategize future moves while taking into account the traps which are still part of the game. The following are various Traps (preset rules):

Traps herein refer to preset rules. While particular examples of bomb and swap traps are described above, it will be appreciated that a number of different types of these rules may be utilized. Such traps may include, for example:

Swap Traps—if a piece of pieces 700 and 800 specified by the trap associated with the square lands on this square, swap it with the specified piece.

Bomb Traps—if a piece of pieces 700 and 800 specified by the trap associated with the square lands on this square, remove the piece from the board.

Swap Attach Traps—identical to Swap Traps, except this trap can only be attached to a piece of pieces 700 and 800 directly and moves with the piece.

Bomb Attach Traps—identical to Swap Traps, except this trap can only be attached to a piece of pieces 700 and 800 directly and moves with the piece.

In certain embodiments, all traps of a particular type must be at the same priority level on chess board formed by grid 20 and base 2, and all traps that move with pieces of pieces 700 and 800 are on the same Priority Level(s). Additional types of traps (rules) in accordance with the invention may include, for example: (1) swap traps in which a specified piece of pieces 700 and 800 is swapped to any piece of pieces 700 and 800 of the player's choosing (i.e., the player who sets the trap chooses the piece the opponent's piece turns into once the opponent's piece lands on the square with the trap); (2) trapping/freezing a piece at a particular location, with exceptions; (3) transforming a modified pawn piece to a different modified chess piece before or after the game starts, or once the modified chess piece is touched; (4) making a modified chess piece immune to particular traps, (5) changing how a modified chess piece moves every round, whether by a die roll or some other method, and (6) immobilizing or limiting a modified chess piece's movement, but giving the modified chess piece a "poisonous" quality, whereby when another modified chess piece captures it, the capturing modified chess piece also becomes poisoned, cannot move or has its movements limited, can only move for a set number of turns, and/or or is swapped for a modified chess piece of lesser point value.

Other potential traps include causing a modified chess piece to switch sides, activating a modified chess piece on a square and allowing either party to move it, activating a rule instructing that a modified chess piece can never check the king, turning a piece into a different modified chess piece in two or more turns, and having a player roll dice to determine into which modified chess piece their modified chess piece will change.

The following two examples illustrate how the rules of at least one embodiment of the present invention are applied. For simplification, only the modified chess pieces discussed are shown on each board.

The following is one example:

A modified bishop piece of pieces 800 may be laid down or removed to reveal that the square beneath of pieces 30 is equipped with a bomb, on the bottom surface as in FIG. 57A. Modified chess pieces 700 or 800 and/or grid 20 may be configured and dimensioned such that when placed sideways on board (formed by grid 20 and base 2), pieces 700 and 800 always lie fully within the squares they occupy, and within the appropriate walls of grid 20 and base 2 so that a cover can be placed over grid 20 and all pieces 700 and 800 and board (of grid 20 and base 2) may be easily transported mid game while preserving all piece locations. Due to the depth of the base 2 and/or grid 20, modified chess pieces 700 and 800 can also be easily covered by removing or displacing top inserts 30 and/or 40 and/or one or more middle layers of inserts 30 and/or 40, which creates more depth for modified chess pieces 700 and 800 and allows them to be covered while standing vertically within grid 20 instead of being covered while laying sideways. In the actual game, if the first player (controlling pieces 700) has not yet moved a piece onto this square, then the first player would not know that one of the stacked inserts of inserts 30 and 40 within the cuboid space defined by removable grid 20 on this square contained a bomb rule set by the player during setup of the board (formed by grid 20 and base 2)

The first player (controls pieces 700) moves one of the modified rook pieces of 700 and takes one of the opposing player's (pieces 800) bishops off of the board (grid 20 and base 2). The first player announces "check."

However, since the particular insert of 30 and 40 in this example was equipped with a bomb that would destroy the rook of the first player (i.e. 'B R'), the white rook is killed and removed from the board, and the black king is no longer in check:

It is now the second player's turn (the player that controls pieces 800), and the second player may make any legal chess move. Alternatively, if the players were playing with the rules attached to the pieces rather than associated with the specific locations, and the first player's modified bishop piece had had an insert-trap piece for 30 or 40, that was moving with it (i.e., magnetized and attached to the bottom thereof), and the rule was 'B R' (bomb rook), then the first player modified rook piece would have activated the bomb when it killed the bishop, with the same result. In other embodiments, players may agree to allow a piece to survive an attack if the attacking piece is killed by the rule (trap) on the square or by the rule (trap) on the piece being attacked.

The following is a second example:

The first players' modified pawn piece is about to take a second player's modified pawn piece. The square under the modified black pawn piece contains a bomb trap (rule) which kills first player modified pawns (i.e: 'B P').

The first player modified pawn takes the second player modified pawn on the diagonal, placing the second player modified king in check.

However, because the insert in the square previously occupied by the second player modified pawn (now occupied by the first player modified pawn) contains a bomb which kills first player modified pawns, the first player modified pawn is also destroyed and removed from the board. Since a first player modified bishop sits on the same diagonal as the second player modified king, without the two modified pawns present, the second player is still in check due to the first player modified bishop. It is now the second player's turn to move, and the second player must move the second modified king out of check.

As noted above, traps can additionally or alternatively be attached to pieces of pieces 700 and 800, and move with the pieces 700 and 800. In certain embodiments, any traps that move with pieces 700 or 800 are assigned to the same priority level, and if multiple layers of traps are moved with pieces 700 or 800, then the moving traps are placed at corresponding priority levels at the destination square to which they are moved. When a trap is assigned to a modified chess piece and moved with the piece, the destination square's priority is checked first for a trap. If the destination square's corresponding priority level contains no trap, then the trap that moves with the modified chess piece is moved to the destination square at that priority level. If a trap is already present at the destination square on the same priority level as the priority level of the moving trap, then if the trap at the destination square activates and the moving piece survives or is changed, the player may have the option to fizzle (deactivate) his or her your own trap or have it overtake the new trap spot.

As also noted above, in certain embodiments, board (formed by grid 20 and base 2) may be configured without painted/colored top layer inserts 30 or 40, and may include a single layer of inserts 30 or 40, each equipped with metal insert for piece 31*a* of FIG. 38 which magnetically couples to magnet at the bottom 102*b* of base 100 of each of pieces 700 and 800. The squares of board (formed by grid 20 and base 2) may be colored using interior portions of grid 20 or just the edges of individual squares defined by grid 20 on the board formed by grid 20 and base 2. The board, formed by grid 20 and base 2, may alternatively be utilized with no color and the depth thereof may vary to accommodate one or more layers of inserts 30 and 40 (i.e., one deep, two deep, three deep, four deep, five deep, etc.):

It will be appreciated that each additional layer of inserts 30 and 40 in board (formed by grid 20 and base 2) add additional dimensions to the game, and the opportunity for introducing additional new rules thereto. In one embodiment, the individual squares on board (formed by grid 20 and base 2) defined by grid 20 are approximately one and 7/16th inches square and one half inch in height. Metal inserts may be used for inserts 30 and 40 wherein each insert of 30 and 40 may be approximately three quarters of an inch of an inch in height. Other dimensions may be utilized. Board (formed by grid 20 and base 2) may be configured with one or more shelves, slabs, larger corners, small sections attached to the side of base 2, etc. on each side thereof for storing a metal piece or additional magnet which each player can personalize and use to move pieces 700 and 800.

In certain embodiments, a bottom, such as bottom shown in FIG. 39 of inserts 30 and 40 is configured with images as noted above to showcase traps that are present. By way of example, instead of the configuration of insert 30*a*' in FIG. 57A showing "BP" a picture may be utilized:

As another example, a picture of a knight with two bombs (depicting bombs that kill knights) may be preprinted on the bottom such as on bottom shown in FIG. 39 of trap-inserts 30 and 40 instead of "B Kn". The following other figures may be preprinted on the bottom of inserts 30 and 40 for representing bomb-pawns, bomb-rooks, bomb-queens, and bomb-bishops:

These figures and/or other imagery may also be attached to the player's personalized magnet for moving pieces of pieces 700 and 800 and/or the player's personalized section of board (formed by grid 20 and base 2). Other images and themes may be used. In certain embodiments, modified chess pieces 700 and 800 are configured to store one or more elements of chance, such as dice, rules, traps with rules, and the like, such as in recess 104 of the base 100, shown in FIG. 43.

Each of modified chess pieces 700 and 800 is equipped with base portion 100 for storing the one or more elements of chance. Base portion 100 defines a cavity 104 on one side thereof for storing one or more dice or cube 600 shown in FIGS. 50 and 52, customized cubes, sheets containing rules, or the like. All rules that may be present on insert of inserts 30 and 40 may be placed on customizable cubes. Cavity 104 in base 100 may contain multiple dice or customized cubes. All customizable cubes are governed by accepted priority rules when activated. Priority can affect both inserts 30 and 40 and any rules inside cavity 104 separately or jointly in any combination. Base portion 100 also defines one or more gripping ribs on body portion 102 for gripping to hold piece of pieces 700 and 800, and houses magnet or magnetic attraction device inside of body portion 102 towards or on the bottom 102*b* with magnet in some embodiments resting against a shelf thereof (e.g., glued thereto).

Base portion 100 can be uniform/modular, and thus attachable to or detachable from the upper portion (i.e., the portion which looks like a pawn, rook, queen, etc) of every modified chess piece of pieces 700 and 800. Base portion 100 may be fixed to the upper portion of the modified chess pieces 700 and 800 by any suitable mechanical or fixing means, such as via an elongated upper neck portion of base portion 100 may be received in a corresponding channel of upper portion of pieces 700 and 800.

Modified chess pieces 700 and 800 may be formed with, for example, a Staunton (2.7" Staunton) design. Cavity 104 of each of pieces 700 and 800 may be a three quarters of an inch square hole on one side thereof. Other dimensions may be utilized.

Base portion 100 may be approximately one and one sixteenth (1.0625) inches in diameter. Cavity at the bottom 102*b* of base portion 100 for housing magnet may be 13/16ths (0.8125) inches in diameter and approximately 0.2 inches deep. Other dimensions may be utilized. Cavity 104 for housing a die or dice 600 above shelf 104*b* is sized to snugly fit one or more standard die 600 (i.e., 8.0 mm (millimeter), 12.0 mm, 16.0 mm, 19.0 mm, 25.0 mm) so that die 600 does not rattle around inside base portion 100 when piece of pieces 700 and 800 is moved, but is easily removable from cavity 104. It will be appreciated that die 600 is hidden from an opposing player, as cavity 104 is intended to face the player who is moving piece of pieces 700 and 800. Hidden dice allow the concept of bluffing. A player can also hold his or her thumb over the back of piece of pieces 700 and 800 so the cube or die 600 inside does not move and cause sound, which would alert the opponent that there is a trap within the modified chess piece of pieces 700 and 800. In some instances, felt or other finishing material could be placed inside cavity 104, creating a more snug environment that dampens sound for die 600 or any substitution for die 600. In other instances, a button or magnet can be used to secure die 600 or other substitutions for rules to die 600 within cavity 104, thus reducing all sound and movement so it is not necessary for a player to use his or her thumb to mask such sound and movement. Base portions 100 may be part of all modified chess pieces 700 and 800 so that each player does not know which of his or her opponent's pieces contain die within cavity 104.

Base portion 100 may be a separate, modular piece that equips to a regular chess piece, thus forming each of pieces 700 and 800. A fastener of some type or some form of adhesive can be added to the bottom of a normal chess piece or the top of base portion 100 in order to equip, fasten, glue, etc base portion 18*a* to a chess piece, thus forming chess pieces 700 and 800.

When manufactured, modified chess pieces 700 and 800 may be equipped with felt or a finishing material on the bottom 102*b* for improving aesthetics and hiding imperfections from a 3D printing process. Modified chess pieces 700 and 800 may also be equipped with a cover, door, veil, curtain, or any other covering to cover cavity 104 to prevent an opposing player from seeing exactly what is inside a modified chess piece of pieces 700 and 800. As noted above, cavity 104 may store a standard die 600, but may alternatively store, for example, a customized wooden, plastic, or metal cube approximately 0.6" in size, which is insertable into cavity 104. Such customized cube may depict, on one or more sides, one or more of the various rules described herein, in shorthand or via one or more illustrations or images such as those shown above with respect to a knight with two bombs (depicting bombs that kill knights), a pawn with a bomb, etc.

It will be appreciated that if chess piece of pieces 700 and 800 is equipped with cavity 104 for storing one or more elements of chance such as a die, then if an opposing player's piece captures this piece, then the opponent's piece may be removed from the board once the rule stored within cavity 104 of piece of pieces 700 and 800 is implemented (i.e., if the rule applies). The customizable cube 600 placed inside cavity 104 may be formed with the same size or similar size as a standard 16.0 mm, six sided die, or with other standard die sizes.

Die 600 or the customized cube inside cavity 104 may be rolled if modified chess piece of pieces 700 and 800 in which it is secretly stored is captured. Depending on the result of the roll of the die or customized cube 600, the attacking piece may be destroyed. By way of example, one of the players may be required to roll die 600 when a piece of pieces 700 and 800 is captured. A die roll of '1' may be deemed to destroy a pawn, a '2' may destroy a knight, a '3' may destroy a bishop, a '4' may destroy a rook, a '5' may destroy a queen, and a '6' may automatically destroy the attacking piece (i.e., regardless of the type of the attacking piece). A roll of '6' may alternatively allow for the implementation of another rule.

If the king is the attacking piece and a '6' is rolled, then this situation may be deemed to violate the rules of traditional chess (a king can only be checkmated, not captured), and this rule may be deemed inapplicable. Alternatively, if a king captures a piece of pieces 700 and 800 and a '6' is rolled, then this situation may be considered like scratching with the '8' ball in pool, and create an automatic loss of the game for the opposing player. In yet other embodiments, if a '6' is rolled, then the rolling player or the non-rolling player may be allowed to place the die 600 in a new one of his or her pieces of either pieces 700 or 800. Any particular numbers 1-6 of the die roll may correspond to any one of the different types of modified chess pieces of pieces 700 and 800, and/or of the rules discussed herein, which may be implemented in accordance with the die roll. If a customized cube is rolled, then if the cube lands on a side showing, for example, a knight with bombs, then if the attacking piece is a knight, it is killed and removed from the board. In this manner, modified chess pieces 700 and 800 may be utilized to carry rules and add elements of chance to the game without disrupting board (formed by grid 20 and base 2).

In other embodiments, removable inserts 30 and 40 may utilized for a matching game to teach about chess in general or one of the versions of chess described herein. By way of example, top layer of inserts 30 and 40 in board (formed by grid 20 and base 2) may have a bottom layer configured with illustrations depicting a knight which needs to be matched to a '3' or a bishop which needs to be matched to a '3' (their point values), or matching a '3' to an (the point value of a knight to the direction the knight moves), or some combination thereof. The board (formed by grid 20 and base 2) utilized to conduct a matching game, such as by matching a particular rule to a corresponding correct image, and potentially used with younger players and even toddlers as generic teaching tools. Inserts 30 and 40 may be formed with soft cushioning on the bottom thereof, with particular colors, and/or with identifications of particular colors (red, blue, green, etc) that need to be matched. A magnet tool may be utilized to remove inserts 30 and 40 and help with motor skills. A tool with a hook on the end may also be used to remove inserts 30 and 40 instead of utilizing magnetic coupling thereof.

In certain embodiments, the various rules described herein may be used in the game during in-person play without utilizing board (formed by grid 20 and base 2) to incorporate them. By way of example, bombs as described herein may be added to the game by writing them down on a piece of paper, along with the location to which they apply. The paper may be divided into a number of sections corresponding to the particular squares of the board which the players cannot reveal until a piece lands on one of them. Alternatively, it will be appreciated that board (formed by base 2 and grid 20) can be utilized just two levels deep to reduce the size and weight thereof. The first primary level may be, for example, traps attached to pieces, and the second primary level may be traps attached to the squares.

Computer-Implemented Gaming System:

It will be appreciated that the various rule-based game systems and methodologies described herein with respect to physical board (formed by grid 20 and base 2), and the various chess game rules and methodologies which depict or are configured to facilitate a step or a group of steps for a new chess game, may be executed by a computer-implemented system. The game systems and methodologies described herein may be utilized through or by, for example, a processor, a mobile computing device, an app, a website accessible by a web browser, a device having a stored program, or through any other suitable means.

Each step of the various game methodologies described herein may contain one or more sub-steps. For purposes of illustration and explanation, these steps, as well as all other steps identified and described, are presented in a certain logical order. However, it will be appreciated that any exemplary embodiments described herein can contain an alternate order of the steps adapted to a particular application of a technique disclosed, and that any such variations and/or modifications are intended to fall within the scope of the invention. The depiction and description of steps in any particular order is not intended to exclude embodiments having the steps in a different order, unless required by a particular application, explicitly stated, or otherwise clear from the context.

Various modules of the game systems, platforms, and methods described herein may be implemented by using an interfacing mobile app on an internet enabled mobile device's operating system, such as, for example, Android, iOS, or Windows Phone OS, and in part by using a web interface, and different types of users may utilize different functionalities. Systems described herein may include implementations through a combination of hardware and software that operate on a stationary or portable computing devices, and may comprise various preprogrammed features combined and integrated with basic components, including but not limited to, one or more servers, databases, mobile end applications, web portals, network settings, etc. With the support of these components, the system provides the services and functionalities through user interfaces such as a website or mobile applications.

The systems described herein may have more than one server in a distributed structure with support from data centers located anywhere in the world. Implementations may be communicatively linked and cross-platformed so that a user may be provided with game information relevant to his or her inquiry. The system may function on more than one computer architecture, operating system, application software, application programming interface (API), web application, etc. It will be appreciated that computer program instructions used by systems described herein and/or the apps for use with the system may include computer executable code in one of a variety of languages, including C, C++, Java, JavaScript, etc., and that all system components and system processors may be operatively coupled or operatively associated with one another wirelessly, via hardware, software, and/or through cloud-based computing. The computer-implemented system is best understood with reference to, for example, FIGS. 59-61.

Figure 59:
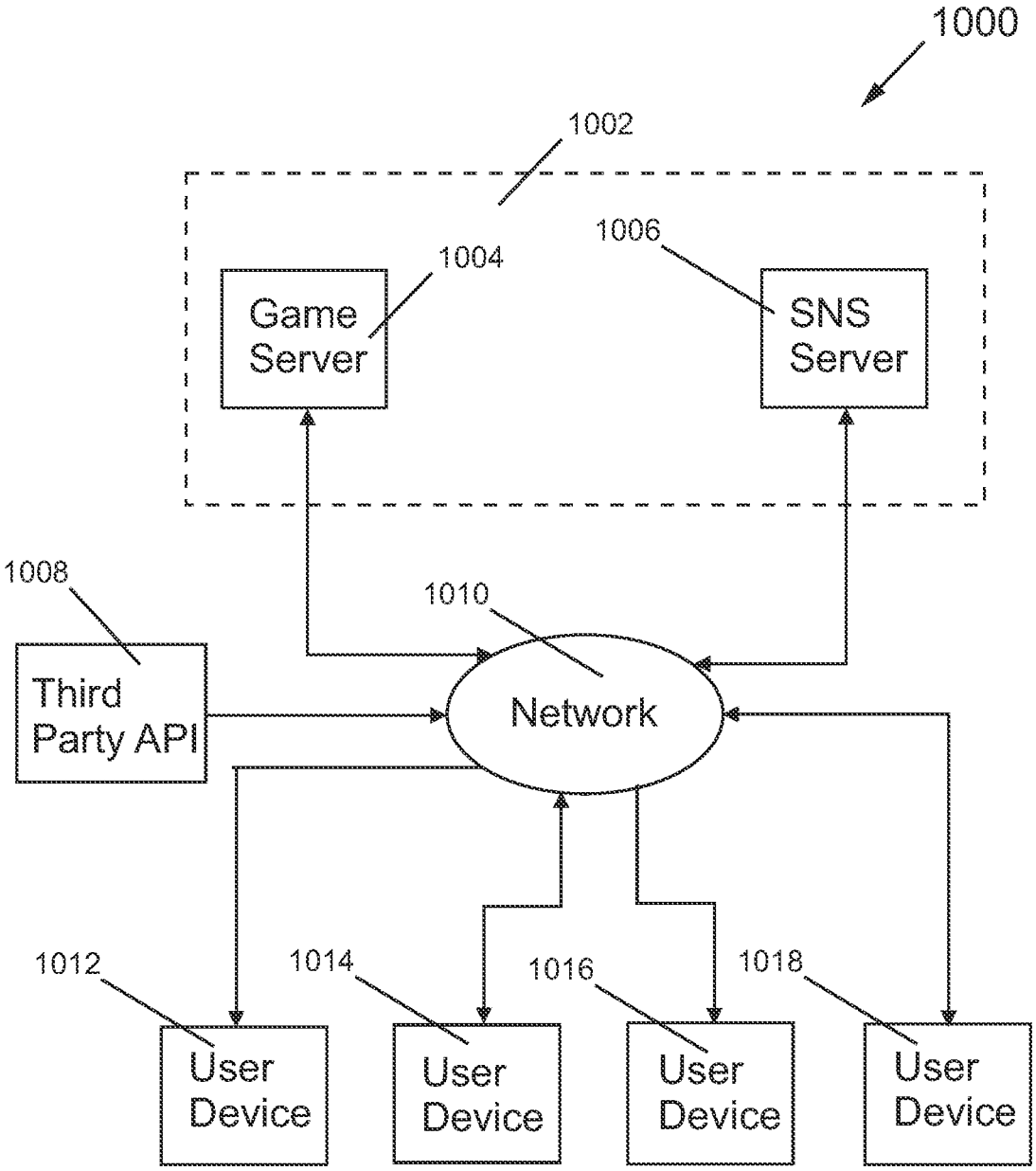
FIG. 59 is a simplified block diagram of an exemplary computer system.

Referring to FIG. 59, illustrated is a simplified block diagram of an exemplary computing system 1000, a plurality of peripheral remote user computing devices 1012, 1014, 1016, 1018, and at least one third party API (application programming interface) 1008 for use with various exemplary embodiments of the present invention. A combination of hardware and software operates on computing devices 1012, 1014, 1016, and 1018 and the computing system 1000, generally with one or more connections to wired or wireless network 1010 (e.g., a wide area network (WAN) such as the Internet), incorporated with local devices through a local area network (LAN) interface (not shown). Computing system 1000 can include, for example, game server 1004 and any form of Social Networking Service (SNS) server 1006. It will be appreciated that all game system and methodologies described herein can be used in conjunction with, as part of, or remote but operatively coupled to game server 1004 and/or social network server 1006. Game server 1004 is operatively coupled to user devices 1012, 1014, 1016, and 1018 via network 1010.

Figure 60:
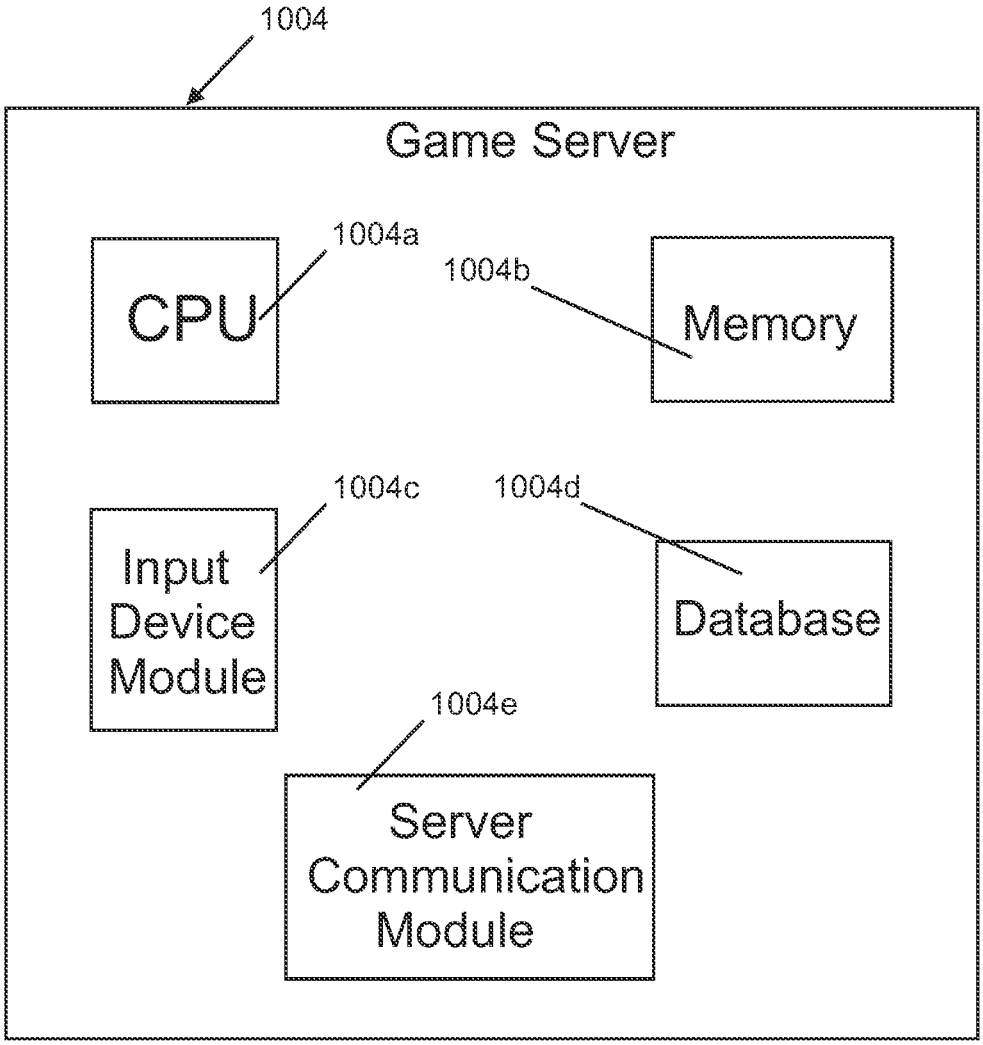
FIG. 60 is a simplified block diagram of a game server of the computer system of FIG. 59.
Figure 61:
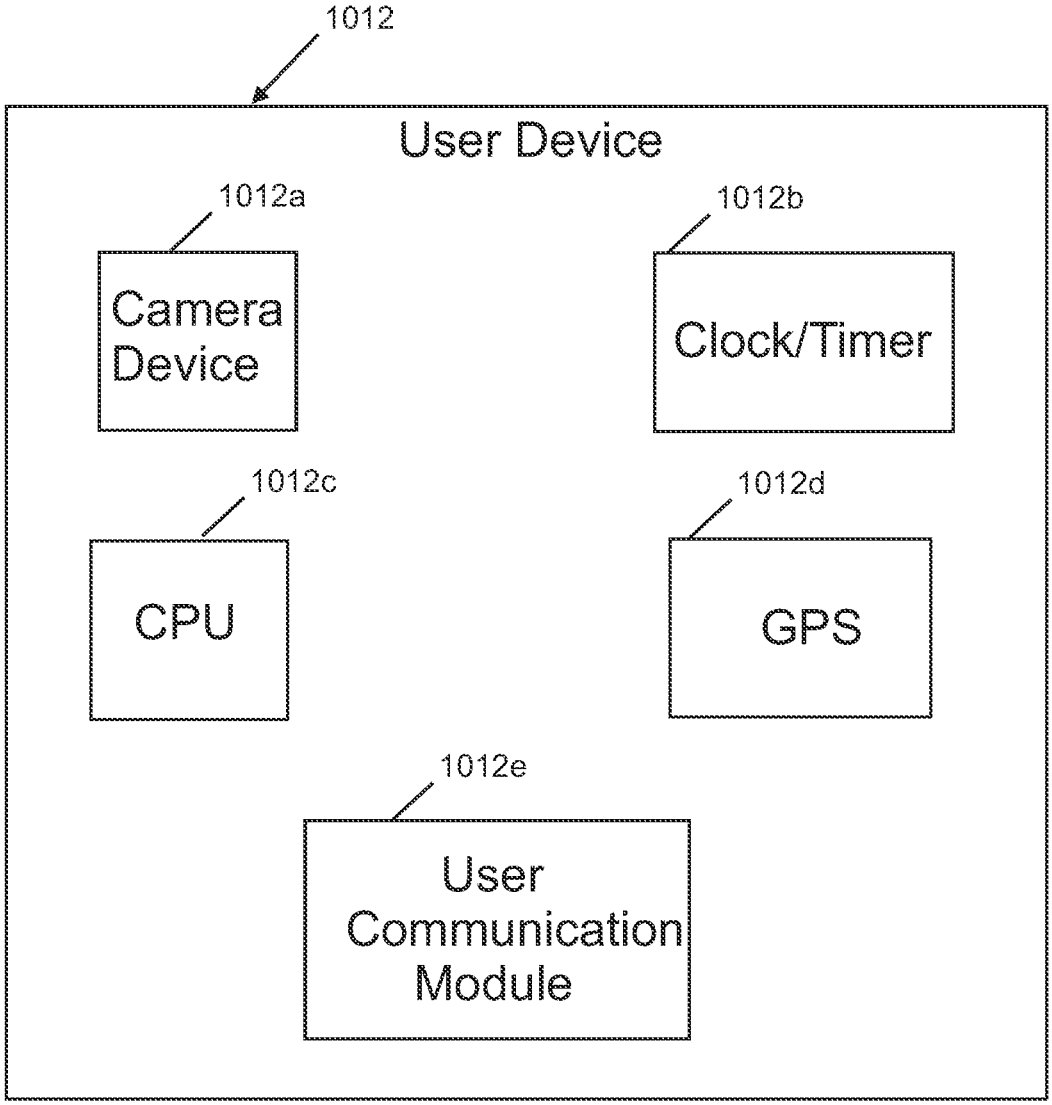
FIG. 61 is a simplified block diagram of a user device of the computer system of FIG. 59.

Referring to FIG. 60, game server 1004 may include central processing unit or control unit (CPU) 1004*a*, which executes programs stored in memory 1004*b* to perform various types of processing, and transmits and receives data to/from user computing devices 1012, 1014, 1016, and 1018 through network 1010 via server communication module 1004*e*. Memory 1004*b* may include, for example, a hard disk drive or a memory such as R.A.M. (random access memory), and may store various programs such as a game program, game data, etc. Game server 1004 may also be configured to function as a general server for purposes other than performance of multi-dimensional chess games described herein. For example, game server 1004 may be configured to provide access to, via CPU 1004*a*, other game servers, networks, or related applications, and may work in conjunction with third party API 1008 to provide such functionality. Game server 1004 may also be configured in communication with Social Networking Service 1006 for communicating and receiving user profile data and user network data associated with other of a user's online activities for advertisement and analytics purposes.

Game server 1004 may also include database 1004*d* for storing data received during user registration and each game, connections made with other users, moves made during games played and the results thereof, user-inputs, etc. For example, such stored information may include user profile data, names, addresses, phone numbers, associated devices, IP addresses, associated user pictures, prior game data, user connections and networks, social media connections, uploaded content, text messages, communications, captured images, prior games, information concerning the users' devices, privacy settings, preferences, interests, occupations, relatives, etc.

In certain embodiments, database 1004*d* may also categorize such stored information based on other content uploaded by users, or by user choice. Input device modules 1004*c* may also be provided in conjunction with server communication module 1004*e*, and operatively coupled to external PCs (personal computers) or mobile devices to input commands from administrators of system 1000.

Each user device of 1012, 1014, 1016, and 1018 may be any user computing device such as a mobile phone, a smartphone, a laptop computer, a desktop computer, a tablet, and the like. Any user device of 1012, 1014, 1016, and 1018, such as user device 1012 shown in FIG. 61, may include a camera device 1012*a*, a central processing unit 1012*c*, a clock or timer device 1012*b* for playing blitz or rapid forms of the various chess games described herein, a GPS location identifier 1012*d* configured to identify a location or geolocation of a user via communication with global positioning system (GPS) or similar technology, and a user communication module 1012*e* for communicating with game server 1004 via network 1010 shown in FIG. 59. It will be appreciated that in certain embodiments, user device 1012 (or any other user device, such as 1014, 1016, and 1018, or any further number of user devices) may simply be a terminal, and that some or all of the functionalities of these components may be provided by a remote computing device such as CPU 1004*a* of game server 1004. In certain embodiments, camera device 1012*a* of user device 1012 in FIG. 61 may be remote from user device 1012 and configured to capture a digital image which can be later transferred to user device 1012 and/or game server 1004 by email, text, MMS, or any other suitable means through network 1010.

One or more processors of system 1000, game server 1004, or any one of user computing devices 1012, 1014, 1016, and/or 1018, and/or any further number of user devices, may be configured to implement, individually or in combination, any of the chess game systems, methodologies, rules, and displays disclosed herein, as well as added functionality not available on a physical board. For example, system 1000 may be configured to utilize a camouflage rule which makes a modified chess piece of pieces 700 or 800 invisible to an opposing player, which can be done on a display screen but not on a physical board. Additionally, system 1000 may be configured to configure the initial setup of the chess board automatically, allow the players to agree upon the various rules, to individually view the computer's automatic placement of his or her drawn traps, or to prompt the user to indicate where he or she wishes to place any drawn insert-traps. Such "drawings" of inserts on the computer may be computer-generated or based on actual random drawings by the computer, "spins" by the user by pressing a button, or by any other suitable means.

In certain embodiments, system 1000 may be configured to utilize camera device 1012*a* to take a picture of a physical chess board (e.g., image of FIG. 1, image in various different stages, such as when various inserts of 30 and/or 40 are removed and/or pieces of pieces 700 or 800 are moved or removed from board, or a conventional chess board, and various different stages) that is then uploaded and mimicked in the application. In this manner, users can play in person on any standard chess board, and also utilize system 1000 to incorporate the various rules, setups, and methodologies discussed herein. During play, camera 1012*a* may be placed above the board and configured to take a picture thereof after each move. System 1000 may then instruct the players via individual apps operating on their respective user devices, such as user device 1012 for the first player and user device 1014 for the second player, as to the ramifications of their moves and the rules associated with the squares of the board on which their moving pieces land. It will be appreciated that such configurations allow users to set up a board instantaneously, and/or to play a hybrid form of the game which utilizes aspects of both physical board (formed by grid 20 and base 2) or a classical board and a computer-implemented system or method. Adding specific trap rules as described herein can alternatively be done separately, by system 1000 or inputted thereto by the players. Such embodiments, bridge the analog physical board with the digital world for game continuation, analysis, and the like.

Below are two additional examples of the application of certain rules of the invention, but this time by a processor or computer-implemented system such as system 1000.

Example-3

A second player modified rook piece of pieces 800 moves into the same column as a first player modified king piece of pieces 700. The second player announces "check." The first player modified knight piece may be shown on a computer screen in a different color or design than the remaining pieces to represent the fact that on the computer-implemented system 1000, it is "camouflaged" or invisible (not displayed) to the second player on the second player's screen. The first player modified knight piece of pieces 700 blocks the first player modified king piece of pieces 700 from being in check by the second player modified rook piece of pieces 800. The first player is not actually in check, so check is not indicated by the system 1000.

The first players' modified knight piece of pieces 700 cannot move because it is pinned, but remains invisible. It is now the first player's turn. The first player is not forced to protect his or her king and may make any legal move. While the first player modified knight's location is not displayed to the second player, the second player may infer that there is an invisible piece between the second player modified rook piece and the first player modified king piece because "check" will not be indicated. The second player will be able to deduce that there is an invisible piece in one of the three squares between the second player modified rook and the first player modified king, but will not know which piece it is, or on which square it lies. In certain embodiments, system 1000 may be alternatively configured to display the camouflaged first player modified knight piece to the second player in this situation because the first player modified knight lies in the second player modified rook's line of fire and blocks the "check."

Example-4

The first player tries to move the first player modified rook from H1 to H8 (upper right corner to upper left corner in the figure below), and doesn't know there is a camouflaged (invisible) second player modified pawn, on H4.

When the first player releases the first player modified rook at H8, system 1000 instead places the first player modified rook piece at H4 and takes the second player modified pawn, which is revealed to the first player. It is now the second player's turn.

System 1000 may be configured to generate various user interfaces, including a plurality of graphical user interfaces configured to guide a new player through an initial authentication or registration, selection of player characters, visual or audio data and sound effects, a particular type of chess game in accordance with various rules and methodologies described herein. System 1000 may also be configured to request, through one or more graphical user interfaces, that the players select whether or not to play the computer (and if so, a level of play such as beginner, intermediate, or advanced), or whether to play another user. System 1000 may be configured to calculate, store, and/or display player scores, ratings, user profile data, social networking features, and the like. In certain embodiments, system 1000 may be configured with each rule controlled/setup with a Boolean operator, whereby when creating a new game, all rules can be turned on and off by a user and combined in different ways. In certain embodiments, system 1000 may be configured to utilize artificial intelligence (AI) to improve upon the various chess game embodiments disclosed herein by using data from previously played matches to predict best moves based on, for example, where players typically place bombs or other traps given various initial setup and/or fluid parameters and elements of chance described herein. Players can then study such patterns which emerge from AI analysis of more and more games played.

Various potential graphical user interfaces may be generated and displayed by one or more processors of system 1000. In at least one embodiment, as an alternative to metal and/or magnetic piece or plate 31*a* shown in FIG. 33, the piece 30*a* can be pushed into the bottom 12 of base 2 to fasten it and pushed again to eject it. In such an embodiment, the bottom 12 or piece 30*a* may be spring loaded, similar to pushing a memory card into a camera or smartphone, as will be described in reference to FIGS. 66A-B and 67A-B. In at least one embodiment, the pieces or inserts 30 and 40, will not entirely eject. Instead they will come up high enough for a player to input a trap. In this way, each of inserts 30 and 40 may be equipped with a trap (graphic or alphanumeric signifying a rule) instead of removing the insert of inserts 30 and 40 completely. In at least one embodiment the bottom 12 of the base 2 may not be completely solid. The base 2 may be on legs to elevate it from the surface it rests on. In such an embodiment, the base 2 and the grid 20 may be configured to allow a player push up on an insert of inserts 30 and 40 to remove it and swap it for an insert that has a "trap" (i.e. a graphic or alphanumeric signifying a rule) as will be described with reference to FIGS. 64A-B. In at least one embodiment, the inserts 30 and 40 rest on the bottom 12 of the base 2, wherein on the top surface of the bottom 12, there is another grid.

In at least one embodiment of the present invention, the bottom 12 of the base 2 will not be flush with the bottom of the border (4, 6, 8, and 10 shown in FIG. 1). The individual inserts 30 and 40 in such an embodiment, are configured to sit slightly higher so they can be removed with fingertips.

In at least one embodiment, the cubes 600 or 900 may be made of a metal which is attracted by a magnet. Such a metal or magnetically attracted cube 600 or 900 is configured to be pulled out from the recess 104 of FIG. 43 and FIG. 50, using magnetic attraction.

Figure 62:
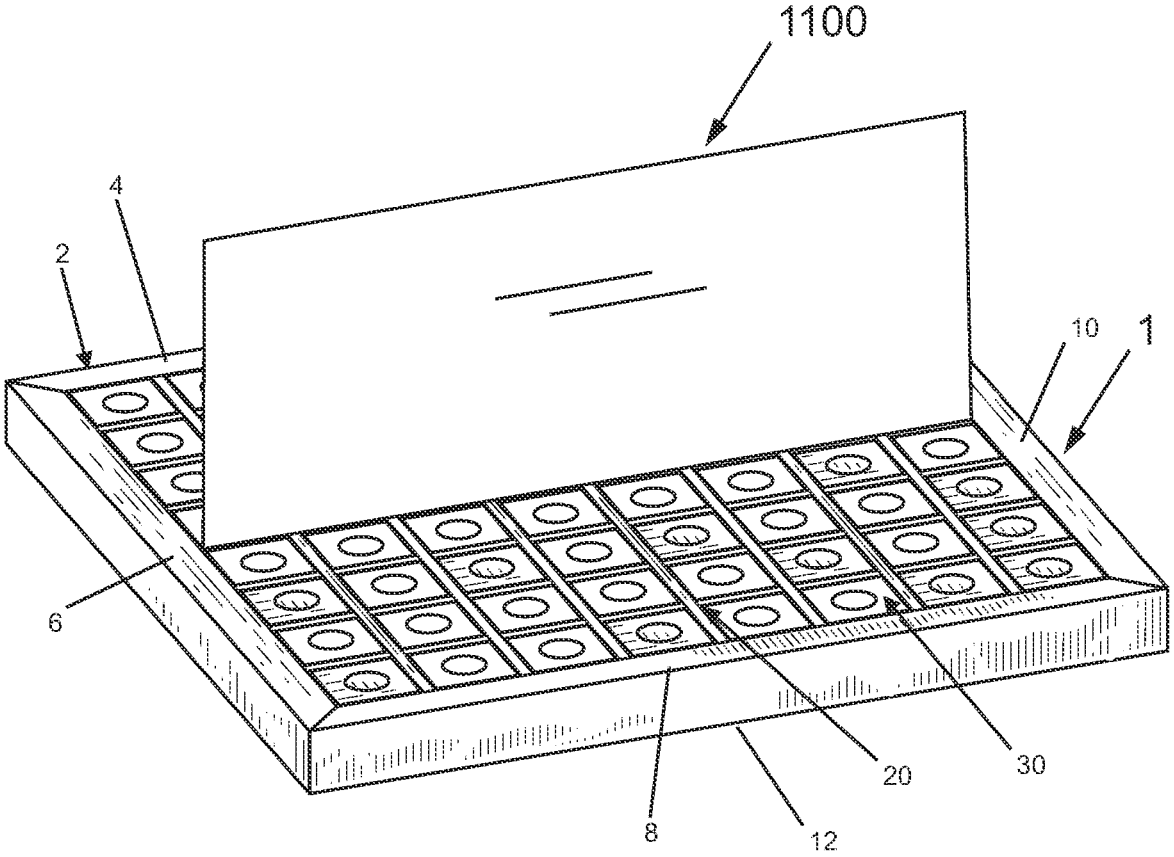
FIG. 62 is a left side, top, and front perspective view of the game board apparatus, in accordance with the present invention, wherein the game board apparatus is shown in a fully assembled state, and along with a divider or screen between the first player and the second player.
Figure 63:
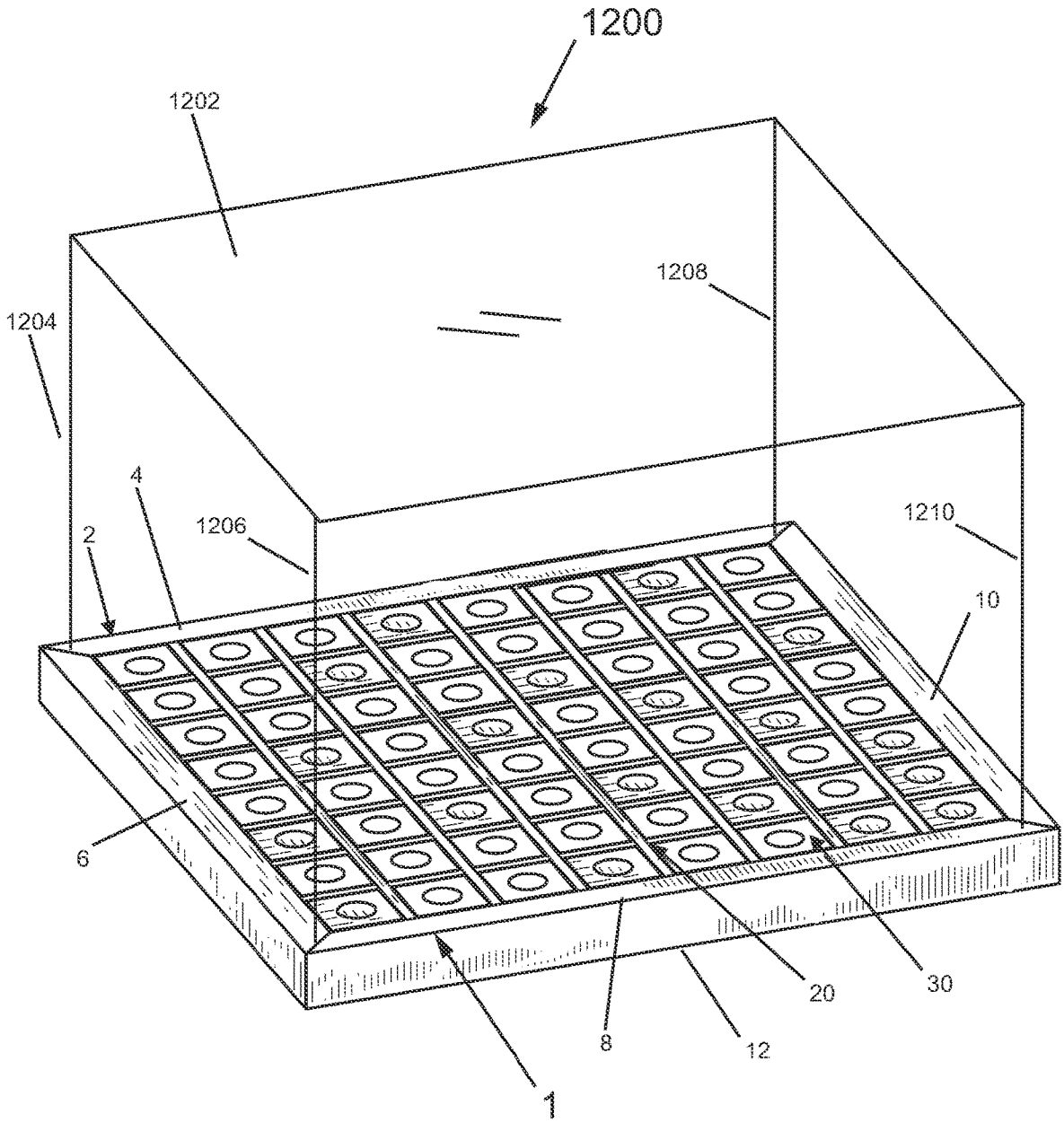
FIG. 63 is a left side, top, and front perspective view of the game board apparatus, in accordance with the present invention, wherein the game board apparatus is shown in a fully assembled state, and along with a roof and/or enclosure shown covering a substantial portion of the game board apparatus.

In at least one embodiment, a divider or screen 1100 may be provided between the first player and the second player, such as running along the fourth row member (row member 24*d* shown in FIG. 25) in FIG. 62. The divider or screen 1100 is configured to be removable, and to be used also as a cover to cover all of the grid spaces, or all of locations where pieces 30 are shown in FIG. 1.

In at least one embodiment, each of the height and width of the divider/cover 1100 is typically equal to half of the length and width of the chessboard (where that is the distance from the inside surface of member 6 to the inside surface of member 10, and the distance from the inside surface of member 4 to the inside surface of member 8.

In another embodiment, the height and width of the divider/cover 1100 is equal to the entire size of the chessboard. In another embodiment, the divider/cover 1100 may be larger than the length and width of the chessboard (including base 2 and grid 20).

Two dividers/covers 1100 may come with the apparatus 1.

Putting both dividers/covers 1100 under the base 2 protects the dividers/covers 1100 from dirty surfaces, fully encompassing the bottom 12 of the base 2.

Putting both dividers/covers 1100 on top of the apparatus 1 in the assembled form of FIG. 1, so that the combination of covers 1100 covers all of the pieces 30 and/or all spaces formed by grid 20 and members 4, 6, 8, and 10, protects the pieces 30, 40, members 4, 6, 8, and 10 and fully encompassing the top of the chessboard (including members 4, 6, 8, and 10, grid 20, all grid spaces, and all inserts 30 and 40 that are part of apparatus 1 in the assembled form of FIG. 1.

When playing a game, either of dividers 1100 can be used as a divider by securing within a elongated slot that is cut out of the center row member 24*d* (shown in FIG. 25), and slots cut into column members 22*a*-*g*. There are seven by seven grid lengths on each side. Grid length or row member 24*d* from one side or both sides may be configured to be a shorter height than the other row members 24*a*-24*c*, and 24*e*-24*g*. This will allow the cover/divider 1100 to slide inside row member 24*d*.

Either of dividers 1100 may slide into the center grid or row member 24*d* to use as a divider, allowing both players to set up pieces of pieces 30 and 40 on their side of divider 1100 in secret. The divider 1100 may have different ways to fasten into the center or to the row member 24*d*. For example, the edge of divider 1100 or 22*d*' shown in FIGS. 68A and 68B may be made of metal and the opening in the center grid or member 22*d*' or 22*d* may go to a magnet that holds in the divider 1100 or 22*d*'. Alternatively, the divider 1100 or divider 22*d*' may fasten to border members, such as members 6 and 10 or members 4 and 8 respectively.

The divider 1100 is typically configured to stay upright by just sliding into row member 24*d*, and friction keeps it upright from one or both dividers 1100 securing in row member 24*d*.

As an example, a single cover/barrier 1100 may be provided, which secures into the middle, such as to row member 24*d*, and stands upright to act as a barrier. In at least one embodiment, this will cover exactly half of the chessboard (grid spaces formed by grid 20 and members 4, 6, 8, and 10), so it can cover the squares on a chessboard that has all the modified chess pieces of 700 and 800 in their starting locations.

All divider/covers, such as divider 1100, can be painted, printed on, etc. Art can be put on them. Edges and corners of the divider/cover 1100 may be cut differently for an enhanced appearance.

In at least one embodiment, an apparatus 1200 including a roof or ceiling 1202 and legs 1204, 1206, 1208, and 1210 is configured to be used to cover the grid spaces of formed by grid 20 and members 4, 6, 8, and 10. Each of legs or pillars 1204, 1206, 1208, and 1210 sits on a corner of base 2. Roofs 1202 can be made in any style, material, design (painted, colored, printed, etc).

In at least one embodiment, the apparatus 1200 may be an enclosure with walls between legs 1204 and 1206, between legs 1206 and 1210, between 1208 and 1210, and between 1208 and 1204. The enclosure may be artistic/painted. The enclosure form of apparatus 120 is configured to sit on the entire border (members 4, 6, 8, and 10) of the base 2, grid spaces, and pieces 30, 40, and any pieces 700 and 800.

In at least one embodiment, an authenticity certification may be provided for each apparatus 1 and any other apparatus that comes with or would be attached to apparatus 1.

A serial number on the bottom 12 of the base 2 or inside the base 2 may be provided that can be seen when the grid 20 and modified chessboard pieces 700 and 800 are removed.

The present invention presents a new and modified version of classical chess which introduces variability, luck, and new strategic considerations through one or more customizable rule-based layers (traps) to an additional dimension of the chess board and/or to the movable chess pieces themselves. The modified chess board of the invention better maintains the positional integrity of the pieces as well as the customized pre-set rule-based layers within individual compartments of the board during in-person live play and while games are temporarily halted and/or transported.

The described embodiments of the invention are intended to be exemplary, and numerous variations and modifications will be apparent to those skilled in the art. All such variations and modifications are intended to be within the scope of the invention. Although the present invention has been described and illustrated in detail, it is to be clearly understood that the same is by way of illustration and example only, and is not to be taken by way of limitation. It will be appreciated that various features of the invention which are, for clarity, described in the context of separate embodiments may also be provided in combination in a single embodiment. Conversely, various features of the invention which are, for brevity, described in the context of a single embodiment may also be provided separately or in any suitable combination. It is appreciated that particular embodiments described in the specification are intended only to provide a detailed disclosure of the present invention, and are not intended to be limiting. Modifications of the above disclosed apparatuses and methods which fall within the scope of the invention will be readily apparent to those of ordinary skill in the art. Accordingly, while the present invention has been disclosed in connection with exemplary embodiments thereof, it should be understood that other embodiments may fall within the spirit and scope of the invention.

Figure 64A:
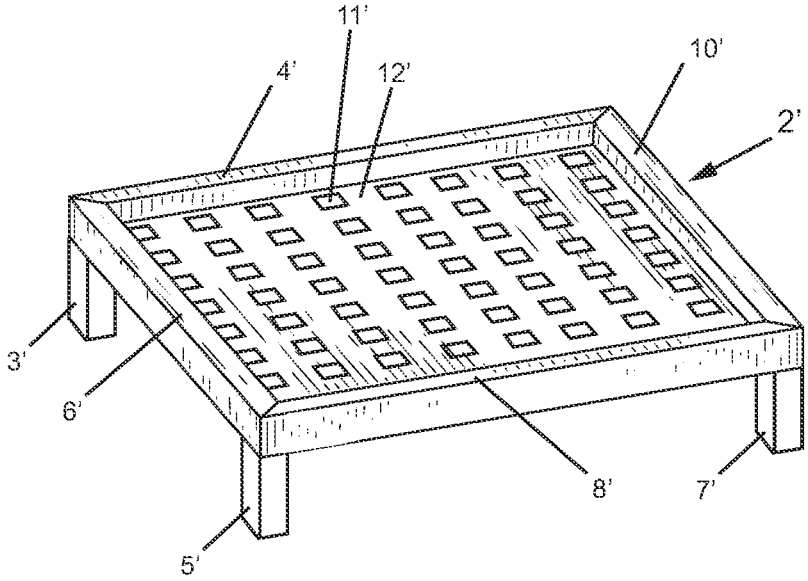
FIG. 64A is a is a left side, top, and front perspective view of a first modified base for use with a first modified version of the game board apparatus, in accordance with the present invention.
Figure 64B:
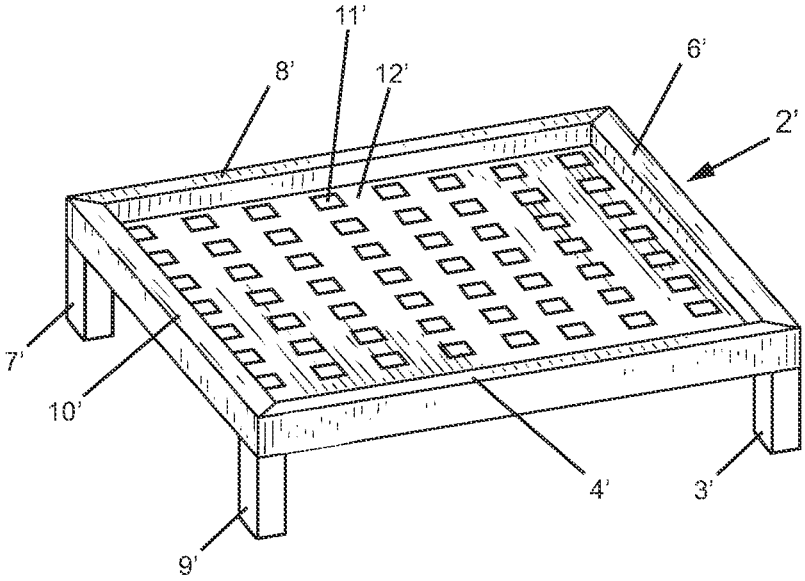
FIG. 64B is a is a right side, top, and rear perspective view of the first modified base of FIG. 64A.

FIG. 64A is a is a left side, top, and front perspective view of a first modified base 2' for use with a first modified version of the game board apparatus, in accordance with the present invention. FIG. 64B is a is a right side, top, and rear perspective view of the first modified base 2' of FIG. 64A. The first modified base 2' includes members 4', 6', 8', and 10' which may be identical to members 4, 6, 8, and 10, respectively, for base 2 of FIG. 1. The first modified base 2' further includes a bottom 12' which has a grid of a plurality of square openings or holes 11'. In at least one embodiment, these holes 11' are configured to align with spaces of grid 20 and with pieces or inserts 30 and/or 40 to allow a player to push underneath the bottom 12' to thereby remove one or more of pieces or inserts 30 and/or 40. In FIG. 64A at least parts of fifty-six holes 11' can be seen, however, the view of eight holes is being blocked by member 8' in the view of FIG. 64A, such that there are actually sixty-four holes which align with sixty-four grid spaces defined similarly or identically to the sixty-four grid spaces defined by grid 20 and members 4, 6, 8, and 10 shown in FIG. 1. Similarly, in FIG. 64B at least parts of fifty-six holes 11' can be seen, however, the view of eight holes is being blocked by member 4'.

Figure 65A:
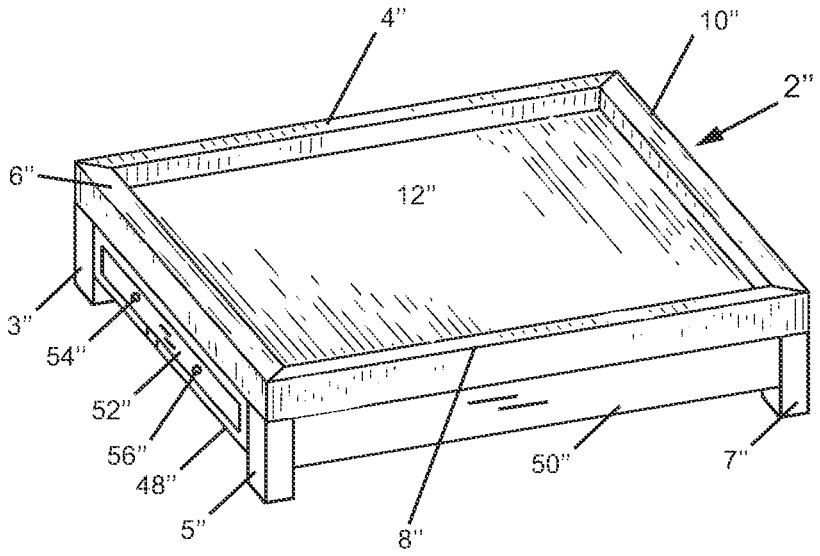
FIG. 65A is a is a left side, top, and front perspective view of a second modified base for use with a second modified version of the game board apparatus, in accordance with the present invention.
Figure 65B:
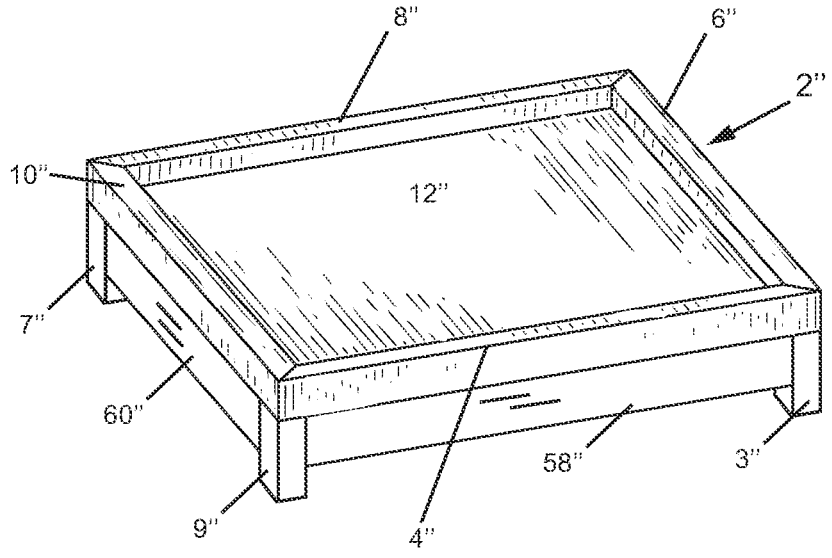
FIG. 65B is a is a right side, top, and rear perspective view of the second modified base of FIG. 65A.

FIG. 65A is a is a left side, top, and front perspective view of a second modified base 2" for use with a second modified version of the game board apparatus, in accordance with the present invention. FIG. 65B is a is a right side, top, and rear perspective view of the second modified base 2" of FIG. 65A. The second modified base 2" includes members 4", 6", 8", and 10" which may be identical to members 4, 6, 8, and 10, respectively, of the base 2 shown in FIG. 1. The second modified base 2" includes housing members 48" and 50" shown in FIG. 65A and housing members 58" and 60" shown in FIG. 65B. The second modified base 2" further includes a drawer 52" which is inserted in FIGS. 65A-B into a region defined by the housing members 50", 48", 58", and 60". The drawer 52" may have attached to it knobs 54" and 56", for sliding the drawer 52" away from the bottom 12". In FIGS. 65A and 65B the drawer 52" sits below, parallel to and substantially aligned with the bottom 12". The drawer 52" may be configured to store rules and game pieces of pieces 700 and 800, and inserts or pieces 30 and 40.

Figure 66A:
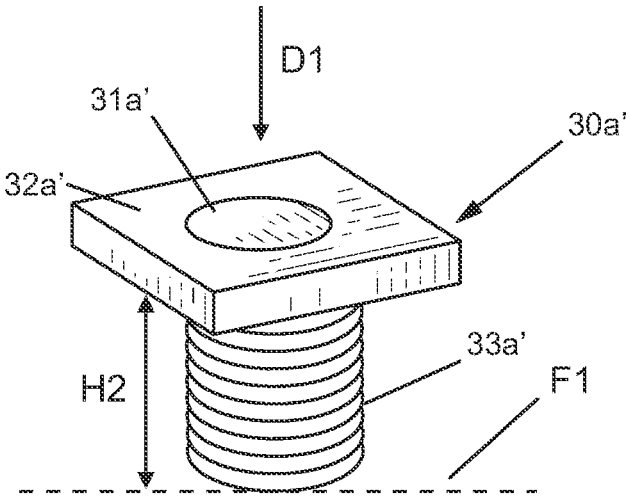
FIG. 66A is a left side, top, and front perspective view of a modified first piece, which may be any of the pieces of the first layer or the second layer of pieces of the game board apparatus, with the modified first piece in an expanded state.
Figure 66B:
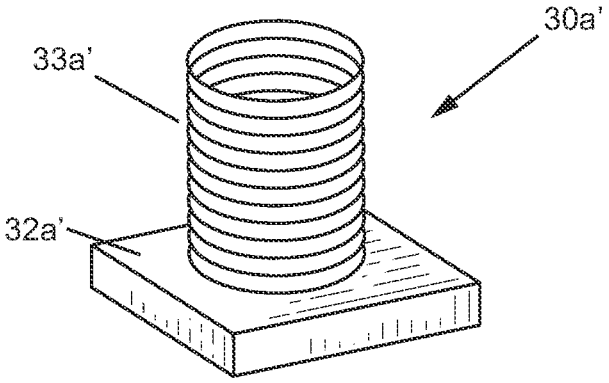
FIG. 66B is a left side, bottom, and rear perspective view of the modified first piece of FIG. 66A, in the expanded state.

FIG. 66A is a left side, top, and front perspective view of a modified first piece 30*a*', which may used for any of the pieces 30 of the first layer or the second layer of pieces 40 of the game board apparatus 1, with the modified first piece 30*a*' shown in an expanded state. The modified first piece 30*a*' may include body portion 32*a*' and piece 31*a*' which may be the same as body portion 32*a* and piece 31*a* of piece 30*a*. The modified first piece 30*a*' may further include spring, toggle, and/or retraction/expansion device 33*a*'. The device 33*a*' may be any known device, such as a spring device, which toggles between two states, typically an expanded state and a contracted state. FIG. 66B is a left side, bottom, and rear perspective view of the modified first piece 30*a*' of FIG. 66A, in the expanded state.

Figure 67A:
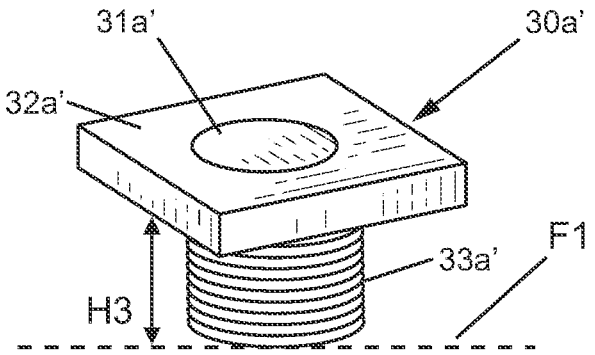
FIG. 67A is a left side, top, and front perspective view of the modified first piece, with the modified first piece in a contracted state.
Figure 67B:
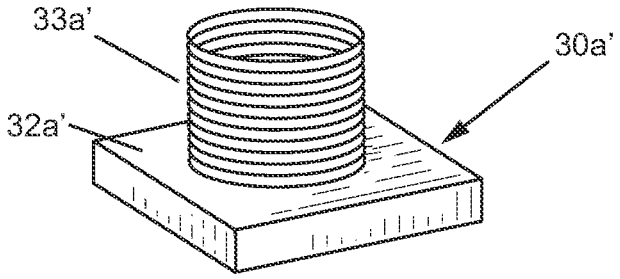
FIG. 67B is a left side, bottom, and rear perspective view of the modified first piece of FIG. 66A, in the contracted state.

FIG. 67A is a left side, top, and front perspective view of the modified first piece 30*a*', with the modified first piece in a contracted state. FIG. 67B is a left side, bottom, and rear perspective view of the modified first piece 30*a*' of FIG. 66A, in the contracted state.

In at least one embodiment, the modified piece 30*a*' is configured so that when a person pushes down on the body portion 32*a*' in the direction D1, shown in FIG. 66A, while the bottom end of the device 33*a*' (opposite an end fixed to the bottom of the piece 30*a*'), is resting on a flat surface shown simplistically by a dashed line F1, or such as on the bottom 12 of the apparatus 1, the piece device 33*a*' toggles from the expanded state in FIG. 66A to the contracted state in FIG. 67A or from the contracted state in FIG. 67A to the expanded state in FIG. 66A, depending on the start state. The toggle mechanism of device 33*a*' allows a piece, such as any of pieces 30 and/or 40, to be removed more easily from the apparatus 1 in FIG. 1. I.e. if the modified piece 30*a*' is used, it would typically start in a contracted state, when the board is set as in FIG. 1, and as shown in FIGS. 67A-B, and then the body portion 32*a*' which be pushed down in the direction D1 to change to the expanded state, so that the body portion 32*a*' would extend above walls 4, 6, 8, and 10 of base 2 to allow the piece 30*a*' (which may be any of pieces 30 or 40) to be removed from the base 2.

The distance between the end of device 33*a*'; sitting on flat surface F1 or bottom 12 of apparatus and the end of device 33*a*' attached to bottom of body portion 32*a*' in the expanded state of FIG. 66A is a height of H2. The distance between the end of device 33*a*'; sitting on flat surface F1 or bottom 12 of apparatus and the end of device 33*a*' attached to bottom of body portion 32*a*' in the contracted state of FIG. 67A is a height of H3, wherein H3 is less than H2. In at least one embodiment the height H3 in the contracted state may be very small, so that the apparatus 1 (as modified by using pieces 30*a*' for one or more of pieces 30 and 40) may be very similar to what is shown in FIG. 1. I.e. the height or level of the top layer of pieces 30 should still be level or close to level with the tops of members 4, 6, 8, and 10. In at least one embodiment, the members 4, 6, 8, and 10 may have greater heights when used with pieces that have spring or toggle devices 33*a*, so that the tops of members 4, 6, 8, and 10 are level with the top of grid 20 and/or with the maximum number of layers of pieces 30 and/or 40 to be used.

Figure 68A:
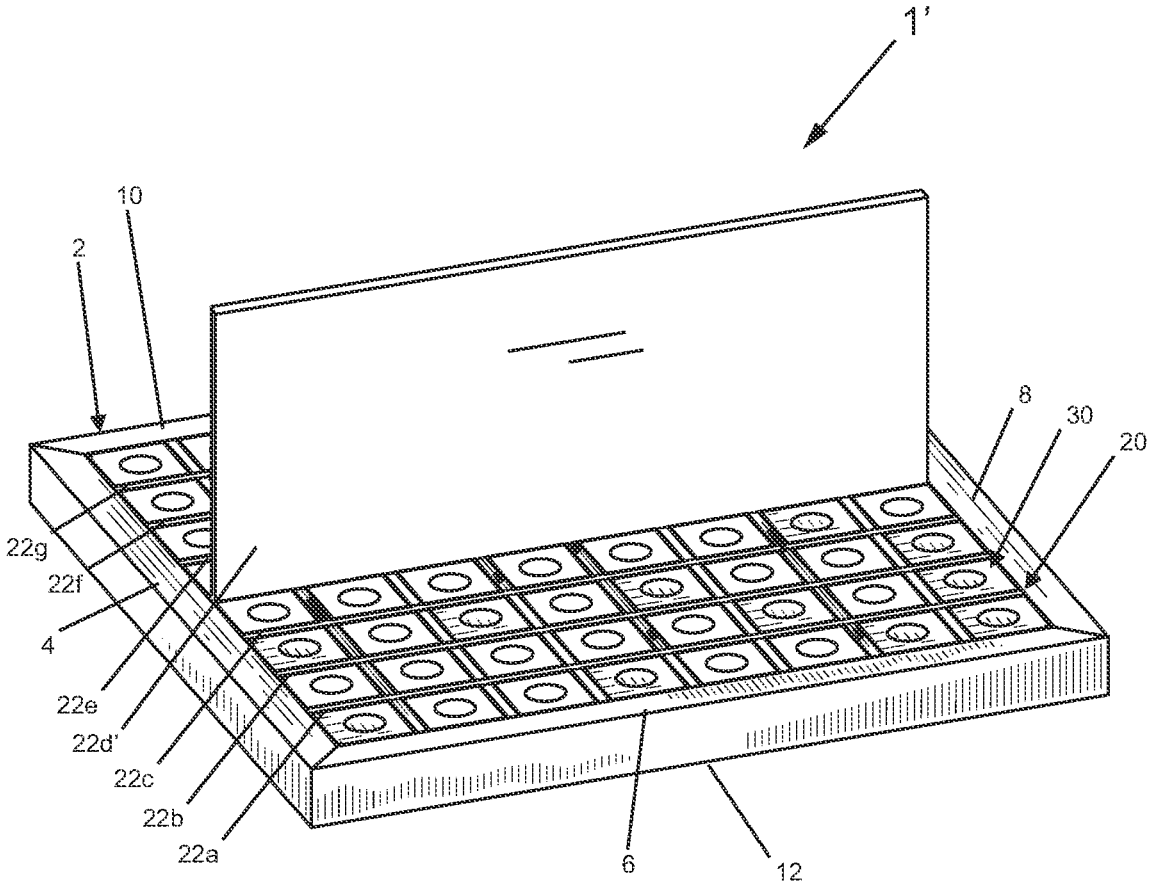
FIG. 68A shows a FIG. 1 is a rear, top, and left side perspective view of further modified game board apparatus, in accordance with the present invention, wherein the further modified game board apparatus is shown in a fully assembled state, and includes a divider.
Figure 68B:
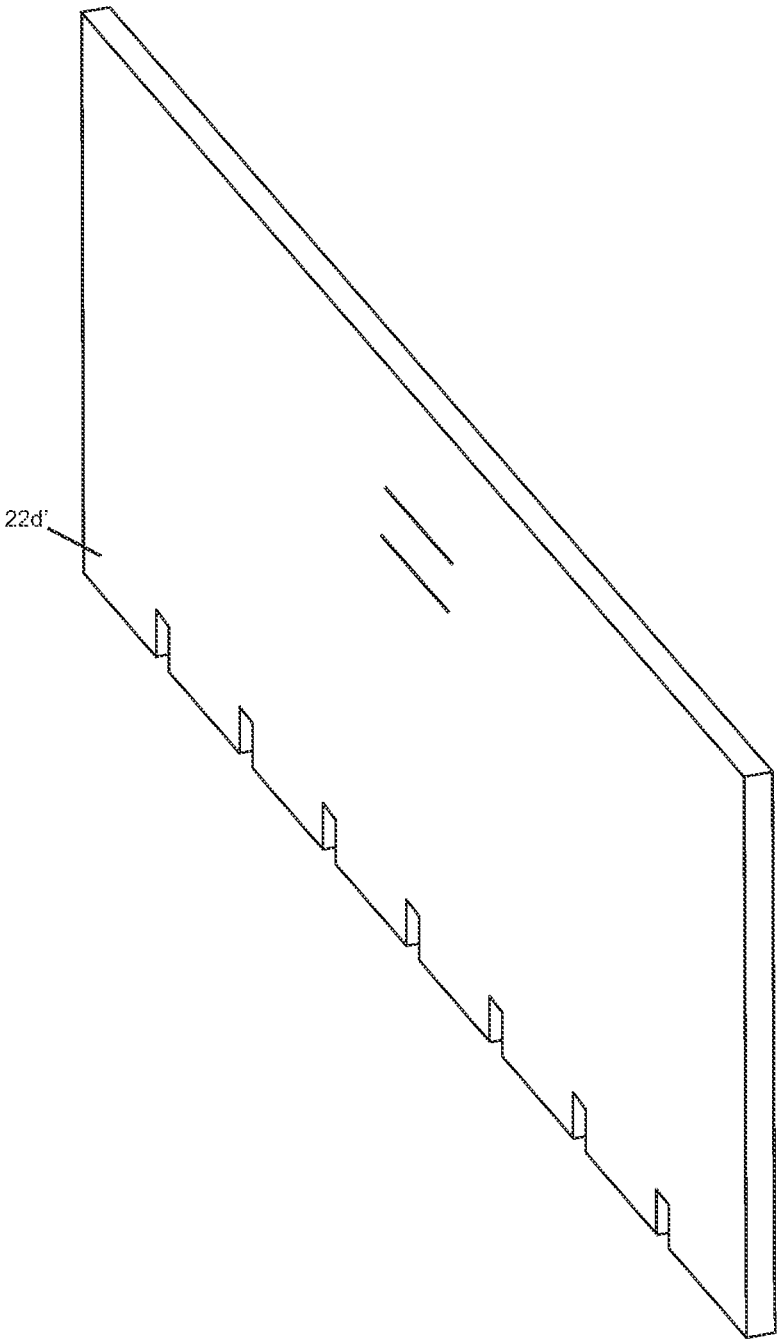
FIG. 68B shows a divider which may be one of the column and/or row members.

FIG. 68A is a rear, top, and left side perspective view of further modified game board apparatus 1', in accordance with the present invention, wherein the further modified game board apparatus 1' is shown in a fully assembled state, and includes a divider 22*d*' which is part of a column member or can be called a row member. FIG. 68B shows the divider 22*d*' which may be one of the column and/or row members. FIG. 68A shows a rotated apparatus 1, so that now members 22*a-g* become row members and members 24*a-g* become column members, but with divider 22*d*' replacing member 22*d*. The apparatus 1' may be identical to the apparatus 1 except for divider 22*d*' replacing member 22*d*. In addition, the pieces 700 would be placed on one side of the divider 22*d*' and the pieces 800 would be placed on the other side of the divider 22*d*' of FIG. 68A. For example, in the configuration of FIG. 68A, the pawn pieces of pieces 800 would be placed between member 22*b* and 22*a*, similar to as shown between member 24*f* and 24*g* in FIG. 56 and the other pieces of pieces 800 would be placed in FIG. 68A between member 22*a* and member 6 similar to as shown for FIG. 56 between member 24*g* and member 8. Also, in FIG. 68A, the pawn pieces of pieces 700 would be placed between members 22*f* and 22*g*, similar to as shown between members 24*a* and 24*b* in FIG. 56 and the other pieces of pieces 700 would be placed between member 24*g* and 10, similar to as shown between members 24*a* and 6 in FIG. 56.

Instead of the continuous integrated divider shown in FIG. 68B, the elongated member 22*d*' may have a central slot running along its entire length or substantially its entire length, into which a divider may be inserted.

Although the invention has been described by reference to particular illustrative embodiments thereof, many changes and modifications of the invention may become apparent to those skilled in the art without departing from the spirit and scope of the invention. It is therefore intended to include within this patent all such changes and modifications as may reasonably and properly be included within the scope of the present invention's contribution to the art.

I claim:

1. A game apparatus comprising:

a plurality of first player game pieces, each of which has a first portion that is a chess piece, such that the plurality of first player game pieces include two rooks, two knights, two bishops, one queen, one king, and eight pawns for a first player for a game of chess;

a plurality of second player game pieces, each of which has a portion that is a chess piece, such that the plurality of second player game pieces include two rooks, two knights, two bishops, one queen, one king, and eight pawns for a second player for a game of chess; and wherein each of the plurality of first player game pieces has a second portion fixed to a corresponding bottom of a corresponding first portion of each the plurality of first player game pieces;

wherein each of the plurality of second player game pieces has a second portion fixed to a corresponding bottom of a corresponding first portion of each the plurality of second player game pieces;

wherein each second portion of each of the plurality of first player game pieces has a recess at a rear of the second portion so that a cube is configured to be inserted into the recess in a manner so the cube cannot be seen from a front of the second portion; and wherein each second portion of each of the plurality of second player game pieces has a recess at a rear of the second portion so that a cube is configured to be inserted into the recess in a manner so the cube cannot be seen from a front of the second portion; and further comprising a base;

a grid; and a first plurality of insert pieces;

wherein the grid and the base form a chessboard pattern of a plurality of grid spaces; and wherein each of the first plurality of insert pieces fits within a space of the plurality of grid spaces; and wherein each of the first plurality of insert pieces has a device which toggles from an expansion state to a contraction state when pressed.

2. The game apparatus of claim 1 further comprising a second plurality of insert pieces;

and wherein each of the second plurality of insert pieces fits within a space of the plurality of grid spaces.

3. The game apparatus of claim 2 wherein each of the first plurality of insert pieces is configured to sit on top of one of the second plurality of insert pieces within a space of the plurality of grid spaces.

4. The game apparatus of claim 1 wherein each of the first plurality of insert pieces has a device which is subject to magnetic attraction.

5. The game apparatus of claim 2 wherein each of the first plurality of insert pieces has a device which is subject to magnetic attraction; and wherein each of the second plurality of insert pieces has a device which is subject to magnetic attraction.

6. The game apparatus of claim 1 wherein each of the plurality of grid spaces is surrounded by four walls at right angles to each other; and wherein each of the first plurality of insert pieces fits within a space of the plurality of grid spaces, such that each of the first plurality of insert pieces is surrounded by four walls at right angles to each other.

7. The game apparatus of claim 6 further comprising a second plurality of insert pieces;

and wherein each of the second plurality of insert pieces fits within a space of the plurality of grid spaces, such that each of the second plurality of insert pieces is surrounded by four walls at right angles to each other.

8. The game apparatus of claim 7 wherein each of the first plurality of insert pieces is configured to sit on top of one of the second plurality of insert pieces within a space of the plurality of grid spaces, such that each of the first plurality of insert pieces and each of the second plurality insert pieces is surrounded by four wall at right angles to each other.

9. The game apparatus of claim 6 wherein each of the first plurality of insert pieces has a device which is subject to magnetic attraction.

10. The game apparatus of claim 6 wherein each of the first plurality of insert pieces has a device which is subject to magnetic attraction; and wherein each of the second plurality of insert pieces has a device which is subject to magnetic attraction.

11. The game apparatus of claim 7 wherein each of the second plurality of insert pieces has a device which toggles from an expansion state to a contraction state when pressed.

12. The game apparatus of claim 6 wherein the base has a plurality of openings aligning with the plurality of grid spaces, such that the first plurality of insert pieces is configured to cover the plurality of openings, but not fall through the plurality of openings; and wherein the base has four corners, and there is a leg at each of the four corners lifting up a bottom of the base so that one can reach under the bottom of the base and push out through each of the plurality of openings each corresponding pieces of the first plurality of insert pieces.

13. The apparatus of claim 6 wherein there is a drawer located underneath the bottom of the base, wherein the drawer is configured to be pulled out from under the base.

14. A game apparatus comprising:

a plurality of first player game pieces, each of which has a first portion that is a chess piece, such that the plurality of first player game pieces include two rooks, two knights, two bishops, one queen, one king, and eight pawns for a first player for a game of chess;

a plurality of second player game pieces, each of which has a portion that is a chess piece, such that the plurality of second player game pieces include two rooks, two knights, two bishops, one queen, one king, and eight pawns for a second player for a game of chess; and wherein each of the plurality of first player game pieces has a second portion fixed to a corresponding bottom of a corresponding first portion of each the plurality of first player game pieces;

wherein each of the plurality of second player game pieces has a second portion fixed to a corresponding bottom of a corresponding first portion of each the plurality of first player game pieces;

wherein each second portion of each of the plurality of first player game pieces has a recess at a rear of the second portion so that a cube is configured to be inserted into the recess in a manner so the cube cannot be seen from a front of the second portion; and wherein each second portion of each of the plurality of second player game pieces has a recess at a rear of the second portion so that a cube is configured to be inserted into the recess in a manner so the cube cannot be seen from a front of the second portion; and further comprising a base;

a grid; and a first plurality of insert pieces;

wherein the grid and the base form a chessboard pattern of a plurality of grid spaces; and wherein each of the first plurality of insert pieces fits within a space of the plurality of grid spaces; and further comprising a second plurality of insert pieces;

and wherein each of the second plurality of insert pieces fits within a space of the plurality of grid spaces;

wherein each of the first plurality of insert pieces has a device which toggles from an expansion state to a contraction state when pressed; and each of the second plurality of insert pieces has a device which toggles from an expansion state to a contraction state when pressed.

15. A method comprising:

playing a game with a game apparatus comprising:

a plurality of first player game pieces and a plurality of second player game pieces, wherein the game is played on a chess board pattern;

wherein each of the plurality of first player game pieces has a first portion that is a chess piece, such that the plurality of first player game pieces include two rooks, two knights, two bishops, one queen, one king, and eight pawns for a first player for a game of chess;

wherein each of the plurality of second player game pieces, has a first portion that is a chess piece, such that the plurality of second player game pieces include two rooks, two knights, two bishops, one queen, one king, and eight pawns for a second player for a game of chess; and wherein each of the plurality of first player game pieces has a second portion fixed to a corresponding bottom of a corresponding first portion of each the plurality of first player game pieces;

wherein each of the plurality of second player game pieces has a second portion fixed to a corresponding bottom of a corresponding first portion of each the plurality of first player game pieces;

wherein each second portion of each of the plurality of first player game pieces has a recess at a rear of the second portion so that a cube is configured to be inserted into the recess in a manner so the cube cannot be seen from a front of the second portion; and wherein each second portion of each of the plurality of second player game pieces has a recess at a rear of the second portion so that a cube is configured to be inserted into the recess in a manner so the cube cannot be seen from a front of the second portion;

wherein the game apparatus further comprises:

a base;

a grid; and a first plurality of insert pieces;

wherein the grid and the base form a chessboard pattern of a plurality of grid spaces; and wherein each of the first plurality of insert pieces fits within a space of the plurality of grid spaces; and wherein each of the first plurality of insert pieces has a device which toggles from an expansion state to a contraction state when pressed.

16. The method of claim 15 wherein each of a first plurality of insert pieces fits within a space of the plurality of grid spaces.

17. The method of claim 15 wherein each of a second plurality of insert pieces fits within a space of the plurality of grid spaces.

18. The method of claim 17 wherein each of the first plurality of insert pieces is configured to sit on top of one of the second plurality of insert pieces within a space of the plurality of grid spaces.

19. The method of claim 15 wherein each of the first plurality of insert pieces has a device which is subject to magnetic attraction.

20. A method comprising: playing a game with a game apparatus comprised of a plurality of first player game pieces and a plurality of second player game pieces, wherein the game is played on a chess board pattern; wherein a grid and a base form the chess board pattern of a plurality of grid spaces, such that each of the plurality of grid spaces is surrounded by four walls at right angles to each other; and wherein each of a first plurality of insert pieces fits within a space of the plurality of grid spaces, such that each of the first plurality of insert pieces is surrounded by four walls at right angles to each other; wherein each of the plurality of first player game pieces has a first portion that is a chess piece, such that the plurality of first player game pieces include two rooks, two knights, two bishops, one queen, one king, and eight pawns for a first player for a game of chess; wherein each of the plurality of second player game pieces, has a first portion that is a chess piece, such that the plurality of second player game pieces include two rooks, two knights, two bishops, one queen, one king, and eight pawns for a second player for a game of chess; and wherein each of the plurality of first player game pieces has a second portion fixed to a corresponding bottom of a corresponding first portion of each the plurality of first player game pieces; wherein each of the plurality of second player game pieces has a second portion fixed to a corresponding bottom of a corresponding first portion of each the plurality of first player game pieces; wherein each second portion of each of the plurality of first player game pieces has a recess at a rear of the second portion so that a cube is configured to be inserted into the recess in a manner so the cube cannot be seen from a front of the second portion; and wherein each second portion of each of the plurality of second player game pieces has a recess at a rear of the second portion so that a cube is configured to be inserted into the recess in a manner so the cube cannot be seen from a front of the second portion; wherein the game apparatus further comprises: first plurality of insert pieces; and wherein each of the first plurality of insert pieces fits within a space of the plurality of grid spaces; and wherein each of the first plurality of insert pieces has a device which toggles from an expansion state to a contraction state when pressed.

21. The method of claim 20 wherein each of a second plurality of insert pieces fits within a space of the plurality of grid spaces, such that each of the second plurality of insert pieces is surrounded by four walls at right angles to each other.

22. The method of claim 21 wherein each of the first plurality of insert pieces is configured to sit on top of one of the second plurality of insert pieces within a space of the plurality of grid spaces, such that each of the first plurality of insert pieces and each of the second plurality insert pieces is surrounded by four wall at right angles to each other.

23. The method of claim 20 wherein each of the first plurality of insert pieces has a device which is subject to magnetic attraction.

24. The method of claim 20 wherein the base has a plurality of openings aligning with the plurality of grid spaces, such that the first plurality of insert pieces is configured to cover the plurality of openings, but not fall through the plurality of openings; and wherein the base has four corners, and there is a leg at each of the four corners lifting up a bottom of the base so that one can reach under the bottom of the base and push out through each of the plurality of openings each corresponding pieces of the first plurality of insert pieces.

25. The method of claim 20 wherein there is a drawer located underneath the bottom of the base, wherein the drawer is configured to be pulled out from under the base.

* * * * *